US012410667B2

(12) United States Patent
Eitschberger et al.

(10) Patent No.: US 12,410,667 B2
(45) Date of Patent: Sep. 9, 2025

(54) BALLISTICALLY ACTUATED WELLBORE TOOL

(71) Applicant: DynaEnergetics Europe GmbH, Troisdorf (DE)

(72) Inventors: Christian Eitschberger, Munich (DE); Thilo Scharf, Letterkenny (IE); Gernot Uwe Burmeister, Austin, TX (US)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 18/704,876

(22) PCT Filed: Oct. 10, 2022

(86) PCT No.: PCT/EP2022/078043
§ 371 (c)(1),
(2) Date: Apr. 25, 2024

(87) PCT Pub. No.: WO2023/072561
PCT Pub. Date: May 4, 2023

(65) Prior Publication Data

US 2024/0418047 A1 Dec. 19, 2024

Related U.S. Application Data

(60) Provisional application No. 63/347,056, filed on May 31, 2022, provisional application No. 63/271,466, filed on Oct. 25, 2021.

(51) Int. Cl.

| | |
|---|---|
| ***E21B 23/04*** | (2006.01) |
| ***E21B 33/12*** | (2006.01) |
| ***E21B 43/116*** | (2006.01) |

(52) U.S. Cl.
CPC ..... *E21B 23/0414* (2020.05); *E21B 33/12* (2013.01); *E21B 43/116* (2013.01)

(58) Field of Classification Search
CPC .... E21B 23/0414; E21B 33/134; E21B 29/10; E21B 23/065; E21B 43/116; E21B 33/12
See application file for complete search history.

(56) References Cited

U.S. PATENT DOCUMENTS

| | | | | |
|---|---|---|---|---|
| 6,257,331 | B1 * | 7/2001 | Blount | E21B 23/0414 166/123 |
| 2019/0284889 | A1 * | 9/2019 | Lagrange | E21B 47/04 |
| 2020/0115978 | A1 * | 4/2020 | Mickey | E21B 23/065 |

FOREIGN PATENT DOCUMENTS

| | | | | |
|---|---|---|---|---|
| WO | WO 2021013731 | * | 1/2021 | E21B 23/065 |

* cited by examiner

*Primary Examiner* — Yong-Suk (Philip) Ro
(74) *Attorney, Agent, or Firm* — Womble Bond Dickinson (US) LLP

(57) ABSTRACT

A ballistically actuated plug (2100) for being deployed in a wellbore casing includes a ballistic housing (2106) and an outer seal housing (2102). The ballistic housing includes a first housing portion including a chamber (2208), and a second housing portion having a noncompressible core. The outer seal housing is circumferentially disposed around the noncompressible core (2216). According to an aspect, the initiator (2206) is positioned within the chamber and a detonation extender (2222) is in ballistic communication with the initiator and is circumferentially disposed around the noncompressible core. The detonation extender is configured to, upon detonation, expand the outer seal housing (2102) from an unexpanded form to an expanded form to secure the outer seal housing within the wellbore casing.

14 Claims, 36 Drawing Sheets

BALLISTICALLY ACTUATED WELLBORE TOOL

CROSS-REFERENCE TO RELATED APPLICATIONS

This application claims the benefit of U.S. Provisional Patent Application No. 63/347,056 filed May 31, 2022 and U.S. Provisional Patent Application No. 63/271,466 filed Oct. 25, 2021, the entire contents of which are incorporated herein by reference in their entireties.

BACKGROUND

Hydraulic Fracturing (or, "fracking") is a commonly used method for extracting oil and gas from geological formations (i.e., "hydrocarbon bearing formations") such as shale and tight-rock formations. Fracking typically involves, among other things, drilling a wellbore into a hydrocarbon bearing formation, deploying a perforating gun including shaped explosive charges into the wellbore via a wireline or other methods, positioning the perforating gun within the wellbore at a desired area, perforating the wellbore and the hydrocarbon formation by detonating the shaped charges, and pumping high hydraulic pressure fracking fluid into the wellbore to force open perforations, cracks, and imperfections in the hydrocarbon formation to liberate the hydrocarbons and collect them via a wellbore tubing or casing within the wellbore that collects the hydrocarbons and directs them to the surface.

Various downhole operations may require actuating one or more tools, such as wellbore plugs (bridge plugs, frac plugs, etc.), tubing cutters, packers, and the like as are well known in the art. For example, in an aspect of a fracking operation, a plug-and-perforate ("plug-and-perf") operation is often used. In a plug-and-perf operation, a tool string including a plug, such as a bridge plug, frac plug, or the like, a setting tool for the plug, and one or more perforating guns are connected together and sent downhole. The plug assembly is located furthest downstream (in a direction further into the wellbore) in the string and is connected to the setting tool which is in turn connected to the bottom (downstream)-most perforating gun. The setting tool is for activating (i.e., expanding) the plug to isolate a portion of the wellbore to be perforated. Isolating these portions, or "zones", makes more efficient use of the hydraulic pressure of the fracking fluid by limiting the volume that the fracking fluid must fill in the wellbore before it is forced into the perforations.

Using a setting tool for deploying the plug adds length to the tool string as well as potential failure points at the connections to the perforating guns/plug. A typical setting tool may use a pyrotechnic igniter and/or explosive to generate pressure for moving a piston that in turn forces a pressure, which may be a hydraulic pressure, into the plug assembly to expand the plug and shear the plug from the setting tool. Once the plug is expanded it makes contact with an inner surface of the wellbore casing and creates a fluid seal between the plug and the wellbore casing to isolate the zone with respect to the wellbore casing. The setting tool may be retrieved with the spent perforating guns on the tool string, after the perforating operation. Considering that most plugs include a hollow interior for housing components and accepting the pressures that will expand the plug, once the plug is in place a resulting open passage in the plug must be sealed by, e.g., dropping into the wellbore a ball that is sized to set within an opening of the passage of the plug and thereby fully isolate the zone. This process continues for each zone of the wellbore. Once the perforating operations are complete and the wellbore is ready for production, the balls and/or plugs remaining in the wellbore must be drilled out to allow hydrocarbons to travel to the surface of the wellbore for collection.

These typical aspects of a plug-and-perf operation create certain undesirable issues for the operation. For example, increased length of the tool string, including the setting tool, affects ease of handling and deployment of the tool string. Components of the plug assembly that remain in the wellbore post-perforation create obstructive debris in the wellbore. And the delay between initiating the setting tool and ultimately expanding the plug by, e.g., at least one mechanical process, may lead to inaccurate positioning of the tool string and perforating guns within the wellbore.

Accordingly, integrated and instantaneously expanding plugs would be beneficial in plug-and-perf operations. Similarly, these principles and certain disadvantages as explained above may be encountered with a variety of wellbore tools that must be actuated within the wellbore, and the benefits associated with, e.g., an instantaneously expanding plug would be similarly applicable and beneficial for any wellbore tool that must be actuated within the wellbore according to particular operations as are known.

BRIEF SUMMARY

Embodiments of the disclosure are associated with a ballistically actuated plug for being deployed in a wellbore casing. The ballistically actuated plug includes a ballistic housing including a first housing portion. The first housing portion includes a chamber, and a second housing portion having a noncompressible core. According to an aspect, an initiator is positioned within the chamber. A detonation extender may be in ballistic communication with the initiator and may be circumferentially disposed around the noncompressible core of the second housing portion. According to an aspect, an outer seal housing is circumferentially disposed around the noncompressible core. The detonation extender is configured, upon detonation, to expand the outer seal housing from an unexpanded form to an expanded form to secure the outer seal housing within the wellbore casing.

Additional embodiments of the disclosure are associated with a ballistically actuated plug for being deployed in a wellbore casing. The ballistically actuated plug includes a ballistic housing including a first housing portion including a chamber, and a second housing portion extending from the first housing portion. According to an aspect, an initiator is positioned within the chamber, and a detonation extender in side-by-side contact with the initiator extends from the chamber to an outer surface of the second housing portion. An outer seal housing is circumferentially disposed around the second housing portion. According to an aspect, the detonation extender is configured, upon detonation, to expand the outer seal housing from an unexpanded form to an expanded form to secure the outer seal housing within the wellbore casing.

Further embodiments of the disclosure are associated with a wellbore tool assembly. The wellbore tool assembly includes a perforating gun assembly. A sub-assembly may be secured to the perforating gun assembly. According to an aspect, the sub-assembly includes a first sub portion and a second sub portion. The first sub portion is coupled to the perforating gun assembly. According to an aspect, the wellbore tool assembly further includes a ballistic housing including a first housing portion including a chamber, and a second housing portion having a noncompressible core.

According to an aspect, the second sub portion is coupled to the first housing portion. An initiator is positioned within the chamber, and a detonation extender is in ballistic communication with the initiator and is circumferentially disposed around the noncompressible core. The wellbore tool assembly may further include an outer seal housing circumferentially disposed around the noncompressible core. According to an aspect, the detonation extender is configured, upon detonation, to expand the outer seal housing from an unexpanded form to an expanded form to secure the outer seal housing within the wellbore casing, and when the outer seal housing is in the expanded form, the ballistic housing is disengaged from the outer seal housing.

BRIEF DESCRIPTION OF THE SEVERAL VIEWS OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1A:
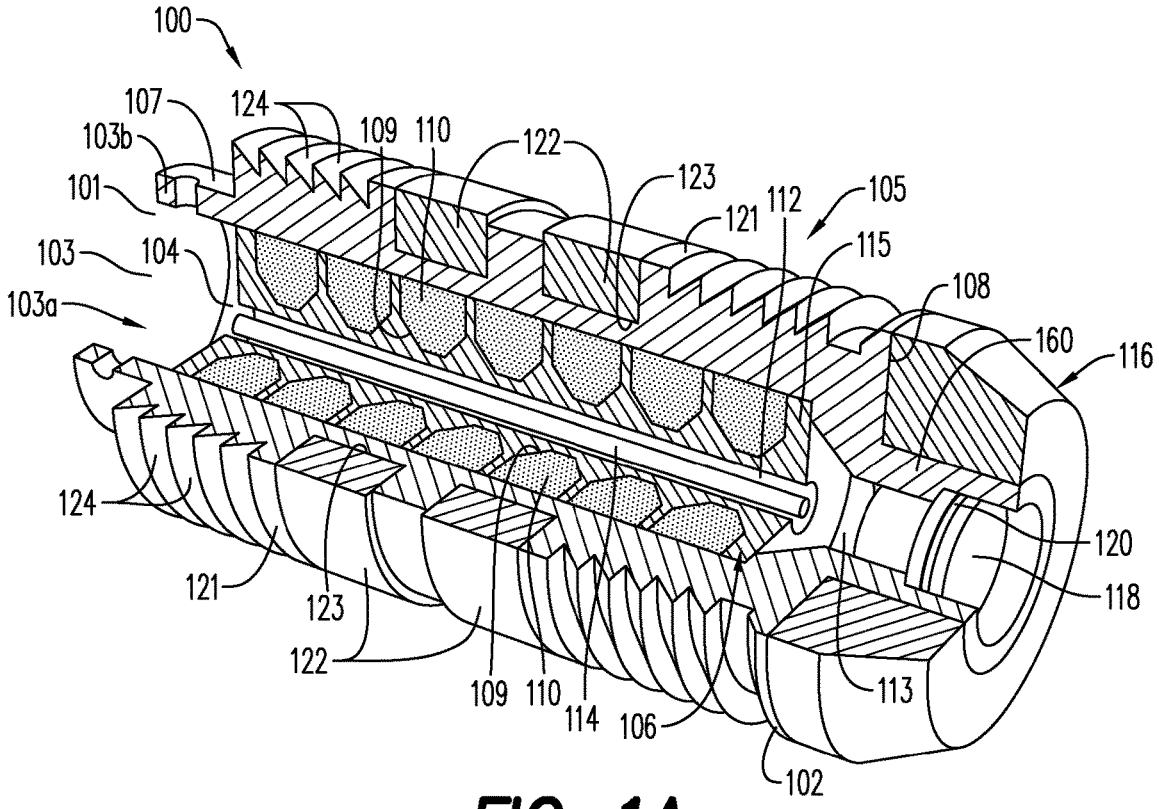
FIG. 1A is a partial cutaway view of an instantaneously expanding, ballistically actuated plug according to an exemplary embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

Embodiments described herein relate generally to devices, systems, and methods for instantaneously setting a plug in a wellbore. For purposes of this disclosure, "instantaneously" means directly resulting from an initiating event, e.g., an explosive event such as detonation of an explosive charge, substantially at the speed of the initiating event. For purposes of this disclosure, the phrases "devices," "systems," and "methods" may be used either individually or in any combination referring without limitation to disclosed components, grouping, arrangements, steps, functions, or processes.

For purposes of illustrating features of the embodiments, an exemplary embodiment will now be introduced and referenced throughout the disclosure. This example is illustrative and not limiting and is provided for illustrating the exemplary features of a ballistically actuated plug as described throughout this disclosure. Further, the exemplary embodiment(s) herein are presented representatively and for brevity with respect to a ballistically actuated plug but are not so limited. The exemplary principles and descriptions of a ballistically actuated wellbore tool are applicable not only to, e.g., wellbore plugs, but to any wellbore tool that must be actuated within the wellbore. For example, packers and other known wellbore or annular isolation tools may variously incorporate the disclosed structures, configurations, components, techniques, etc. under similar operating principles.

Figure 1B:
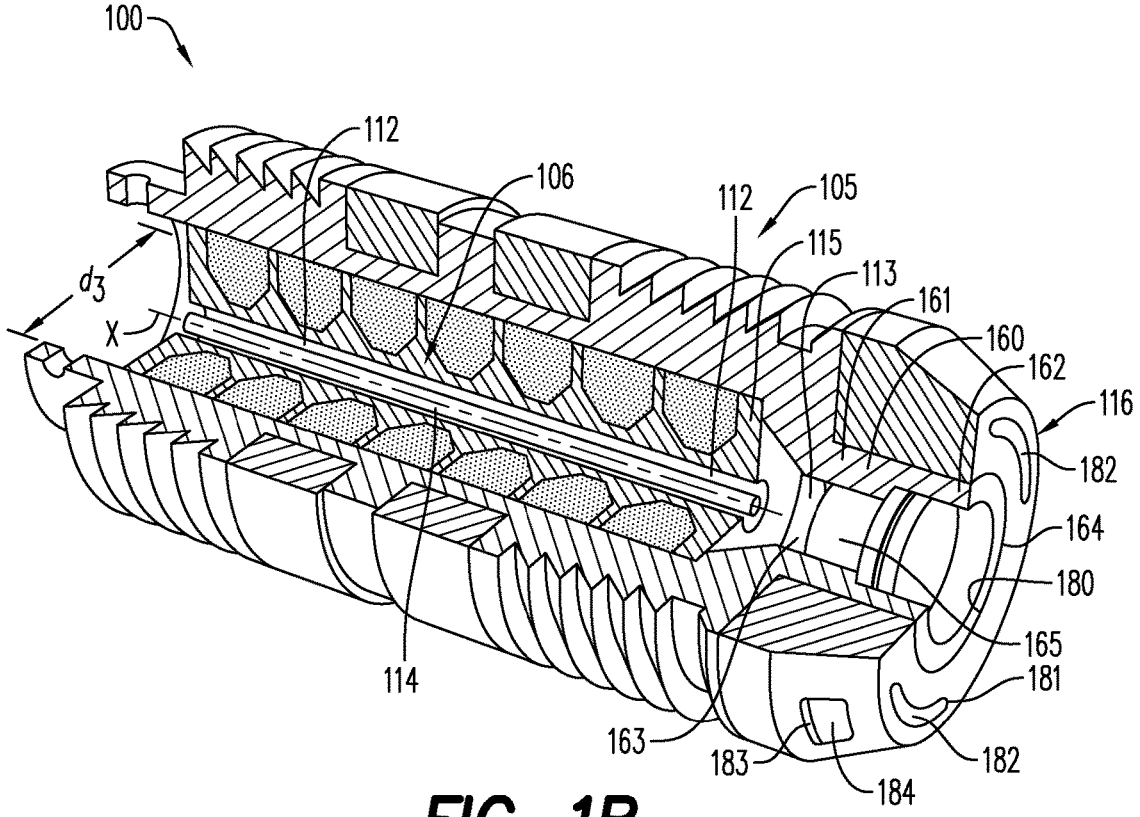
FIG. 1B is a partial cutaway view of an instantaneously expanding, ballistically actuated plug according to an exemplary embodiment.

FIG. 1A and FIG. 1B show exemplary embodiment(s) of a ballistically actuated plug 100 (i.e., instantaneously expanding plug) for being deployed in a wellbore. The exemplary ballistically actuated plug 100 includes, among other things, an outer carrier 105 having a first end 101 and a second end 102 opposite the first end 101 and defining a hollow interior chamber 104 within the outer carrier 105. In the exemplary embodiments shown in FIG. 1A and FIG. 1B, the hollow interior chamber 104 extends from the first end 101 of the outer carrier 105 to the second end 102 of the outer carrier 105.

Figure 3:
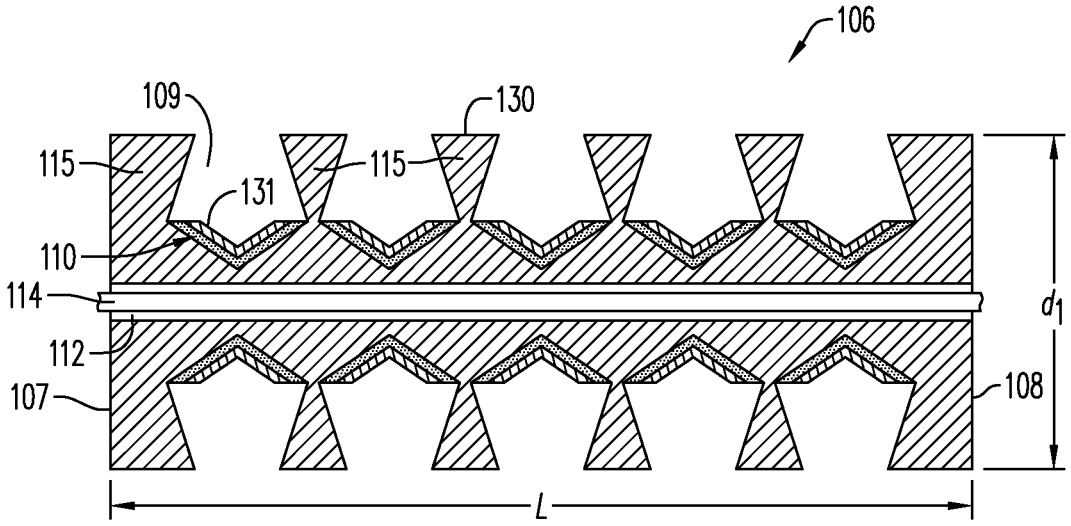
FIG. 3 shows a ballistic carrier according to an exemplary embodiment.
Figure 4:
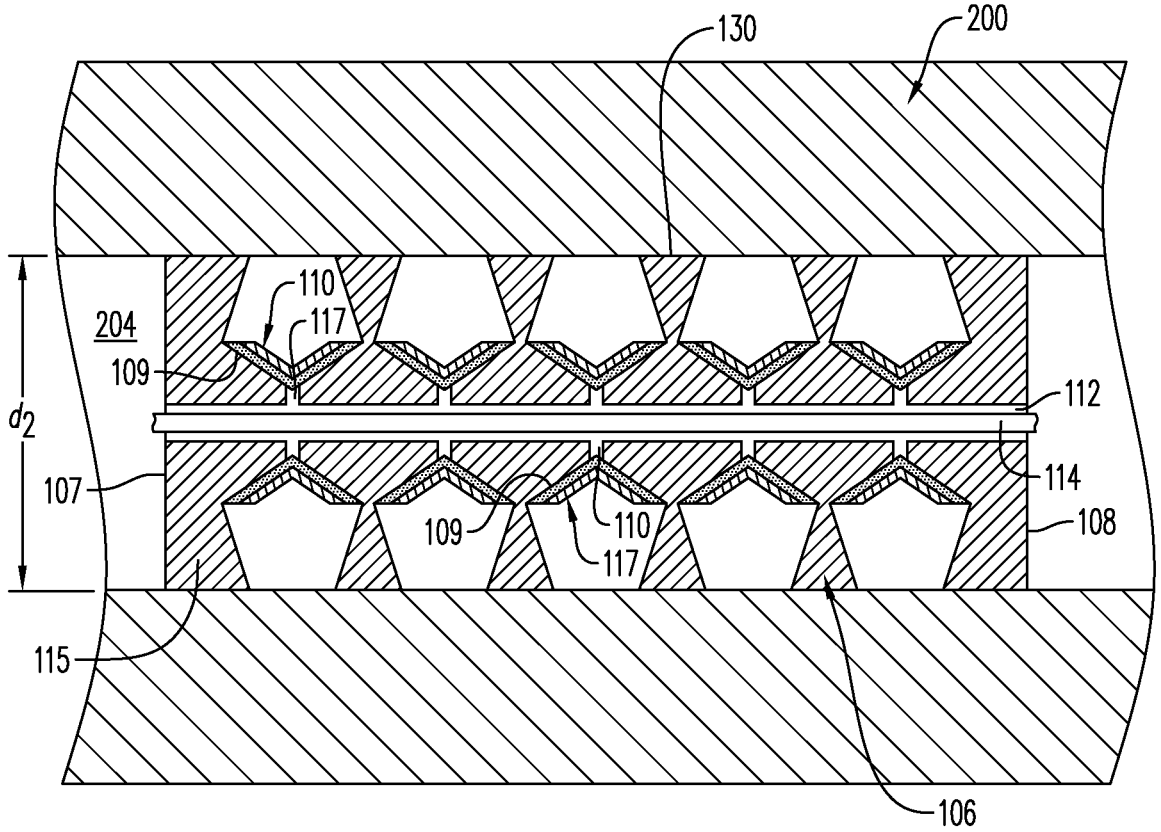
FIG. 4 shows a ballistic carrier in a wellbore tool, according to an exemplary embodiment.

With continuing reference to FIG. 1A and FIG. 1B, and further reference to FIG. 3 and FIG. 4, a ballistic carrier 106 is received and/or positioned within the hollow interior chamber 104 for ballistically actuating a wellbore tool, e.g. the wellbore plug 100. The ballistic carrier 106 includes a body portion 115 having a first end 107 and a second end 108 opposite the first end 107. A bore 112 is formed within and defined by the body portion 115 of the ballistic carrier 106 and extends along a length L of the ballistic carrier 106, an initiator 114 is positioned within the bore 112. In addition, the ballistic carrier 106 includes one or more ballistic components 110 positioned within ballistic slots 109 which are formed in an outer surface 130 of the body portion 115 of the ballistic carrier 106 and extend into the body portion 115 of the ballistic carrier 106. For purposes of this disclosure, a "ballistic component" is a component that generates one or more of kinetic energy (i.e., propelling physical components), thermal energy, and increased pressures upon initiation such as ignition or detonation of the ballistic component. The ballistic components 110 and the initiator 114 are relatively positioned for allowing the initiator 114 to initiate the ballistic components 110. While the exemplary embodiments disclosed herein include the ballistic carrier 106 for holding and orienting, e.g., the initiator 114 and the ballistic components 110, any structure or component consistent with this disclosure may be used for the same purpose. Such components may include, without limitation, a charge tube, strip, or stackable charge carriers. However, a particular orientation of the ballistic components 110 may not be required, in which case any structure or component for relatively positioning the initiator 114 and ballistic components 110 such that the initiator 114 will initiate the ballistic components 110 would be sufficient.

In an aspect of the exemplary embodiment(s), the ballistic carrier 106 may be formed from a substantially fragmentable or disintegrable material such as, without limitation, an injection molded plastic that will substantially fragment and/or disintegrate upon detonation of the ballistic components 110. The ballistic components 110 in such embodiments should thus have sufficient power for fragmenting and/or disintegrating the ballistic carrier 106. The ballistic components 110 may include any known explosive or incendiary components, or the like, for use in a wellbore operation. Non-limiting examples include shaped charges, explosive loads, black powder igniters, and the like.

In the exemplary embodiments, the ballistic components 110 may include, without limitation, explosive rings (such as linear shaped charges) in the ballistic slots 109 formed in the ballistic carrier 106. The ballistic slots 109 may be formed, without limitation, about an entire perimeter or periphery of the ballistic carrier 106 or as pockets therein. The explosive rings may be formed, for example, by pressing explosive powder, and then the explosive rings may be inserted into the ballistic slots 109. Alternatively, the explosive charges (explosive loads) may be pressed directly into the ballistic slots 109. In operation, the explosive charge may generate thermal energy and pressure forces for expanding the outer carrier 105 from an unexpanded form 170 to an expanded form 171 (see FIG. 2A and FIG. 2B) upon initiation of the ballistic components 110. The ballistic components 110 and the outer carrier 105 are together configured for instantaneously expanding the outer carrier 105 from the unexpanded form 170 to the expanded form 171 upon initiation of the one or more ballistic components 110. For example, expanding the outer carrier 105 occurs upon initiation of the ballistic components 110 and substantially as quickly as the pressure forces generated by initiation of the ballistic components 110 propagate to and act upon the outer carrier 105. Compare that exemplary operation with conventional plugs that rely on a setting tool and, in-part, on moving mechanical components after initiating, e.g., an explosive charge in the setting tool and before expanding the plug with forces generated by moving the mechanical components.

In an exemplary embodiment, the initiator 114 is a pressure sealed detonating cord. In other embodiments, the initiator 114 may be a detonator such as a wireless detonator as described in U.S. Pat. No. 9,605,937, which is commonly assigned to DynaEnergetics Europe GmbH and incorporated herein by reference in its entirety. In other embodiments, the initiator 114 may be an elongated booster. In other embodiments, the initiator 114 may be one or more detonating pellets. In other embodiments, the initiator 114 may include two or more of the above components in combination. Where the initiator 114 is a component such as a detonating cord, booster, detonating pellets, or other component that itself requires initiation, such initiation may be provided by, without limitation, a firing head, a detonator, an igniter, or other known devices and/or techniques for initiating a ballistic or incendiary component. Such initiation assembly may be configured or contained in, without limitation, a tandem seal adapter (TSA) (such as described with respect to FIGS. 5A-5C), or other known connectors or assemblies used to house an initiating component and relay an initiation signal or power thereto.

The initiator 114 may be completely or partially contained within the bore 112 of the ballistic carrier 106 according to the exemplary embodiments—at least a portion of the initiator 114 may be positioned within the bore 112 while a portion of the initiator 114 may lie outside of the bore 112 or even the outer carrier 105 according to certain embodiments discussed further below. As mentioned previously, the initiator 114 must at least be capable of initiating, either directly or indirectly (via ballistic components that have been directly initiated), the ballistic components 110 within the hollow interior chamber 104 of the outer carrier 105.

With continuing reference to FIGS. 1A, 1B, 3, and 4, in the exemplary embodiment(s) the ballistic components 110 are respectively positioned and oriented in the ballistic carrier 106 to fire radially outwardly upon initiation of the ballistic components 110. For purposes of this disclosure, "radially outwardly" means along a radius from a center point in a direction away from the center point. For example, the ballistic components 110 in the exemplary embodiments will fire in a direction from the bore 112 within the body portion 115 of the ballistic carrier 106 towards the outer carrier 105. For purposes of this disclosure, a direction in which respective ballistic components 110 "fire" means a direction in which an explosive jet, pressure force, and/or kinetic energy propagate from the respective ballistic component 110 upon initiating the ballistic component 110. Controlling the direction in which the ballistic components 110 fire may aid in expanding the outer carrier 105 from an unexpanded form 170 to an expanded form 171, as will be discussed below with respect to FIG. 2A and FIG. 2B. The direction in which the ballistic components 110 fire may be controlled by, e.g., the orientation of the ballistic slots 109. In the exemplary embodiment(s), the ballistic slots 109 extend radially outwardly in a direction from the bore 112 to the outer carrier 105—i.e., from a portion of the ballistic slot 109 containing the pressed explosive charge to the opening of the ballistic slot 109 on the outer surface 130 of the body portion 115 of the ballistic carrier 106 from which the explosive jet/energy will be ejected.

In the exemplary embodiments, the ballistic slots 109 may be formed, without limitation, as pockets or depressions extending from the outer surface 130 of the body portion 115 of the ballistic carrier 106 into the body portion 115 of the ballistic carrier 106, or as channels extending around at least a portion of a circumference of the exemplary cylindrically-shaped ballistic carrier 106. The exemplary bore 112 may be formed as an axial bore extending along a longitudinal axis x through the body portion 115 of the ballistic carrier 106 and adjacent to the ballistic slots 109 at a portion of the ballistic slots 109 containing at least a portion of the pressed explosive charges.

The direction in which the ballistic components 110 fire is not limited by the disclosure—the ballistic components 110 may fire in any direction, uniformly or individually, at random or according to a particular orientation, provided that the ballistic components 100 are configured with, for example and without limitation, a type and amount of explosive sufficient for generating the energy and forces required for expanding the outer carrier 105.

In addition, and as will be discussed below, the ballistic components 110 may also be used to fragment and/or disintegrate the ballistic carrier 106 upon setting the ballistically actuated plug 100. Accordingly, it may be beneficial for at least some of the ballistic components 110 to fire radially inwardly, i.e., in a direction from a point within or at the outer surface 130 of the body portion 115 of the ballistic carrier 106 towards the axis x. In an example of such embodiment (not illustrated in the Figures), the ballistic component 110 may be a shaped charge positioned such that an open end (i.e., an end through which the explosive jet is expelled) of the shaped charge is on the outer surface 130 of, or within, the body portion 115 of the ballistic carrier 106, to direct the explosive jet into the body portion 115 towards the axis x. In an aspect of such embodiment, an initiation end (i.e., an end adjacent to an initiator) of the shaped charge may be opposite the open end and adjacent to an initiator outside or on the outer surface 130 of the body portion 115 of the ballistic carrier 106. In another example of such embodiment (not illustrated in the Figures), a ballistic slot 109 may be formed as a pocket extending from the outer surface 130 of the ballistic carrier 106 into the body portion 115 of the ballistic carrier 106 and past the longitudinal axis x, such that a portion of the ballistic slot 109 containing the explosive charge is on a side of the longitudinal axis x that is opposite a side into which the ballistic slot 109 extends from the outer surface 130 of the body portion 115 of the ballistic carrier 106. In an aspect of such embodiment, the bore 112 may be positioned off-center within the body portion 115 of the ballistic carrier 106 and adjacent to the portion of the ballistic slot 109 containing the explosive charge, and the initiator 114 may be positioned within the bore 112.

In certain embodiments, the ballistic carrier 106 may include a plurality of ballistic components 110 variously configured to fire in different directions from different orientations. In such embodiments, one or more corresponding initiators in, e.g., corresponding bores and/or outside or on the outer surface 130 of the body portion 115 of the ballistic carrier 106 may be respectively positioned for initiating each of the plurality of ballistic components 110.

In certain embodiments, the ballistic carrier 106 may include a plurality of ballistic components 110 variously configured to fire in different directions. In such embodiments, respective portions of ballistic slots 109 containing the explosive charge may not all be positioned along a single axis or around a single point. In an aspect of such embodiments, the ballistic carrier 106 may include a plurality of initiators respectively positioned within corresponding bores, and the corresponding bores may be respectively positioned adjacent to corresponding respective portions of the ballistic slots 109 containing the explosive charge.

In an aspect, where the ballistic components 110 are explosive charges pressed into the ballistic slots 109 according to the exemplary embodiment(s), the explosive charges may be covered in whole or in part by a liner 131 (FIG. 3). Upon initiation of the explosive charges the liner 131 will collapse and form a jet of material with kinetic energy that may enhance the fragmentation or disintegration of the ballistic carrier 106 according to known principles.

The ballistic components 110 and the outer carrier 105 are together configured for deforming and radially expanding the outer carrier 105 upon initiation of the ballistic components 110. For example, the ballistic components 110 may have a certain explosive force and the outer carrier 105 may be formed in a configuration and/or from a material with physical properties sufficient to achieve the desired expansion of the outer carrier 105 upon initiation of the ballistic components 110. For example, the outer carrier 105 may be formed from a ductile material such as steel having a high yield strength (e.g., >1000 MPa) and impact strength (e.g., Charpy Value >80 J), according to the ASTM-A519 specifications. Other exemplary materials may be aluminum, strong plastics (including injection molded plastics), and the like having the requisite ductility for swelling, resistance to the wellbore environment, and resiliency (i.e., not too brittle) for being drilled out after use.

Accordingly, the exemplary ballistically actuated plug 100 sets by expanding only radially outwardly, without lateral moving parts, into the wellbore casing 300 (FIG. 2B) and does not require a setting tool or moving parts such as pistons with mechanical connections.

As discussed further below, a sufficient degree of "swell"—i.e., the degree to which the size of the outer carrier 105 is expanded upon ballistic actuation—is required for the exemplary instantaneously expanding, ballistically actuated plug 100 to seal within the wellbore in the expanded state 171. For example, initiation of the ballistic components 110 must cause sufficient controlled plastic deformation of the outer carrier 105 to expand the outer carrier 105 enough for engaging and sealing elements (discussed below) to contact the inner wellbore surface and thereby hold, anchor, and seal the ballistically actuated plug 100 thereto, without causing failure of the ballistically actuated plug 100 by, for example, splitting the outer carrier 105. Various considerations that may affect swell include the ratio of explosive mass to free volume within the wellbore tool, the material from which the swellable component is formed and properties such as, without limitation, the yield strength of the material, the thickness of the swellable component(s) such as the outer carrier 105, and the type of ballistic component(s) (e.g., explosive loads, detonating cords, explosive pellets, etc.). Other considerations may be applicable for particular actuatable wellbore tools. In the case of the ballistically actuated plug 100, for example, the type and position of the ballistic components 110 within the outer carrier 105 may affect the degree of swell at different portions/positions of the outer carrier 105. These concepts are discussed further below with respect to the test results being provided herein.

With continuing reference to FIG. 1A and FIG. 1B, the exemplary outer carrier 105 includes a plurality of external gripping teeth 124 formed on an outer surface 121 of the outer carrier 105. The outer carrier 105 is dimensioned such that the gripping teeth 124 will contact an inner surface 301 (FIG. 2B) of a wellbore casing 300 when the outer carrier 105 is in the expanded form. The gripping teeth 124 are shaped to frictionally grip the inner surface 301 of the wellbore casing 300 and thereby position the ballistically actuated plug 100 within the wellbore casing 300 and form a partial or total seal between the gripping teeth 124 and the inner surface 301 of the wellbore casing 300, when the outer carrier 105 is in the expanded form 171. By one understood measure in the art, a successful set for a plug in a plug-n-perf operation requires that the plug does not move or exert any significant signs of pressure loss or leakage under 10,000 psi of hydraulic pressure differential.

The exemplary ballistically actuated plug 100 also includes at least one sealing element 122 extending along at least a portion of the outer surface 121 of the outer carrier 105. In the exemplary embodiment(s) illustrated in FIG. 1A and FIG. 1B, two sealing elements 122, such as o-rings, extend around a circumference of the outer surface 121 of the outer carrier 105, within a depression 123 formed in the outer surface 121 of the outer carrier 105. Securing the sealing elements 122 within a complimentary receptacle such as depression 123 may help to maintain the position and configuration of the sealing elements 122 as the ballistically actuated plug 100 is pumped down into the wellbore. However, the sealing elements 122 in various embodiments may take any shape or configuration including with respect to fitting the sealing elements 122 on/to the outer carrier 105 or other portions of a ballistically actuated plug consistent with this disclosure.

The sealing elements 122 are formed from a material and in a configuration such that, in operation, the sealing elements 122 will expand along with the outer carrier 105 when the ballistic components 110 are initiated. The outer carrier 105 and the sealing elements 122 are dimensioned such that the sealing elements 122 will contact the inner surface 301 of the wellbore casing 300 and form a seal between the inner surface 301 of the wellbore casing 300 and the sealing elements 122 when the outer carrier 105 is in the expanded form 171.

With further reference to FIG. 1A and FIG. 1B, the exemplary embodiment(s) of the ballistically actuated plug 100 may include a bumper 116 secured to the second end 102 of the outer carrier 105. The ballistically actuated plug 100 is deployed in the wellbore with the second end 102 of the outer carrier 105 and bumper 116 downstream, i.e., further into the wellbore, than the first end 101 of the outer carrier 105. The bumper 116 may provide protection from impacts with the wellbore casing 300 as the ballistically actuated plug 100 is pumped down into the wellbore. The bumper 116 may be made from, without limitation, a plastic or rubber material such that the bumper 116 will absorb impacts on the wellbore casing 300. In an aspect, and with specific reference to FIG. 1B, an exemplary embodiment the bumper 116 may include one or more gills 181 having an inlet 182 in fluid communication with an outlet 183 and a flap 184 covering at least a portion of the outlet 183. As described below, as the ballistically actuated plug 100 is pumped down the wellbore the bumper 116 will be the leading end and wellbore fluid within the wellbore casing 300 will pass through the gills 181, from the inlet 182 to the outlet 183, and the flap 184 will provide additional resistance to the fluid flow as it exits the outlet 183. The flap 184 may be a stationary surface feature that covers a consistent portion of the outlet 183 or it may be, for example and without limitation, a bendable piece of material that is capable of opening and closing to different degrees, based on the velocity of the fluid flow, to dynamically adjust to changing conditions of the wellbore fluid. Generally, the gills 181 may help to stabilize and/or slow the pace of the ballistically actuated plug 100 as it is pumped down the wellbore, thereby decreasing impacts between the ballistically actuated plug 100 against the wellbore casing 300 and providing more control for positioning the ballistically actuated plug 100 at a desired location within the wellbore casing 300. In addition, the gills 181 may decrease fluid consumption for pumping the ballistically actuated plug 100 down into the wellbore, by allowing fluid in front (i.e., downstream) of the ballistically actuated plug 100 to pass through the gills 181 and thereby decreasing the pressure and friction acting against the leading end of the ballistically actuated plug 100 as it is pumped down.

The bumper 116 may be connected to the second end 102 of the outer carrier 105 using adhesives, tabs, melding, bonding, and the like. In the exemplary embodiment(s) that FIG. 1A and FIG. 1B show, the bumper 116 is annular and a neck portion 160 of the outer carrier 105 extends from the outer carrier 105 and passes through an interior opening 180 of the annular bumper 116. A friction fit between the neck portion 160 and the inner surface (unnumbered) of the bumper 116 bounding the interior opening 180 may further secure the bumper 116 to the outer carrier 105 at the second end 102 of the outer carrier 105.

The neck portion 160 may be integrally (i.e., as a single piece) formed with the outer carrier 105 or bonded or machined on the outer carrier 105, or provided in the disclosed configuration, or other configuration(s) consistent with this disclosure, according to known techniques. For purposes of this disclosure, the "neck portion 160" is so called to aid in the description of the exemplary ballistically actuated plug 100 and without limitation regarding the delineation, position, configuration, or formation of the neck portion 160 with respect to the outer carrier 105 or other components. In the exemplary embodiments, for example, the neck portion 160 is formed integrally with the outer carrier 105, as a portion with a reduced outer diameter as compared to the outer carrier 105. The neck portion 160 includes a first end 161 and a second end 162 opposite the first end 161 and a channel 165 is formed within the neck portion 160 and defined by the neck portion 160. In the exemplary embodiments, the channel 165 extends from a first opening 163 on the first end 161 of the neck portion 160 to a second opening 164 on the second end 162 of the neck portion 160, wherein the channel 165 is adjacent and open to a second end opening 113 of the outer carrier 105, via the first opening 163 of the channel 165. The second end opening 113 of the outer carrier 105 is adjacent and open to the hollow interior chamber 104 of the outer carrier 105, and is effectively a terminus of the hollow interior chamber 104 at the second end 102 of the outer carrier 105.

The second opening 164 of the channel 165 within the neck portion 160 is sealed by a seal disk 118 positioned within the channel 165 and dimensioned to seal the channel 165 by engaging an inner surface (unnumbered) of the neck portion 160 bounding the channel 165. The seal disk 118 may include an additional sealing element, for example, o-ring 120. The ballistic components 110 are configured to dislodge the seal disk 118 from the channel 165 upon initiation of the ballistic components 110. Dislodging the seal disk 118 in combination with fragmenting the ballistic carrier 106 upon initiating the ballistic components 110 provides a flow path for hydrocarbons being recovered through the ballistically actuated plug 100, as explained below with respect to operation of the ballistically actuated plug 100. Accordingly, in the exemplary embodiments the ballistic components 110 are configured for fragmenting or disintegrating the ballistic carrier 106 upon initiation of the ballistic components 110 and the ballistic carrier 106 is formed from a fragmentable or breakable material such as injection molded plastic.

The outer carrier 105 includes a first end opening 103 at the first end 101 of the outer carrier 105 opposite the second end opening 113 at the second end 102 of the outer carrier, and the hollow interior chamber 104 extends from the first end opening 103 to the second end opening 113 and is open to each of the first end opening 103 and the second end opening 113. The first end opening 103 has a rim 103*b* that defines a passage 103*a* through the first end opening 103 of the outer carrier 105. In the exemplary embodiment(s), the passage 103*a* has a diameter ds that is smaller than a diameter de (FIG. 4) of the hollow interior chamber 104. Thus, once the ballistic carrier 106 has been fragmented or disintegrated and the seal disk 118 has been dislodged from the channel 165, a flow path exists through the ballistically actuated plug 100 from the second opening 164 of the channel 165 to the first end opening 103 of the outer carrier 105.

Figure 2A:
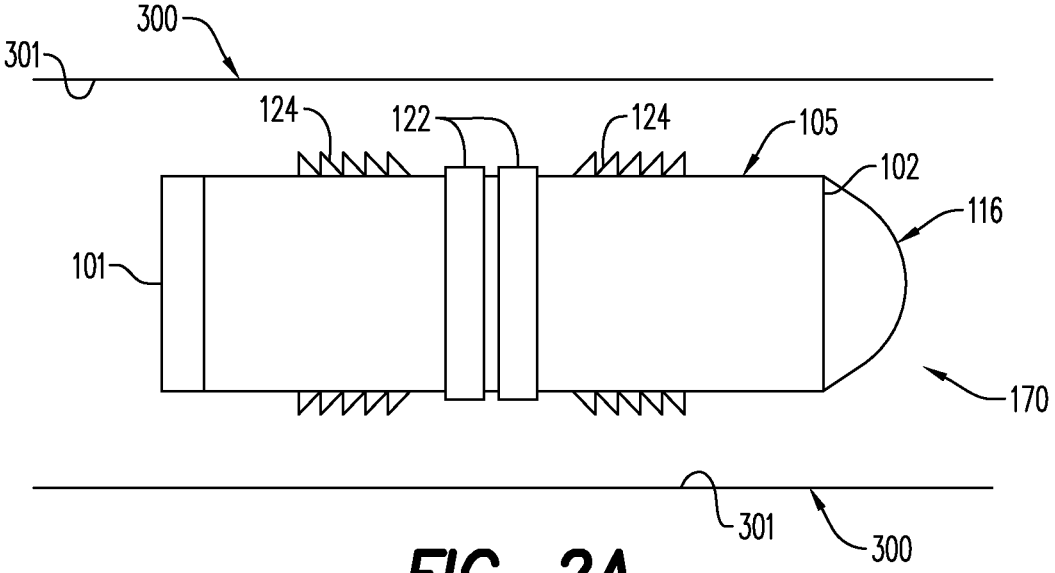
FIG. 2A shows an instantaneously expanding, ballistically actuated plug in an unexpanded form, according to an exemplary embodiment, inside of a wellbore casing.

In an operation of the exemplary ballistically actuated plug 100, and with reference to FIG. 2A, the ballistically actuated plug 100 in the unexpanded form 170 is pumped downhole via pump-down fluid in the wellbore casing 300 with the second end 102 of the outer carrier 105, including the bumper 116, downstream of the first end 101 of the outer carrier 105, i.e., with the second end 102 of the outer carrier 105 being the leading end in the direction of travel. Upon initiation of the ballistic components 110, the outer carrier 105 expands into its expanded form 171 in which the external teeth 124 and sealing element 122 of the outer carrier 105 engage the inner surface 301 of the wellbore casing 300 in a frictional, sealing engagement.

Figure 2B:
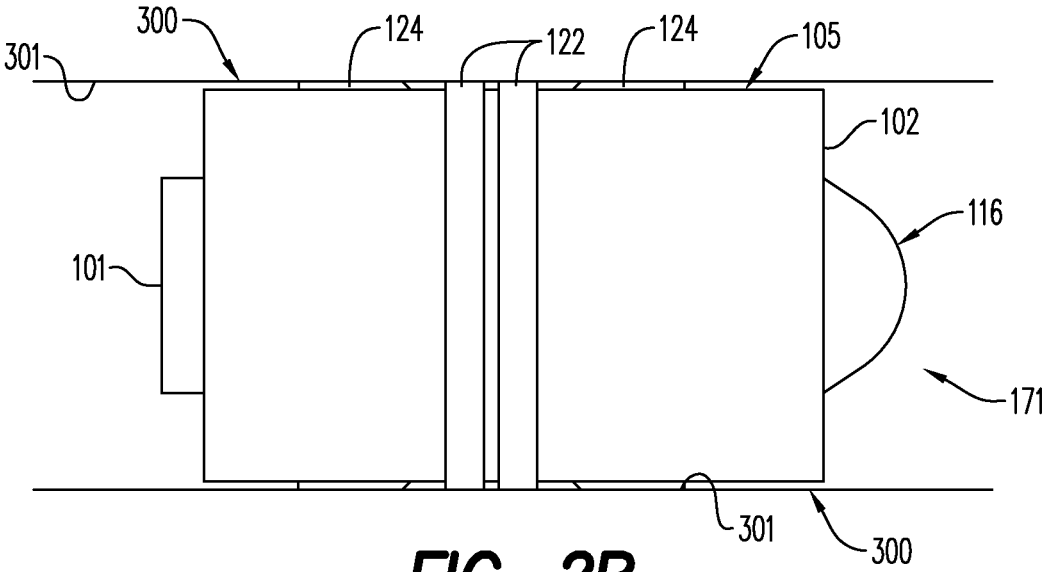
FIG. 2B shows an instantaneously expanding, ballistically actuated plug in an expanded form, according to an exemplary embodiment, inside of a wellbore casing.

Similarly to FIG. 2A, in FIG. 2B the ballistically actuated plug 100 in the unexpanded form 170 may be pumped downhole via pump-down fluid in the wellbore casing 300 with the second end 102 of the outer carrier 105, including the bumper 116, downstream of the first end 101 of the outer carrier 105, i.e., with the second end 102 of the outer carrier 105 being the leading end in the direction of travel. Upon initiation of the ballistic components 110, the outer carrier 105 expands into its expanded form 171 in which the external teeth 124 and sealing element 122 of the outer carrier 105 engage the inner surface 301 of the wellbore casing 300 in a frictional, sealing engagement.

Figure 2C:
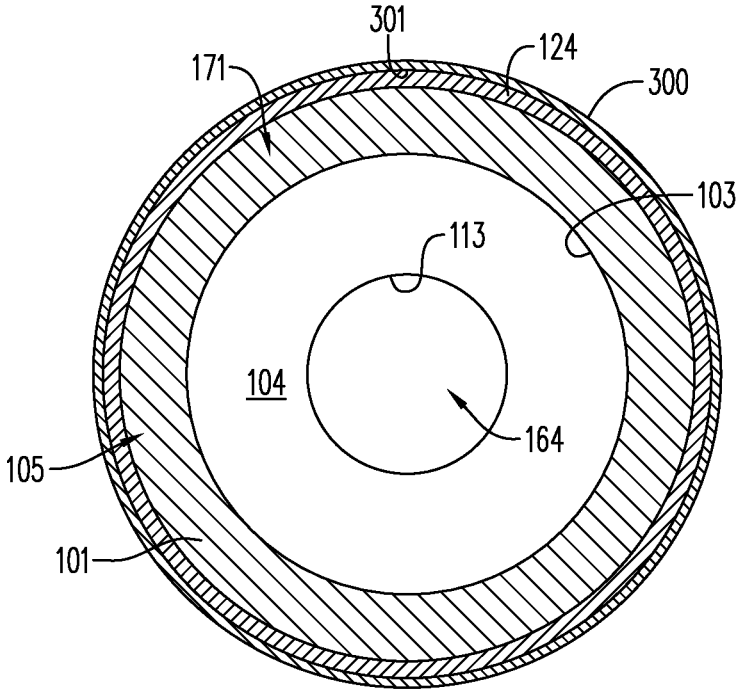
FIG. 2C shows a cross-sectional end view of an exemplary instantaneously expanding, ballistically actuated plug in an expanded form within a wellbore.

With reference to FIG. 2C, a rear cross-sectional view of the ballistically actuated plug 100 in its expanded form 171 is shown from upstream in the wellbore casing 300, towards the first end 101 of the outer carrier 105, and through the outer carrier 105 via the first end opening 103 of the outer carrier 105 and the hollow interior chamber 104 of the outer carrier 105. After the ballistic components 110 have detonated, and the ballistic carrier 106 has been fragmented and the seal disk 118 has been blown out, the hollow interior chamber 104 of the outer carrier 105 is open to a downstream portion of the wellbore casing 300 via the second end opening 113 of the outer carrier 105 and the second end opening 164 of the channel 165 through the neck portion 160. Thus, a flow path through the outer carrier 105 is created for hydrocarbons being recovered to the surface of the wellbore when the well is completed and put into production.

However, before the well is completed and put into production, each zone of the wellbore must be perforated. Typically, each zone of the wellbore is isolated before being perforated, to avoid fluid pressure losses to zones that have already been completed. Accordingly, when a zone upstream of the ballistically actuated plug 100 is to be perforated, a sealing ball, as is known, is dropped down into the wellbore casing 300 to isolate the upstream zone by sealing against an opening of the fluid path that the ballistically actuated plug 100 in the expanded form 171 has created. In the case of the exemplary embodiment shown in FIG. 2C, the ball may have a diameter for seating against the rim 103*b* of the passage 103*a* through the first end opening 103, and/or within a portion of the passage 103*a* of the first end opening 103, or against the second end opening 113 of the outer carrier 105. For example, as shown in FIG. 2D, after the ballistically actuated plug 100 is sealed in its expanded state 171 against the inner surface 301 of the wellbore casing 300, the flow path through the first end opening 103 and the hollow interior chamber 104 of the outer carrier 105 may be sealed by a frac ball or other sealing component such as the bumper 116 (discussed below) which sets against the rim 103*b* that circumscribes the opening 103*a* therethrough, and thereby seals the flow path through the first end opening 103 of the outer carrier 105.

After the well is completed and ready for production, the balls sealing any ballistically actuated plugs 100 (or other plugs) may be drilled out, thus restoring the flow path through the outer carrier 105.

Figure 2D:
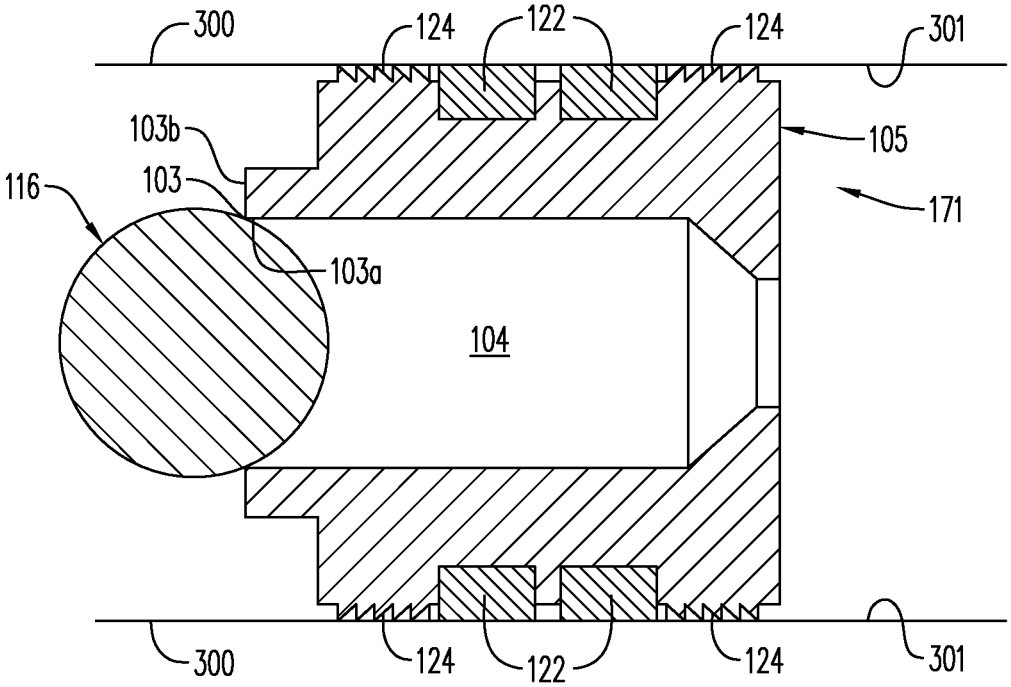
FIG. 2D shows a cross-sectional side view of an exemplary instantaneously expanding, ballistically actuated plug in an expanded form and sealed by a frac ball within a wellbore.

With reference to FIG. 2D, shows a cross-sectional side view of a frac ball secured within the ballistically actuated plug when the plug is in an expanded form. The ball is illustrated as being in a sealing relationship with the opening 103*a* of the outer carrier 105, and thereby seals the flow path through the first end opening 103 of the outer carrier 105.

FIG. 3 illustrates the ballistic carrier 106 including ballistic slots 109. The ballistic slots 109 are formed in an outer surface 130 of the body portion 115 of the ballistic carrier 106 and extend into the body portion 115 of the ballistic carrier 106. According to an aspect, and as described hereinabove, one or more ballistic components 110 are configured for being positioned within the ballistic slots 109.

As shown in FIG. 4, and with reference back to FIG. 1A and FIG. 1B, the ballistic carrier 106 may be dimensioned for being received within the hollow interior chamber 204 of the actuatable wellbore tool 200. For example, an outer diameter $d_1$ of the ballistic carrier 106 may be sufficient to fit securely and not allow for excessive movement within the hollow interior chamber 204 which may have a diameter $d_2$ (as previously discussed with respect to FIG. 1A and FIG. 1B).

With reference now to FIG. 4, an alternative exemplary embodiment of the ballistic carrier 106 is shown housed within a hollow interior chamber 204 of a wellbore tool 200 generally. In the exemplary embodiment that FIG. 4 shows, the ballistic carrier 106 is substantially as has been described with respect to FIGS. 1A, 1B, and 3, and common features will not be repeated here. In the exemplary embodiment shown in FIG. 4, each ballistic slot 109 includes an opening 117 extending from the ballistic slot 109 to the axial bore 112 and open to each of the ballistic slot 109 and the axial bore 112. Providing the openings 117 between the respective ballistic slots 109 and the axial bore 112 may improve the reliability of the initiation between the initiator 114 and the ballistic components 110.

With reference now to FIGS. 1A-4, an exemplary method for positioning an instantaneously expanding, ballistically actuated plug within a wellbore includes, without limitation, deploying an instantaneously expanding, ballistically actuated plug 100 according to this disclosure into the wellbore casing 300 to a predetermined or desired position within the wellbore casing 300. Once the ballistically actuated plug 100 is at the predetermined or desired position within the wellbore casing 300, the initiator 114 positioned in the axial bore 112 of the ballistic carrier 106 is initiated. The ballistic component(s) 110 are then initiated by the initiator 114, and the forces generated by the initiation of the ballistic component(s) 110 within the hollow interior chamber 104 of the outer carrier 105 will cause expanding the outer carrier 105 from the unexpanded state 170 to the expanded state 171. Expanding the outer carrier 105 to the expanded state 171 causes the outer carrier 105 to contact the inner surface 301 of the wellbore casing 300 with the gripping teeth 124 on the outer surface 121 of the outer carrier 105, according to the configuration of the outer carrier 105 in the expanded state 171.

In an aspect of the exemplary method, expanding the outer carrier 105 from the unexpanded state 170 to the expanded state 171 includes expanding the sealing element 122 that extends along the outer surface 121 of the outer carrier 105, wherein the outer carrier 105 and the sealing element 122 are together dimensioned for contacting and forming a seal between the sealing element 122 and the inner surface 301 of the wellbore casing 300 when the outer carrier 105 is in the expanded state 171.

In an aspect of the exemplary method, initiating the ballistic component(s) 110 includes firing one or more ballistic component(s) 110 radially outwardly from the axial bore 112.

In an aspect of the exemplary method, the ballistic carrier 106 is fragmented upon initiating the ballistic component 110. In a further aspect of the exemplary method, the seal disk 118 is dislodged from the channel 165 within a portion of the outer carrier 105 upon initiating the ballistic component 110. As a result, an aspect of the exemplary method includes enabling fluid communication through the hollow interior chamber 104 of the outer carrier 105 between a location upstream of the ballistically actuated plug 100 and a location downstream of the ballistically actuated plug 100.

Figure 5A:
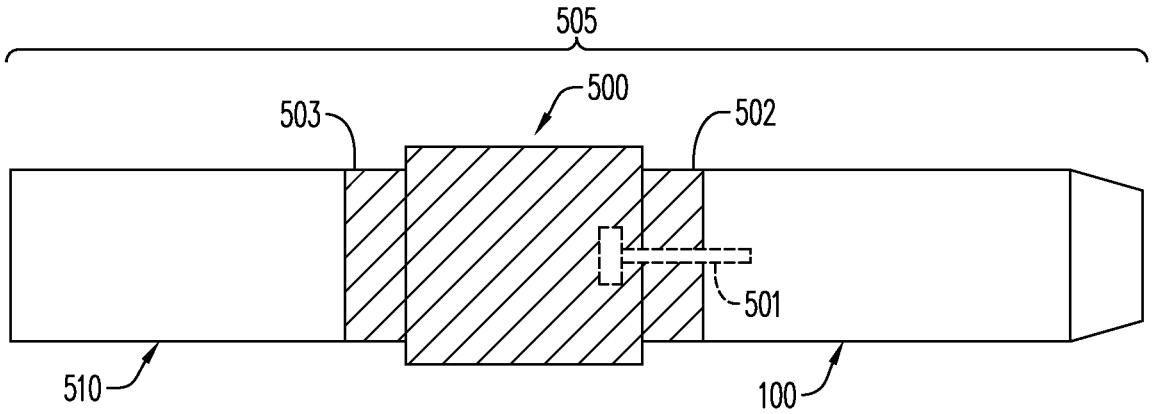
FIG. 5A shows an instantaneously expanding, ballistically actuated plug attached to a tool string, according to an exemplary embodiment.
Figure 5B:
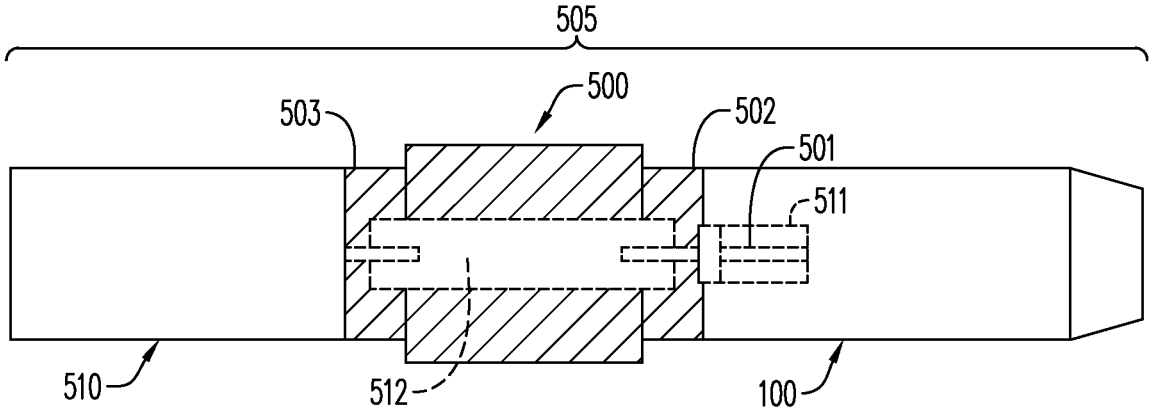
FIG. 5B shows an instantaneously expanding, ballistically actuated plug attached to a tool string, according to an exemplary embodiment.
Figure 5C:
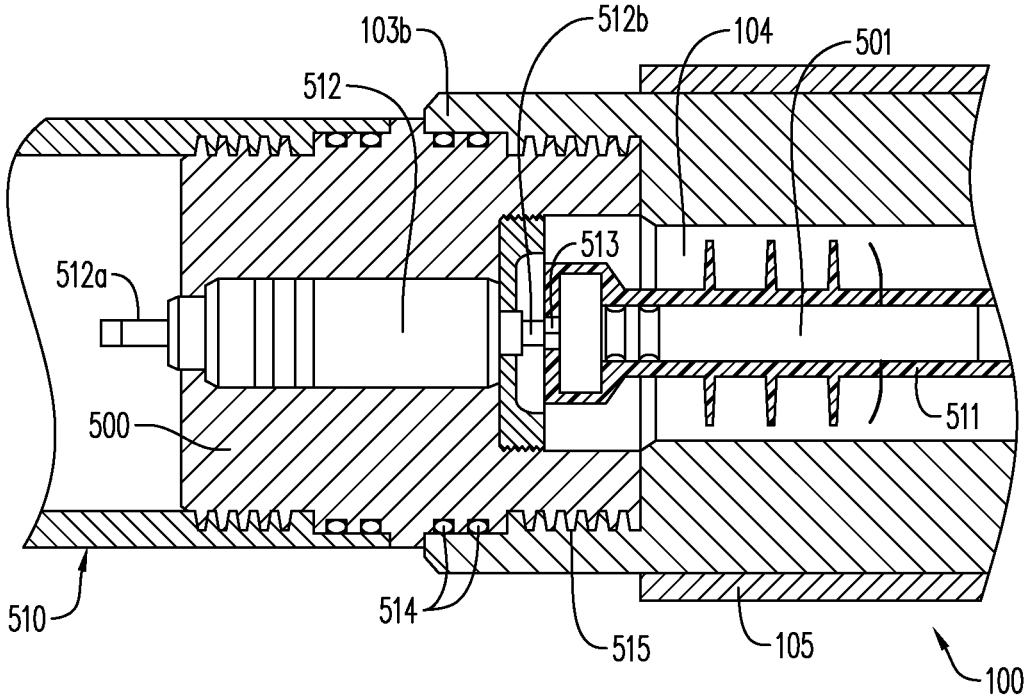
FIG. 5C shows an exemplary Tandem Seal Adapter (TSA) and bulkhead connection assembly, according to an exemplary embodiment.

With reference now to FIGS. 5A-5C, an exemplary configuration and connections of the ballistically actuated plug 100 on a tool string 505 is shown. In the illustrated exemplary embodiment, the ballistically actuated plug 100 is connected to a tandem seal adapter (TSA) 500 as is known. For example and without limitation, the ballistically actuated plug 100 may include a threaded portion (not shown) on an interior surface (i.e., adjacent the passage 103*a*) of the rim 103*b* of the passage 103*a* through the first end opening 103 of the outer carrier 105. The TSA 500 may include a complimentary threaded portion 515 (FIG. 5C) on a first end 502 of the TSA 500 for connecting to the threaded portion on the rim 103*b* of the passage 103*a* through the first end opening 103 of the outer carrier 105, and may also include one or more sealing components, such as o-rings 514 (FIG. 5C), for sealing the interior components of the ballistically actuated plug 100 and TSA 500 from wellbore fluid.

A detonator 501, for example, a selective switch detonator as previously discussed, may be, as shown in phantom in FIG. 5A, partially held within the TSA 500 and extend into the ballistically actuated plug 100 for initiating the ballistic components 100. The TSA 500 may be adapted to hold the detonator 501. Alternatively, the TSA 500 may house a bulkhead 512 (shown in phantom in FIG. 5B), e.g., in an assembly as disclosed in U.S. Pat. No. 9,494,021, commonly assigned to DynaEnergetics Europe GmbH, for transferring a selective detonation signal to the detonator 501 (shown in phantom in FIG. 5B) which may be housed in a detonator holder 511 (shown in phantom in FIG. 5B) within the outer carrier 105 of the ballistically actuated plug 100.

A cross-sectional view of the exemplary bulkhead 512 configuration in the TSA 500 is shown in FIG. 5C. FIG. 5C shows a cutaway portion of the ballistically actuated plug 100 and perforating gun 510 at the TSA 500 connection. The bulkhead 512 includes a first electrical contact 512*a* and a second electrical contact 512*b* for relaying an electrical signal or power supply between an upstream source or wellbore tool such as the perforating gun 510 and a downstream wellbore tool such as the ballistically actuated plug 100. The electrical signal may be, for example, a selective detonation signal. In the exemplary embodiment, the second electrical contact 512*b* electrically contacts a signal-in connection 513 of the detonator 501 and may relay the electrical signal or power supply therethrough to the detonator 501. The detonator holder 511 holds the detonator 501 in the ballistically actuated plug 100, for example in the hollow interior portion 104 of the outer carrier 105.

The TSA 500 may connect at a second end 503 of the TSA 500 to a wellbore tool 510 such as a perforating gun, which may be connected as part of a tool string 505 to additional wellbore tools further upstream, i.e., in a direction away from the ballistically actuated plug 100, as is known. In such configuration, the tool string 505 may be run downhole in the wellbore casing 300 such that after the ballistically actuated plug 100 is set within the wellbore casing 300 in its expanded form 171 as described herein, the additional wellbore tool(s) 510 may be initiated for various operations. In an example, and without limitation, the wellbore tool 510 may be a perforating gun that is fired after the ballistically actuated plug 100 is set. In such embodiment, the tool string 505 may be removed (for example, by retracting a wireline (not shown) to which the tool string is attached) after all perforating guns in the tool string 505 have fired, and a ball may then be dropped into the wellbore casing 300 as previously discussed, thereby sealing the flow path through the outer carrier 105 of the ballistically actuated plug 100 in its expanded form 171. Once the ball has sealed the flow path and isolated the upstream zone, fracking fluid may then be pumped into the wellbore to fracture the hydrocarbon formations via the perforations that the perforating guns created.

In other embodiments, the ballistically actuated plug 100 may be connected to a firing head, as is known, for initiating the ballistically actuated plug 100. The firing head may initiate, without limitation, a wireless detonator as described in U.S. Pat. No. 9,605,937, discussed above. The firing head may be connected to a wireline serving as a connection to the surface of the wellbore and/or a relay for a power supply or electrical control signals, as is known. In other embodiments, the ballistically actuated plug 100 and detonator 501 or other initiator may be electrically connected to a wireline that connects to, e.g., a top sub or other known connector that electrically connects the wireline to the detonator 501 via, for example, a relay such as the bulkhead 512 discussed with respect to FIG. 5C, or other know techniques. Whether conveyed as a single tool or as part of a tool string, a connector, firing head, etc. connected to the first end 101 of the outer carrier 105 should sufficiently seal the first end opening 103 of the outer carrier 105, to prevent wellbore fluid and other contaminants from entering the hollow interior chamber 104.

Figure 6:
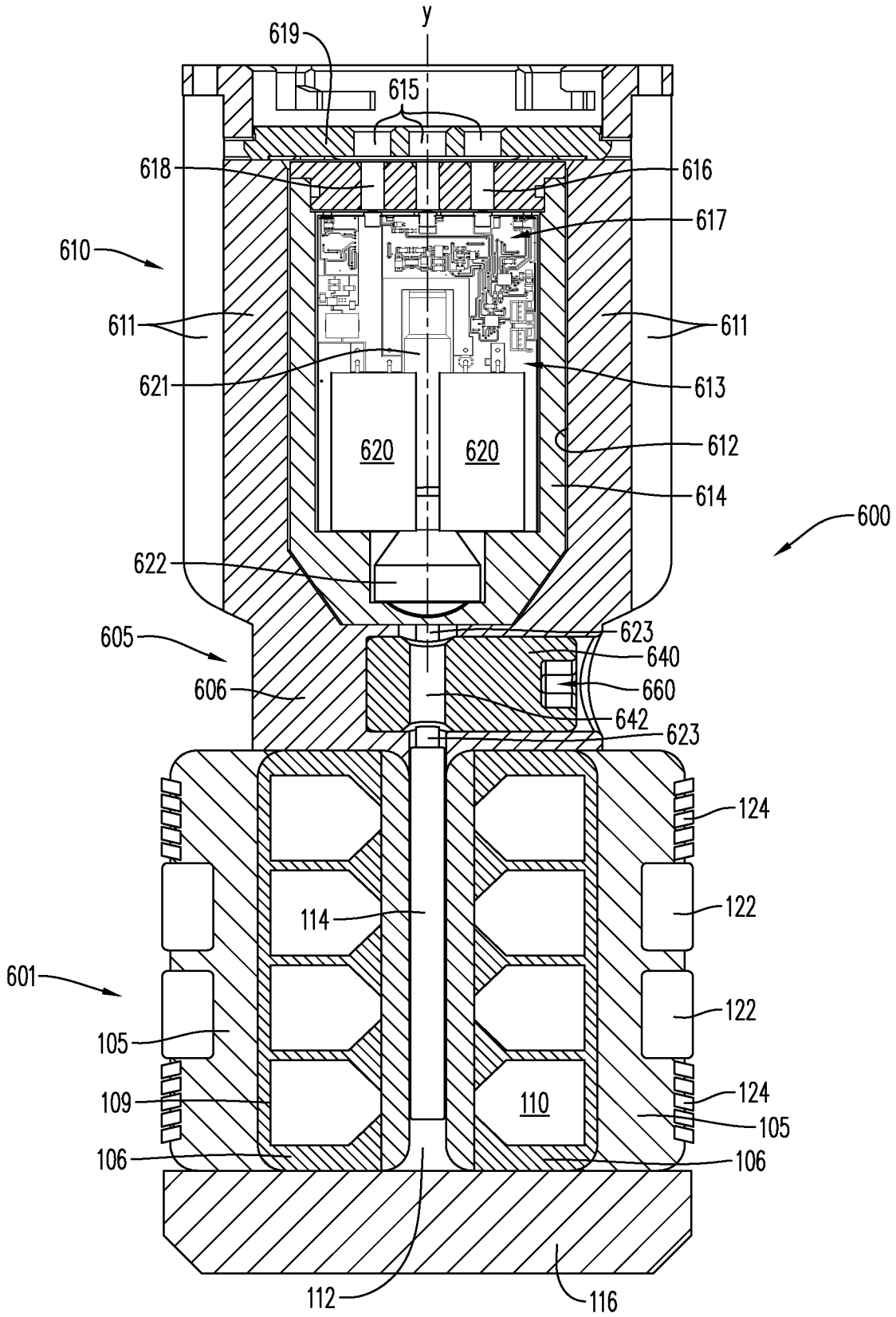
FIG. 6 is a cross-sectional side view of an instantaneously expanding, ballistically actuated autonomous plug drone according to an exemplary embodiment.

With reference now to FIG. 6, in an exemplary embodiment the ballistically actuated plug 100 may be a plug drone 600. For purposes of this disclosure, a "drone" is a self-contained, autonomous or semi-autonomous vehicle for downhole delivery of a wellbore tool. For example, the drone may be sent downhole in the wellbore casing 300 without being attached to a wireline or other physical connection, and/or without requiring communication with the surface of the wellbore to execute a wellbore operation. In the exemplary embodiment FIG. 6 shows, the plug drone 600 includes a ballistically actuated plug section 601 at a first end, a control module section 610 at a second end opposite the first end, and a ballistic interrupt section 605 positioned between and connected to each of the ballistically actuated plug section 601 and the control module section 610. For purposes of this disclosure, references to a "ballistically actuated plug section," "ballistic interrupt section,"

and "control module section" are to aid in the description of an exemplary plug drone including the relative positioning of various components, without limiting the description to any particular configuration or delineation of an exemplary plug drone or type, configuration, or distribution of components of an exemplary plug drone. The control module section 610, ballistic interrupt section 605, and configuration and operation generally of an autonomous wellbore tool including a control module section and ballistic interrupt section may be as described in International Patent Publication No. WO2020/035616 published Feb. 20, 2020, which is commonly owned by DynaEnergetics Europe GmbH and incorporated by reference herein in its entirety.

The ballistically actuated plug section 601 is substantially a ballistically actuated plug 100 as described throughout this disclosure, the description of which will not be repeated here. The ballistically actuated plug section 601 may be connected to the ballistic interrupt section 605 by, without limitation, a threaded engagement (e.g., as discussed with respect to a TSA 500 in FIG. 5), a friction fit, a weld, a mold, an adhesive, or any other technique consistent with this disclosure. In an aspect, a body 606 of the ballistic interrupt section 605 may be formed from, without limitation, a fragmentable or disintegrable material, such as an injection molded plastic, such that the body 606 of the ballistic interrupt section 605 will substantially disintegrate upon detonation of the ballistic components 110 and/or a donor charge 622 as described below. In an exemplary configuration, the body 606 of the ballistic interrupt section 605 is formed integrally (i.e., as a single piece) with the ballistic carrier 106, which may also be formed from the disintegrable injection molded plastic as previously discussed.

The ballistic interrupt section 605 includes a ballistic interrupt 640 housed within the body 606 of the ballistic interrupt section 605. The ballistic interrupt 640 has a through-bore 642 formed therethrough at a position such that the through-bore 642 in the open position, as shown in FIG. 6, is substantially parallel and coaxial with a ballistic channel 623 that is formed through the body 606 of the ballistic interrupt section 605, in which the through-bore 642 is positioned. In the open position, the through-bore 642 forms a passage, within the ballistic channel 623, between the donor charge 622 in the control module section 610 and the initiator 114 in the ballistically actuated plug section 601. The ballistic channel 623 extends between the control module section 610, adjacent the donor charge 622, and the initiator 114 such that, when the ballistic interrupt 640 is in the open position, the ballistic channel 623 and the through-bore 642 together define a path for an explosive jet formed upon detonation of the donor charge 622 to pass through the ballistic channel 623 including the through-bore 642, and reach the initiator 114 to initiate detonation of the ballistic components 110 in the ballistically actuated plug section 601. In a closed position (not shown), the ballistic interrupt 640 of the exemplary embodiment is rotated approximately 90 degrees, such that the through-bore 642 is substantially perpendicular to the ballistic channel 623 and closes the ballistic channel 623 to prevent an explosive jet from the donor charge 622 from reaching the initiator 114. In an aspect, the plug drone 600 is "armed" when the ballistic interrupt 640 is in the open position, and is in a safe, non-armed state when the ballistic interrupt 640 is in the closed position.

The ballistic interrupt 640 may be transported in the closed position and rotated from the closed position to the open position at the wellbore site, to arm the plug drone 600 before deploying the plug drone 600 into the wellbore. The ballistic interrupt 640 includes a keyway 660 for accepting a tool that may be used to rotate the ballistic interrupt 640 from the closed position to the open position. The ballistic interrupt 640 may be rotated, via the keyway 660, either manually or automatically in, or with, a device for engaging the keyway 660. In an exemplary operation, the ballistic interrupt 640 is rotated, and the plug drone 600 is armed, in a launcher (not shown) that arms the plug drone 600 before launching it into the wellbore.

The control module section 610 is generally defined by a control module section body 611 and may be, without limitation, generally circumferentially-shaped and formed about a longitudinal axis y. The control module section body 611 may be formed from, without limitation, a fragmentable or disintegrable material, such as an injection molded plastic, such that the control module section body 611 will substantially disintegrate upon detonation of the ballistic components 110 and/or the donor charge 622. In an aspect, the control module section 610 may be formed integrally (i.e., as a single piece) with the ballistic interrupt section 605.

The control module section 610 includes a Control Interface Unit (CIU) 613 that may be, for example, a programmable onboard computer as described below or in International Patent Publication No. WO2020/035616 published Feb. 20, 2020, which is commonly owned by DynaEnergetics Europe GmbH and incorporated by reference herein in its entirety. The CIU 613 is housed within a control module housing 614 positioned within a hollow interior portion 612 of the control module section 610 and defined by the control module section body 611. Charging and programming contacts 615 include pin contact leads 616 electrically connected to the CIU 613, for example, to a programmable electronic circuit which may be contained on a Printed Circuit Board (PCB) 617. The pin contact leads 616 may be exposed through, and sealed within, apertures 618 through a sealing access plate 619 that closes the hollow interior portion 612 of the control module section 610. The charging and programming contacts 615 may be used for charging a power source of the CIU 613 and/or programming onboard circuitry by, for example and without limitation, connecting the charging and programming contacts 615 to a power supply and/or control computer at the surface of the wellbore, before deploying the plug drone 600 into the wellbore.

The CIU 613 may contain such electronic systems such as power supplies, programmable circuits, sensors, processors, and the like for detecting a position, orientation, or location of the plug drone 600 and/or the condition of the wellbore around the plug drone 600, for powering the onboard computer systems and/or trigger/arming components, and for triggering initiation of the plug drone 600 as described below. In an aspect, the CIU 613 may include capacitor and/or battery power sources 620, a detonator 621, and a donor charge 622. The detonator 621 is positioned for initiating the donor charge 622 upon receiving a signal (e.g., from the programmable electronic circuit) to detonate the plug drone 600. The detonator 621 may include a Non-Mass Explosive (NME) body and the donor charge 622 may, in an aspect, be integrated with the explosive load of the detonator 621. In an aspect of integrating the donor charge 622 with the explosive load of the detonator 621, the amount of explosive may be adjusted to accommodate the donor charge 622 and the size and spacing of components such as a ballistic channel 623 along which a jet from the donor charge 622 propagates upon detonation of the donor charge 622.

In an aspect, the CIU 613 may include the PCB 617 and a fuse for initiating the detonator 621 may be attached directly to the PCB 617. In an aspect of those embodiments, the detonator 621 may be connected to a non-charged firing panel—for example, a selective detonator may be attached to the PCB 617 such that upon receiving a selective detonation signal the firing sequence, controls, and power may be supplied by components of the PCB 617 or CIU 613 via the PCB 617. This can enhance safety and potentially allow shipping the fully assembled plug drone 600 in compliance with transportation regulations if, as discussed above, the ballistic interrupt 640 is in the closed position. Connections for the detonator 621 (and associated components) on the PCB 617 may be, without limitation, sealed contact pins or concentric rings with o-ring/groove seals to prevent the introduction of moisture, debris, and other undesirable materials.

In alternative embodiments, the CIU 613 may be configured without a control module housing 614. For example, the CIU 613 may be contained within the hollow interior portion 612 of the control module section 610 and sealed from external conditions by the control module section body 611 itself. Alternatively, the CIU 613 may be housed within an injection molded case and sealed within the control module section body 611. The injection molded case may be potted on the inside to add additional stability. In addition, or alternatively, the control module housing 614 or other volume in which the CIU 613 is positioned may be filled with a fluid to serve as a buffer. An exemplary fluid is a non-conductive oil, such as mineral insulating oil, that will not compromise the CIU components including, e.g., the detonator 621. The control module housing 614 may also be a plastic carrier or housing to reduce weight versus a metal casing. In any configuration including a control module housing 614 the CIU components may be potted in place within the control module housing 614, or alternatively potted in place within whatever space the CIU 613 occupies.

The detonator 621 and the donor charge 622 are contained within the control module housing 614 and the donor charge 622 is substantially adjacent to and aligned with the ballistic channel 623 along the axis y which is further aligned with the initiator 114. Upon detonation of the detonator 621, the donor charge 622 is initiated and the explosive jet from the donor charge 622 will pierce a portion 624 of the control module housing 614 that is positioned between the donor charge 622 and the ballistic channel 623 and propagate into the ballistic channel 623. When the ballistic interrupt 640 is in the open position, the explosive jet will reach the initiator 114 which will in turn initiate the ballistic components 110 to expand the outer carrier 105 of the ballistically actuated plug section 601 in the same manner as described throughout this disclosure for a ballistically actuated plug 100.

In an aspect of the exemplary plug drone(s) described above, the bumper 116 on the ballistically actuated plug section 601 may act as, or be replaced by, a frac ball for sealing a plug as previously discussed. For example, the frac ball, which may be the bumper 116, may be attached to the ballistically actuated plug section 601 of a second plug drone 600 that is deployed into the wellbore after a first plug drone has previously been set in the wellbore casing 300 with the outer carrier 105 in the expanded form 171. When the second plug drone 600 is actuated, the frac ball—made from a resilient material—is detached from the second plug drone 600 and propelled downstream towards the expanded plug. The frac ball is dimensionally configured to seal the expanded plug as previously discussed. Accordingly, one plug may be sealed as another is set upstream in the next zone to be perforated. However, the frac ball may also be attached to any wellbore tool, or may itself be the wellbore tool, for autonomous deployment on a ballistically actuated drone. In embodiments where the bumper 116 serves as a frac ball, e.g., to seal a plug that has been set downstream, the bumper 116 may not be annularly shaped but have, for example, a solid front portion such that the interior opening 180 of the bumper 116 is closed at one end to prevent the flow of fluid therethrough.

Figure 7:
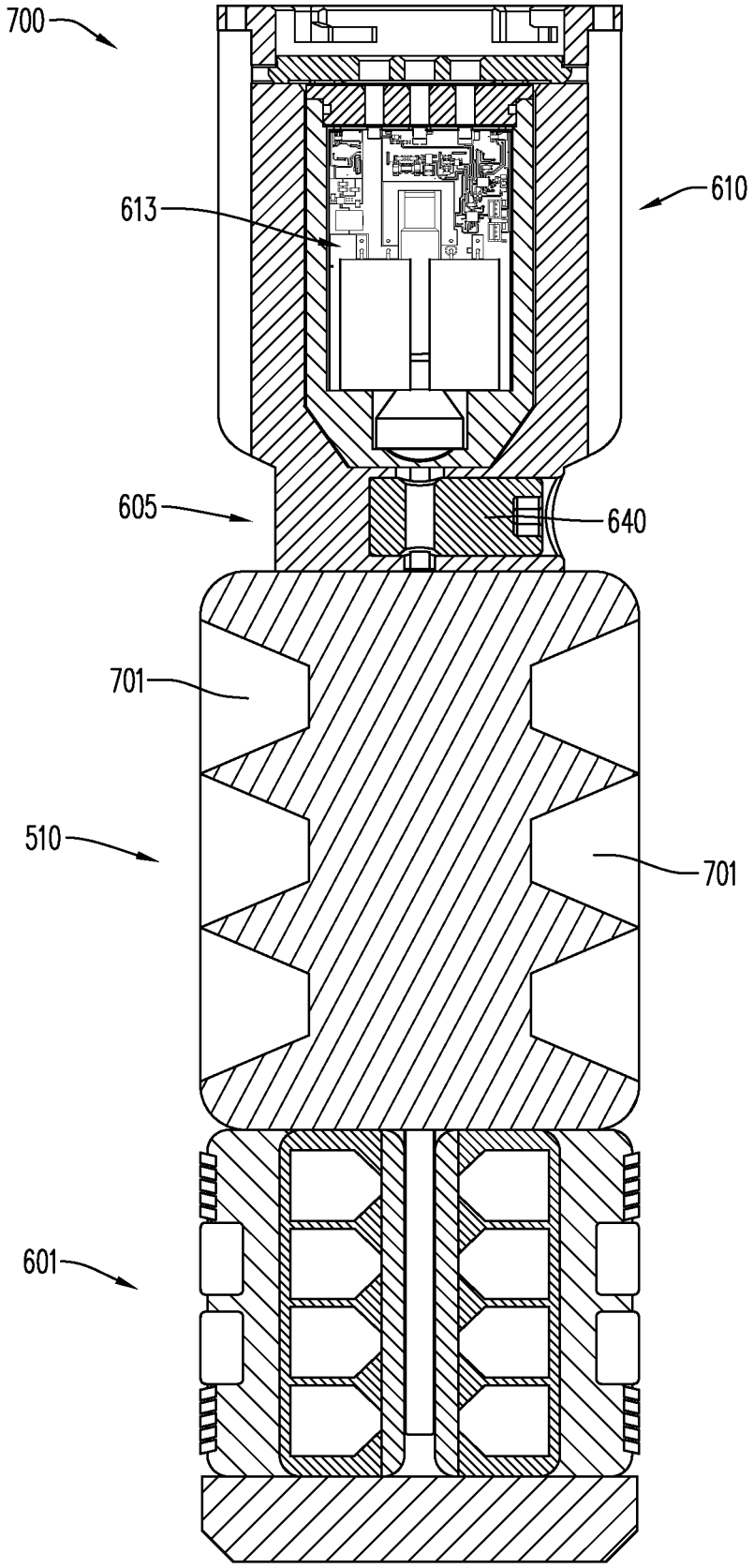
FIG. 7 is a partial cross-sectional side view of a daisy-chained ballistically actuated autonomous plug drone and wellbore tool assembly, according to an exemplary embodiment.

With reference now to FIG. 7, an alternative exemplary configuration of a drone according to the disclosure includes a daisy-chained, ballistically actuated, autonomous wellbore tool assembly 700 including a single CIU 613 connected to and controlling each of a first wellbore tool 601 and a second wellbore tool 510. In the exemplary embodiment shown in FIG. 7, the first wellbore tool may be a ballistically actuated plug 601 according to the exemplary embodiments described herein. The CIU 613 may be positioned within a control module section 610 connected to or integral with a ballistic interrupt section 605 that includes a ballistic interrupt 640 as previously shown in and described with respect to FIG. 6. In the exemplary embodiment, the second wellbore tool 510 may be a perforating gun assembly (or, perforating assembly section of the wellbore tool assembly) such as described in International Patent Publication No. WO2020/035616 published Feb. 20, 2020, which is commonly owned by DynaEnergetics Europe GmbH and incorporated by reference herein in its entirety. The perforating gun assembly 510 may include one or more shaped charges 701. In the exemplary embodiment shown in FIG. 7, the CIU 613 and the ballistic interrupt 640 control operation of each wellbore tool in the daisy-chained string. The different tools or sections of the assembly may be, without limitation, integrally formed as a single piece of a common material or separate components that are joined by known techniques such as molding, threaded connectors, welding, positive locking engagements, friction fits, and the like.

In an exemplary operation of a plug drone 600 as described with respect to FIG. 6, the plug drone 600 may be transported to a wellbore site with the ballistic interrupt 640 in the closed position. The plug drone 600 may then be connected, via the charging and programming contacts 615, to a power supply and/or computer interface at the wellbore site, to charge the power source 620 of the plug drone 600 and provide deployment and detonation instructions to onboard electronic circuitry. The ballistic interrupt 640 may be rotated from the closed position to the open position when the plug drone 600 is ready for deployment.

Once deployed in the wellbore, the plug drone 600 may use onboard sensors to determine a speed, orientation, position, and the like of the plug drone 600 within the wellbore. The plug drone 600 may transmit to a surface controller information determined by the sensors, for generating a wellbore topography profile. The plug drone 600 may also use, for example and without limitation, temperature and pressure sensors to determine a temperature and pressure of the wellbore around the plug drone 600 and may transmit to the surface controller a profile of such wellbore conditions.

Upon reaching a predetermined location within the wellbore as determined by, without limitation, an elapsed time from deployment, a distance traveled, a location as determined from, e.g., casing collar locators (CCLs) or other known position-sensing devices, an orientation of the plug drone 600, and the like, the CIU 613 may trigger the detonator 621 to detonate and thereby initiate the donor charge 622, which will detonate and form an explosive jet that will propagate through the ballistic channel 623 and initiate the initiator 114. The initiator 114 will in turn initiate the ballistic components 110 and cause the ballistically actuated plug section 601 to expand and engage the inner surface 301 of the wellbore casing 300 at a desired location, at which the plug will be set. Instructions regarding, e.g., the predetermined location and/or conditions at which the plug drone 600 should detonate may be programmed into the CIU 613, via the charging and programming contacts 615, by a computer interface at the surface of wellbore, before the plug drone 600 is deployed in the wellbore. While the above sensor-based type initiation is particularly useful in the exemplary plug drone 600 in which no physical connection with the surface is maintained after the plug drone 600 is deployed into the wellbore, such techniques are not limited to use with an autonomous tool and may also contribute to automating deployment and actuation of non-autonomous wellbore tools such as those attached to wirelines or tool strings.

In the exemplary embodiments, the ballistic carrier 106 in the ballistically actuated plug section 601, the body 606 of the ballistic interrupt section 605, and the control module section body 611 are each made from a frangible or disintegrable material that will substantially fragment or disintegrate upon detonation of the detonator 621, donor charge 622, and/or ballistic components 110. The CIU 613 and other internal components of the plug drone 600 may be similarly fragmented into debris that will be carried away from the plug drone 600 upon expansion. Accordingly, the plug drone 600 post expansion will substantially resemble the configuration of the ballistically actuated plug 100 in the expanded form 171, as shown and described with respect to FIG. 2C. Isolation of an upstream wellbore zone and completion of the zone may then proceed as previously discussed.

A method of transporting and arming the exemplary plug drone 600 for use at the wellbore site may include transporting the plug drone 600 in a safe state to the wellbore site and arming the ballistically actuated plug drone 600 at the wellbore site. The safe state of the plug drone 600 is when the ballistic interrupt 640 is in the closed position and arming the plug drone 600 includes moving the ballistic interrupt 640 from the closed position to the open position. The method may also include programming the CIU 613 of the plug drone 600 and/or charging a power source 620 of the plug drone 600, at the wellbore site.

With reference back to FIG. 7, an exemplary method for performing a plug-n-perf operation using the exemplary ballistically actuated, autonomous wellbore tool assembly 700 may be according to similar principles as for use of the plug drone 600 and incorporating, e.g., the perforating step. For example, the method may include deploying the ballistically actuated, autonomous wellbore tool assembly 700 into the wellbore and, first, initiating detonation of one or more shaped charges in the perforating gun assembly 510 by, for example, providing an explosive jet from the donor charge 622 to initiate a booster and/or detonating cord (or other initiator) in the perforating gun assembly 510 for initiating the shaped charge(s) 701. The ballistically actuated plug 601 may be initiated prior to initiating the perforating gun assembly, without limitation, one or a combination of a separate initiation signal that the CIU 613 may send through a relay through the perforating gun assembly 510 to a separate initiator in the ballistically actuated plug 601, a ballistic energy transfer, such as, e.g., a booster, donor charge, or combination of the two and/or other initiating components, from the initiator in the perforating gun assembly 510 to an initiator of the ballistically actuated plug 601, and a portion of the same initiator in the perforating gun assembly 510, such as a detonating cord, that extends into the ballistically actuated plug 601. Accordingly, an explosive component of the ballistically actuated plug 601 will be initiated and thereby expand the ballistically actuated plug 601 to an expanded state 171 before or after the perforating has been performed further upstream. The body portions 606, 611 of the various sections of the ballistically actuated, autonomous wellbore tool assembly 700 may be formed from a fragmentable or disintegrable material such that during the actuation processes those body portions 606, 611 and other components are fragmented or destroyed and the debris is allowed to pass downstream through the flow path formed by the ballistically actuated plug 601 in the expanded state 171. A frac ball or other sealing element may then be provided to seat against and seal the flow passage through the expanded plug, as previously discussed, and isolate the perforated zone.

Figure 8:
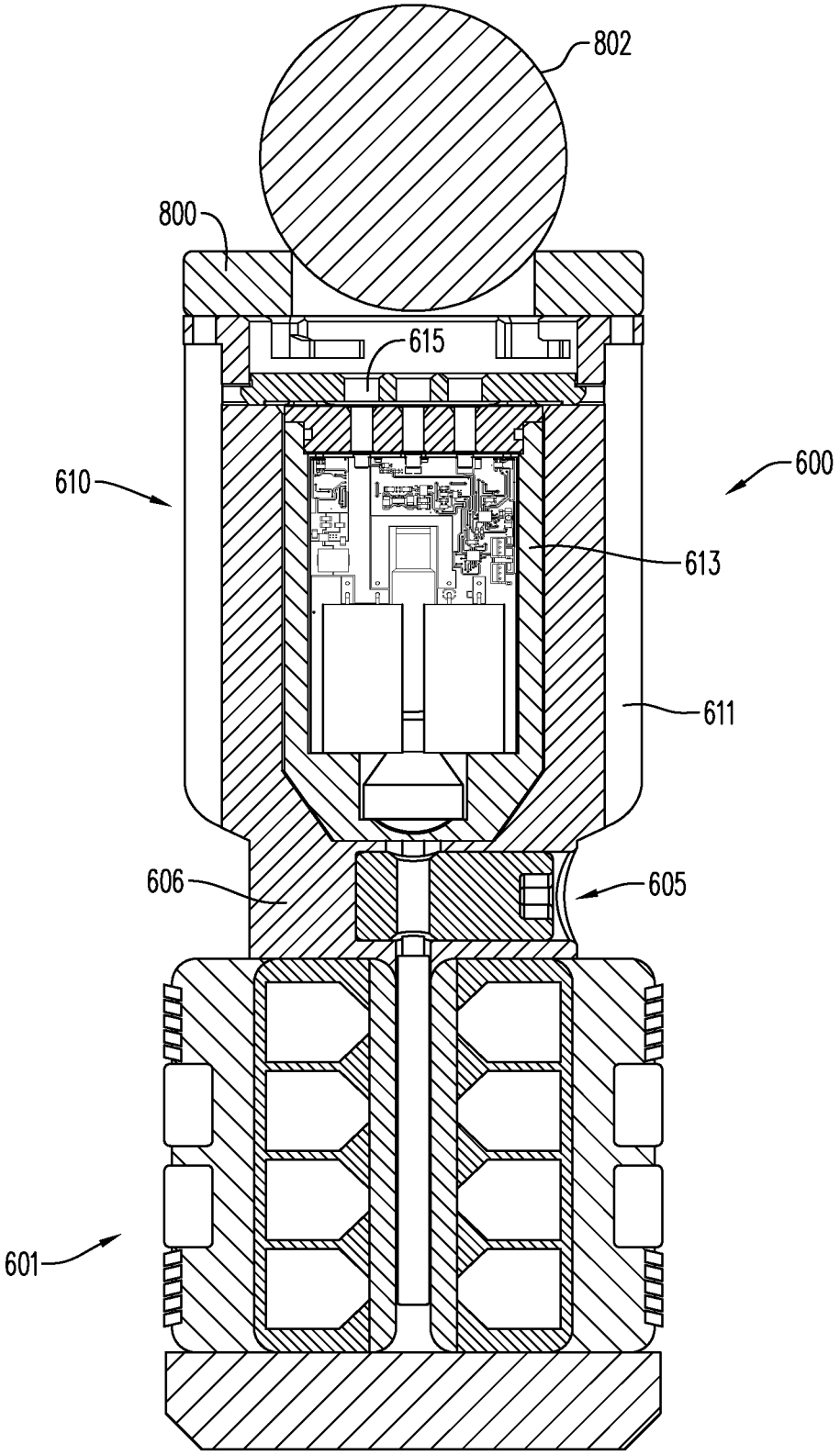
FIG. 8 is a cross-sectional view of an instantaneously expanding, ballistically actuated autonomous plug drone with frac ball, according to an exemplary embodiment.

With reference now to FIG. 8, an exemplary embodiment of a plug drone 600 such as shown in and discussed above with respect to FIG. 6 may include a frac ball 802 (or similar component) connected to the control module section 610 by a connector 800 that may be any structure consistent with this disclosure. For example, the connector 800 may be, without limitation, an integrally formed extension of the control module section body 611 or may be connected to the control module section body 611 by any known technique such as threading, adhesives, positive locking engagements, resilient retaining structures, and the like. The connector 800 may retain the frac ball 802 by any known technique such as magnetically, frictionally, by resilient retainers, and the like. Other connectors generally of any configuration, operating principle, or otherwise may be used consistent with this disclosure. The plug drone 600 in the exemplary embodiment of FIG. 8 is deployed and actuated within the wellbore as previously described with respect to, e.g., FIG. 6. The control module section body 611 and ballistic interrupt section body 606 may be formed from frangible or disintegrable materials, as discussed above. Upon actuating the tool, i.e., initiating the detonator 621, the donor charge 622, and the initiator 114 and expanding the ballistically actuated plug 601 to the expanded state 171, the control module section body 611 and ballistic interrupt section body 606 may be fragmented/disintegrated by the ballistic, thermal, and/or kinetic energies, and the CIU 613 and remaining components may also be destroyed/fragmented, and the debris washed downstream through the open hollow interior chamber 104. The frac ball 802 may then advance into and seat against the first end opening 103 of the outer carrier 105, to seal the expanded plug and isolate a perforating zone as previously discussed.

In an aspect, one or more of the frac ball 802 and various components of the plug drone 600 (or actuatable wellbore tool, generally) may be formed from known degradable materials that will dissolve in the wellbore fluid and therefore not require drilling out.

In an aspect, the exemplary plug drone 600 including the frac ball 802 carried thereon may be part of a daisy-chained assembly 700 including a perforating gun 510 as shown in and described with respect to FIG. 7. The frac ball 802 may be, without limitation, positioned and carried between the perforating gun 510 and the ballistically actuated plug section 601.

Tests

Figure 9:
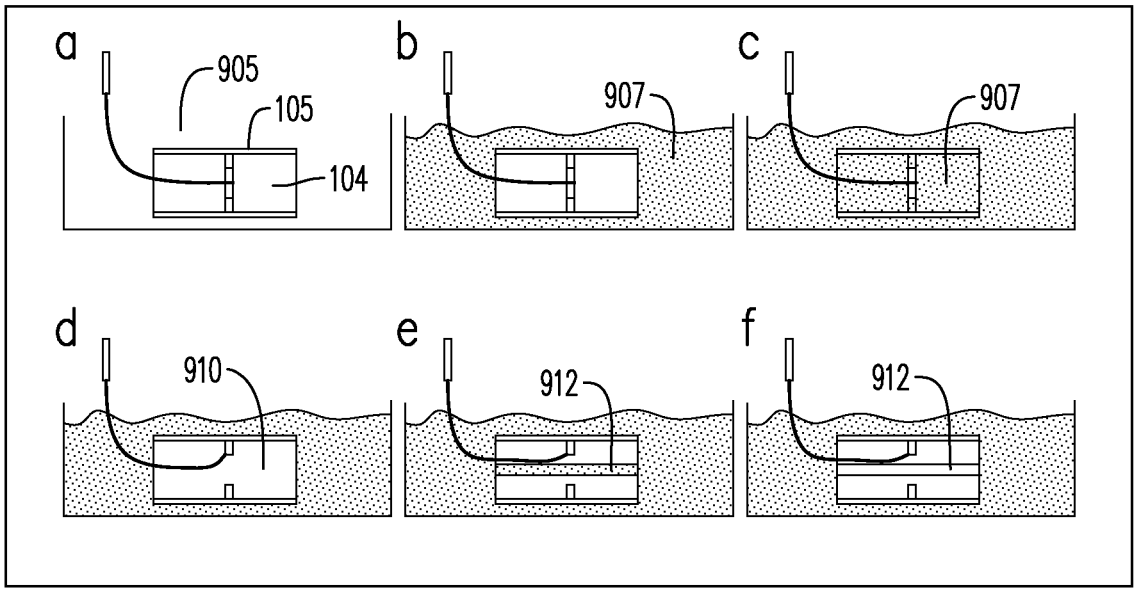
FIG. 9 shows various experimental test setups for a ballistically actuated wellbore tool.
Figure 10A:
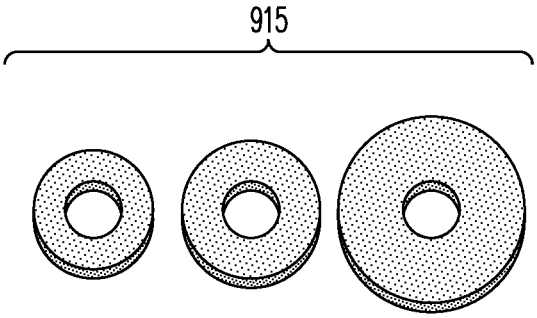
FIG. 10A shows explosive pellets for use with a ballistically actuated wellbore tool.
Figure 10B:
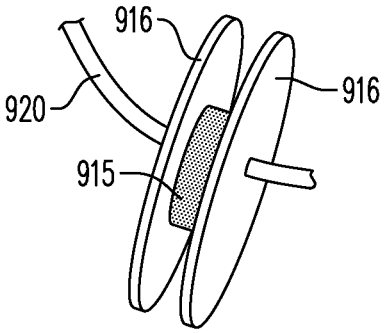
FIG. 10B shows an experimental setup for an explosive pellet as in FIG. 10A.

With reference now to FIGS. 9-20L, a test setup, components, and results for evaluating the effect of certain variables in a ballistically actuated plug design on the swell induced in the outer carrier are shown. The tests included, among other things, various setups, explosive weights for ballistic components, kinds of explosive products for the ballistic components, and materials for the outer carrier. For example, as shown in FIG. 9, two different fluids, air 905 and water 907, were used as the medium both within (104) and outside of the outer casing 105. The test setups illustrated in FIG. 9, and explained in greater detail below, are: a) air filled plug in air; b) air filled plug in water; c) water filled plug in water; d) cord on a noncompressible core 910 in water; e) cord on a hollow core 912, filled with water, in water; and f) cord on a hollow core 912, filled with air, in water.

With reference to FIGS. 10A-11A, explosive pellets 915 such as the pressed rings discussed with respect to the ballistic carrier 106 are shown as used in tests a)-c). The explosive pellets 915 included different outside diameters (OD) and explosive loads as indicated in the test results below. All of the pellets were formed from octahydro-1,3,5,7-tetranitro-1,3,5,7-tetrazocine (High Melting Explosive (HMX)). The pellets 915 were positioned approximately in the middle of the hollow interior 104 of the outer carrier 105 and held in place between pellet holder plates 916. A detonating cord 920 was passed through the center of the plates 916 and pellet 915 to initiate the pellet 915. This test setup was used in tests 1 and 2. The test conditions, including the casing (outer carrier 105) size, outer and inner media, explosive mass of the pellet 915, diameter of the pellet 915, and max swell observed in each of tests 1 and 2 are shown in Table 1 below. Except where otherwise noted, the tests were performed with a 4.5" casing that was a steel pipe with min. tensile strength=95.000 psi, min. yield strength=550 MPa, and max. hardness=240 HBW.

TABLE 1

| Test Nr | Casing | Outer Medium | Inner Medium | Explosive mass | Pellet Diameter | Max Swell |
|---|---|---|---|---|---|---|
| Test 1 | 4.5" L80 | air | air | 22.7 g | 39 mm | 1.4 mm |
| Test 2 | 4.5" L80 | air | air | 50 g | 55 mm | 5.4 mm |

Figure 11A:
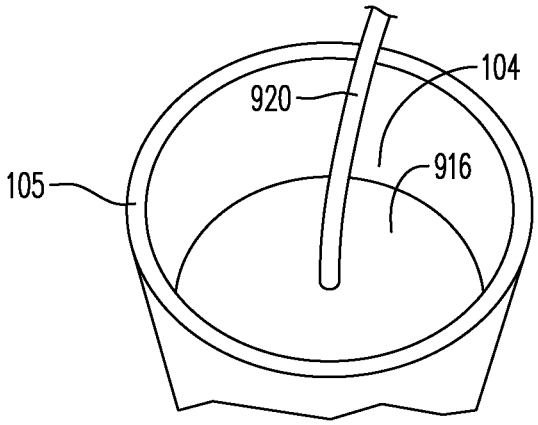
FIG. 11A shows an experimental setup for a ballistically actuated wellbore tool.
Figure 11B:
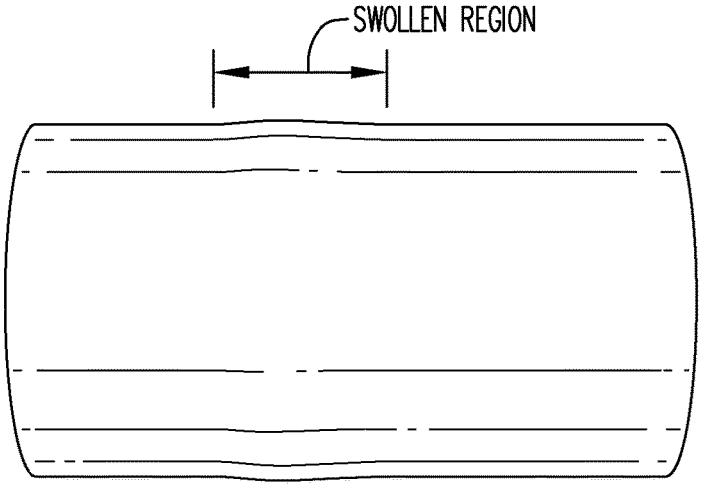
FIG. 11B shows a ballistically actuated wellbore tool after an experimental test.

FIG. 11B shows the casing and swell profile observed after test 1.

Figure 11C:
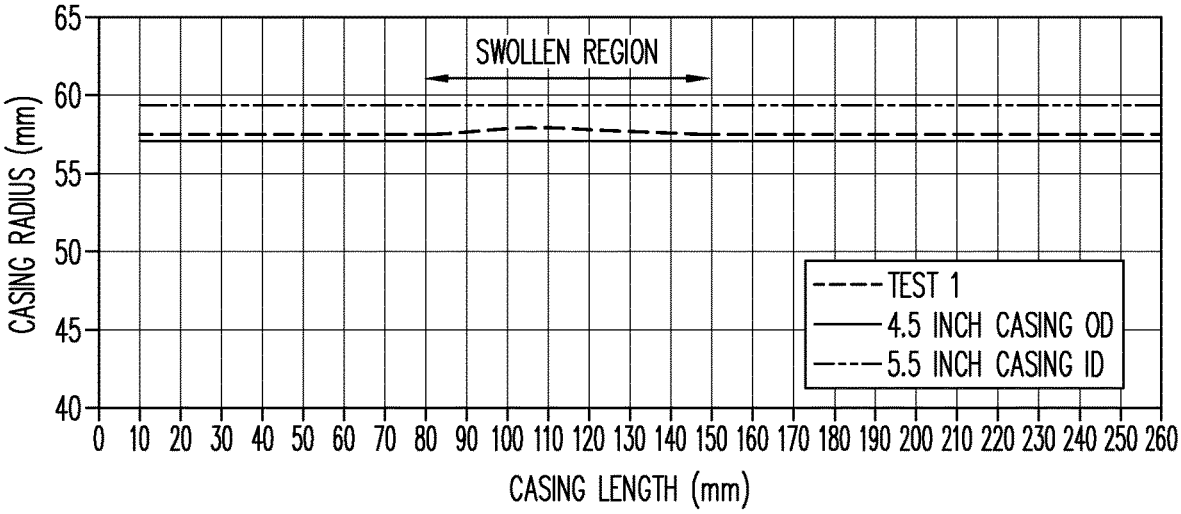
FIG. 11C shows a swell profile for the ballistically actuated wellbore tool of FIG. 11B.

FIG. 11C shows the casing and swell profile observed after test 1.

Figure 11D:
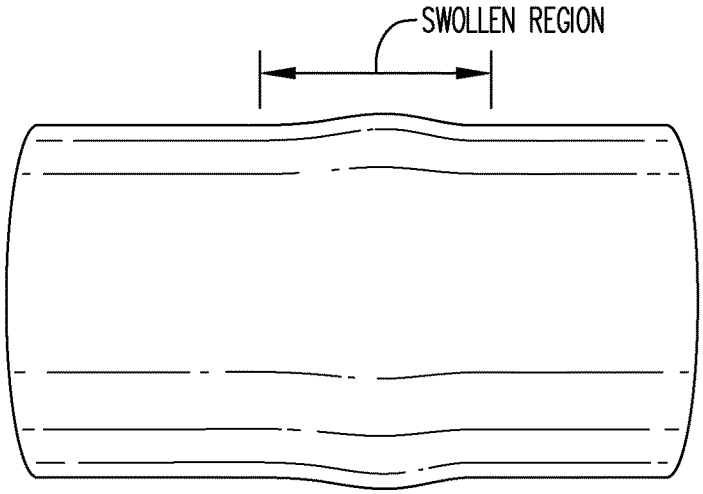
FIG. 11D shows a ballistically actuated wellbore tool after an experimental test.

FIG. 11D shows the casing and swell profile for test 2.

Figure 11E:
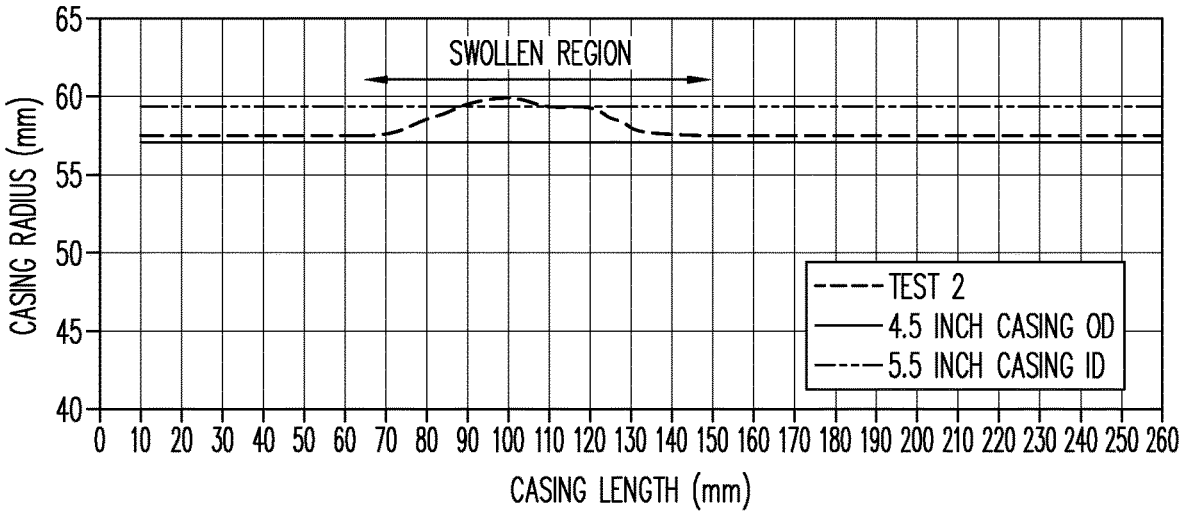
FIG. 11E shows a swell profile for the ballistically actuated wellbore tool of FIG. 11D.

FIG. 11E shows the casing and swell profile for test 2.

Figure 12A:
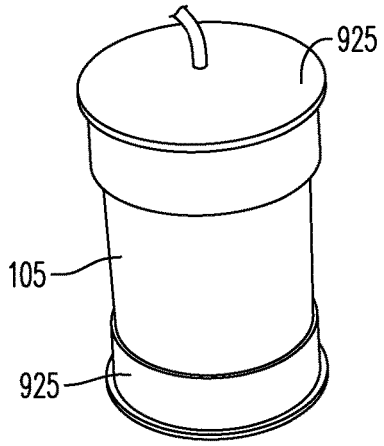
FIG. 12A shows an experimental setup for a ballistically actuated wellbore tool.
Figure 12B:
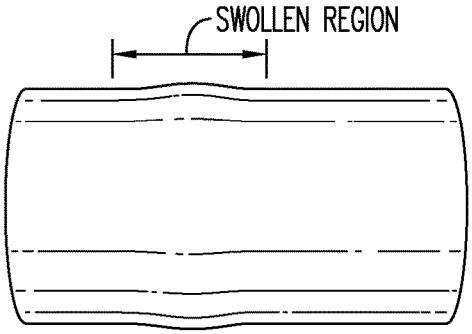
FIG. 12B shows a ballistically actuated wellbore tool after an experimental test.
Figure 12C:
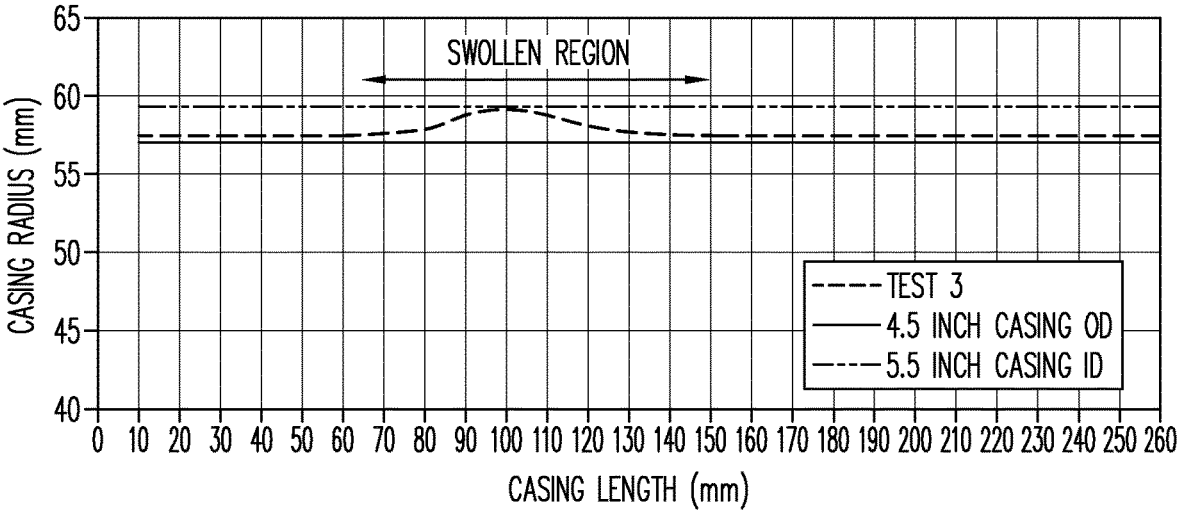
FIG. 12C shows a swell profile for the ballistically actuated wellbore tool of FIG. 12B.

With reference now to FIG. 12A, test 3 included the same setup for the explosive pellet 915 as in tests 1 and 2 except that the outer carrier 105 was closed completely with two caps 925 and the whole system was submerged in water to evaluate the influence of a surrounding medium. The properties and max swell in test 3 are shown in Table 2 below. FIGS. 12B and 12C show the casing and swell profile after test 3.

TABLE 2

| Test Nr | Casing | Outer Medium | Inner Medium | Explosive mas | Pellet Diameter | Max Swell |
|---|---|---|---|---|---|---|
| Test 3 | 4.5" L80 | water | air | 50 g | 55 mm | 44 mm |

Figure 13A:
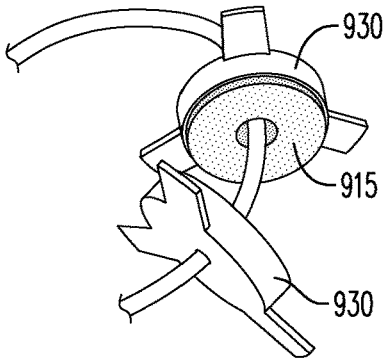
FIG. 13A shows an experimental setup for a ballistically actuated wellbore tool.
Figure 13B:
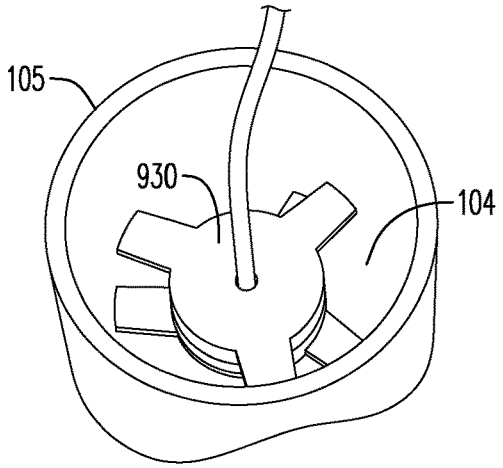
FIG. 13B shows an experimental setup for a ballistically actuated wellbore tool.

With reference now to FIGS. 13A and 13B, the influence on swell of an inner medium was evaluated in tests 4-6, otherwise using the same test setup as in tests 1-3. As air is very compressible, one theory was that changing the inner medium to water would significantly influence the swell. The pellet 915 was sealed with a silicone and centered inside the outer carrier 105 using a plastic fixture 930. Similar to test 3, the ends of the outer carrier were capped (not shown) after the hollow interior 104 was filled with water, and the system was submerged in water. The properties and max swell in tests 4-6 are shown in Table 3 below.

TABLE 3

| Test Nr | Casing | Outer Medium | Inner Medium | Explosive mass | Pellet Diameter | Max Swell |
|---|---|---|---|---|---|---|
| Test 4 | 4.5" L80 | water | water | 50 g | 55 mm | 20 mm |
| Test 5 | 4.5" L80 | water | water | 22.7 g | 38 mm | 7.4 mm |
| Test 6 | 4.5" L80 | water | water | 22.7 g | 55 mm | 8.6 mm |

According to the results of tests 1-6, it is believed that each of changing the inner medium from air to water and especially providing water within the outer carrier such that water is between the explosive and the outer carrier, increasing the explosive mass, and increasing the pellet diameter have a significant impact for increasing the amount of swell. Changing the outer medium from air to water slightly decreased the swell.

Figure 13C:
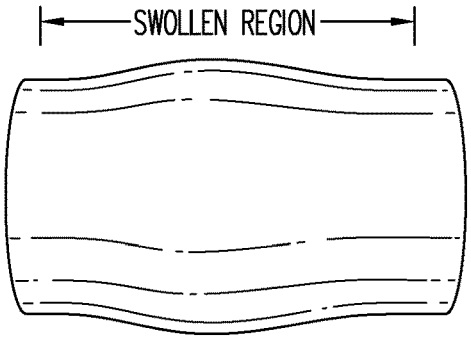
FIG. 13C shows a ballistically actuated wellbore tool after an experimental test.

FIG. 13C shows the casing and swell profile after test 4.

Figure 13D:
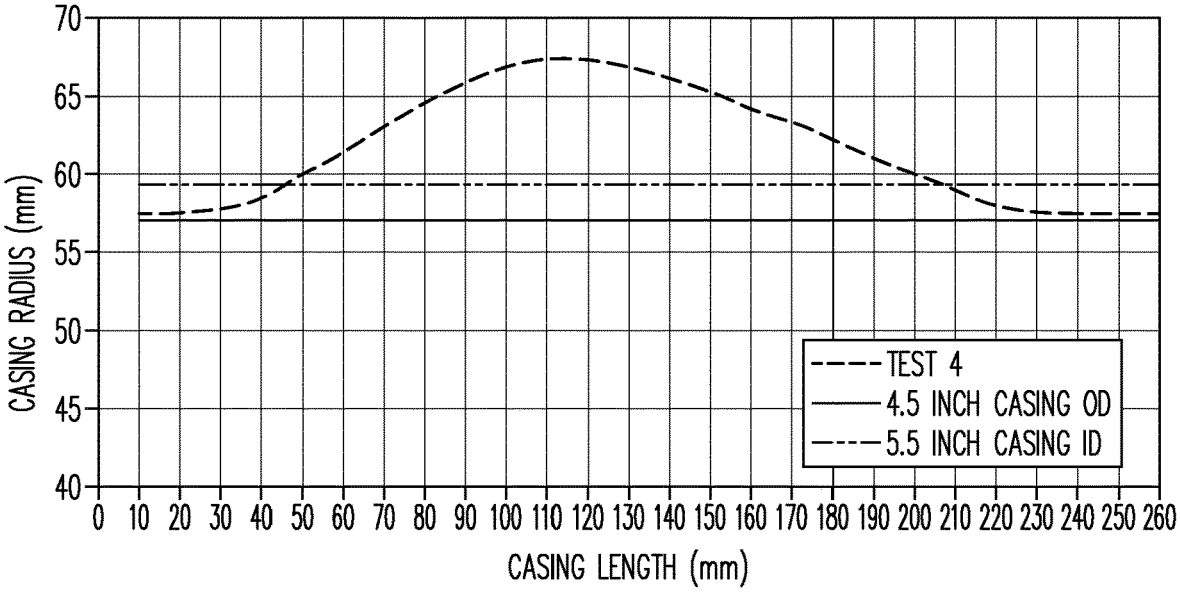
FIG. 13D shows a swell profile for the ballistically actuated wellbore tool of FIG. 13C.

FIG. 13D shows the casing and swell profile after test 4.

Figure 13E:
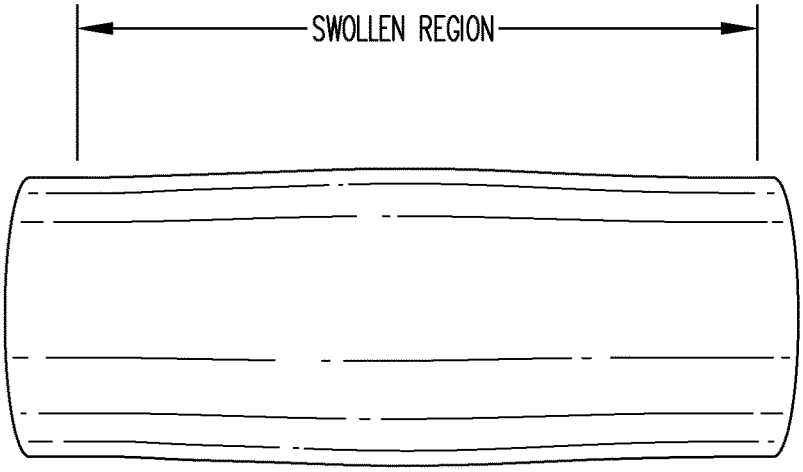
FIG. 13E shows a ballistically actuated wellbore tool after an experimental test.

FIG. 13E shows the casing and swell profile after test 5.

Figure 13F:
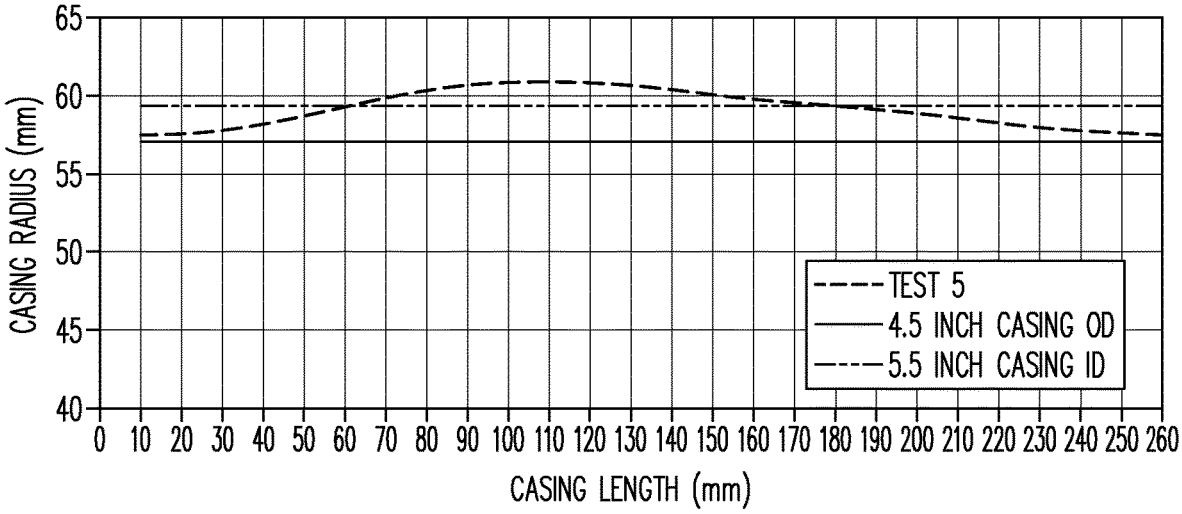
FIG. 13F shows a swell profile for the ballistically actuated wellbore tool of FIG. 13E.

FIG. 13F shows the casing and swell profile after test 5.

Figure 13G:
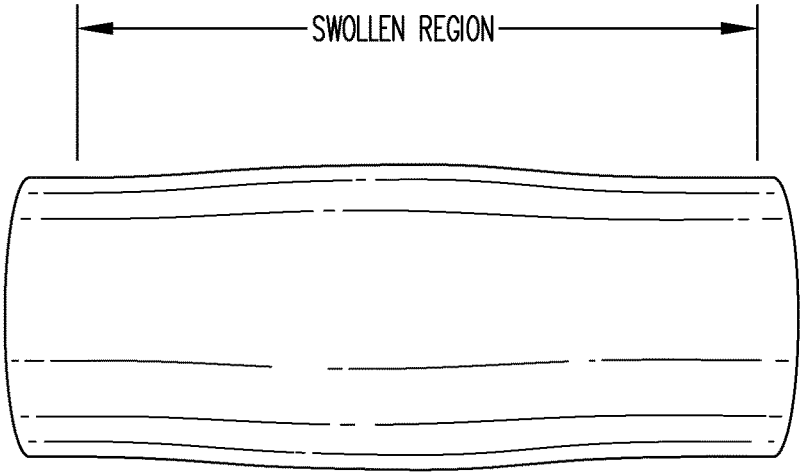
FIG. 13G shows a ballistically actuated wellbore tool after an experimental test.

FIG. 13G showS the casing and swell profile after test 6.

Figure 13H:
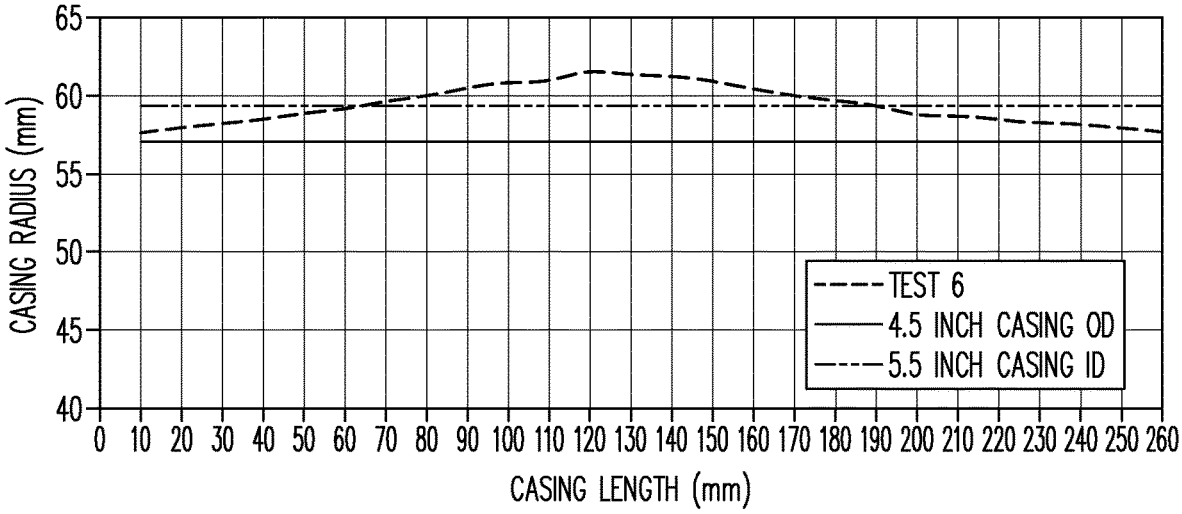
FIG. 13H shows a swell profile for the ballistically actuated wellbore tool of FIG. 13G.

FIG. 13H showS the casing and swell profile after test 6.

Figure 14:
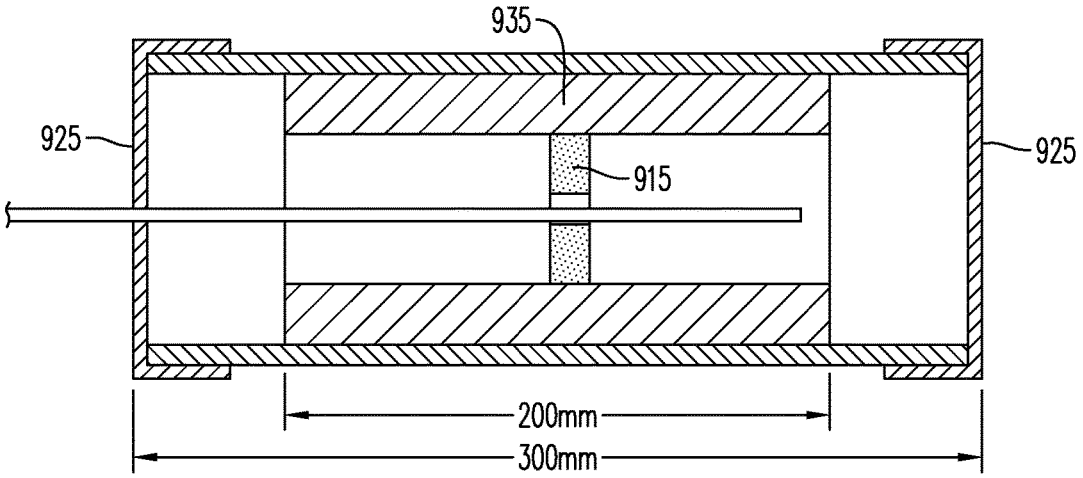
FIG. 14 shows an experimental setup for a ballistically actuated wellbore tool.
Figure 15A:
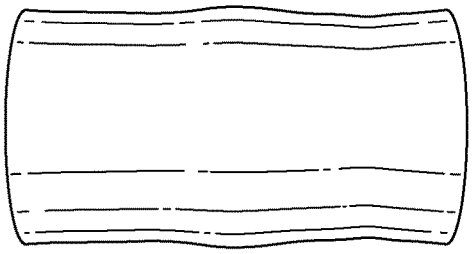
FIG. 15A shows a ballistically actuated wellbore tool after an experimental test.
Figure 15B:
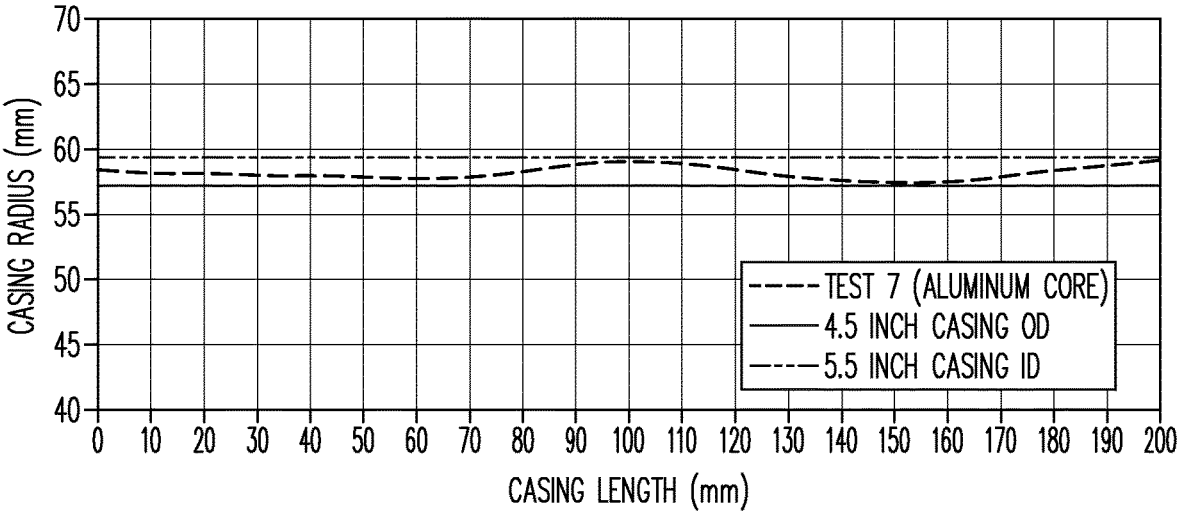
FIG. 15B shows a swell profile for the ballistically actuated wellbore tool of FIG. 15A.
Figure 15C:
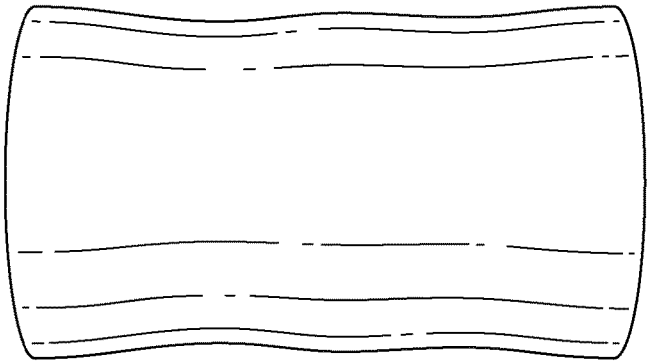
FIG. 15C shows a ballistically actuated wellbore tool after an experimental test.
Figure 15D:
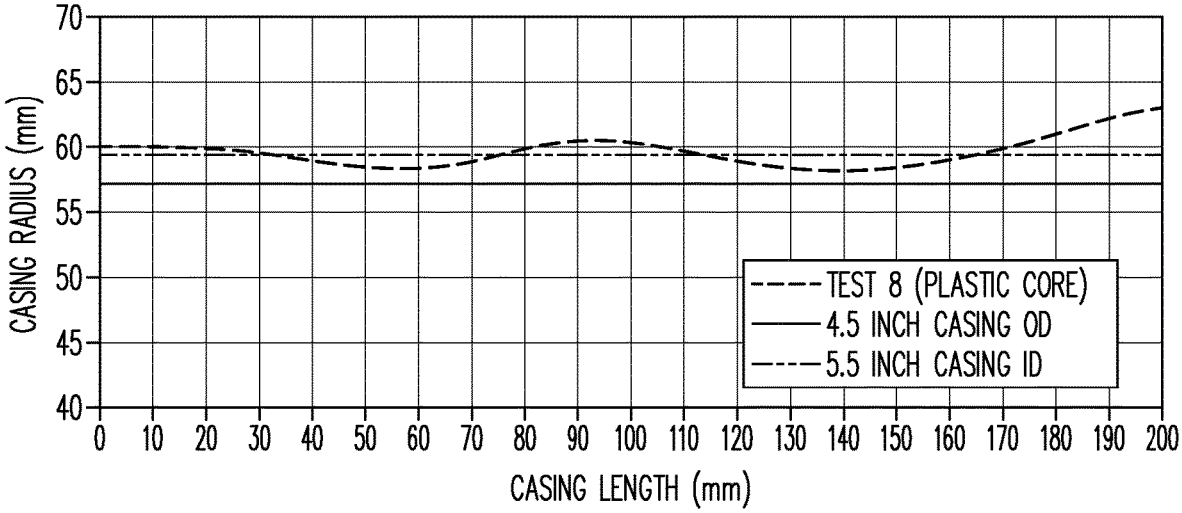
FIG. 15D shows a swell profile for the ballistically actuated wellbore tool of FIG. 15C.
Figure 15E:
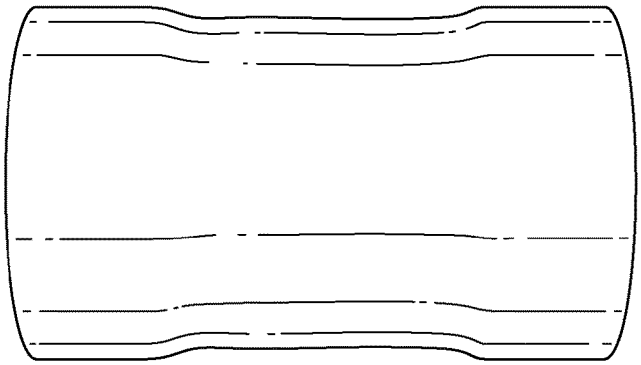
FIG. 15E shows a ballistically actuated wellbore tool after an experimental test.
Figure 15F:
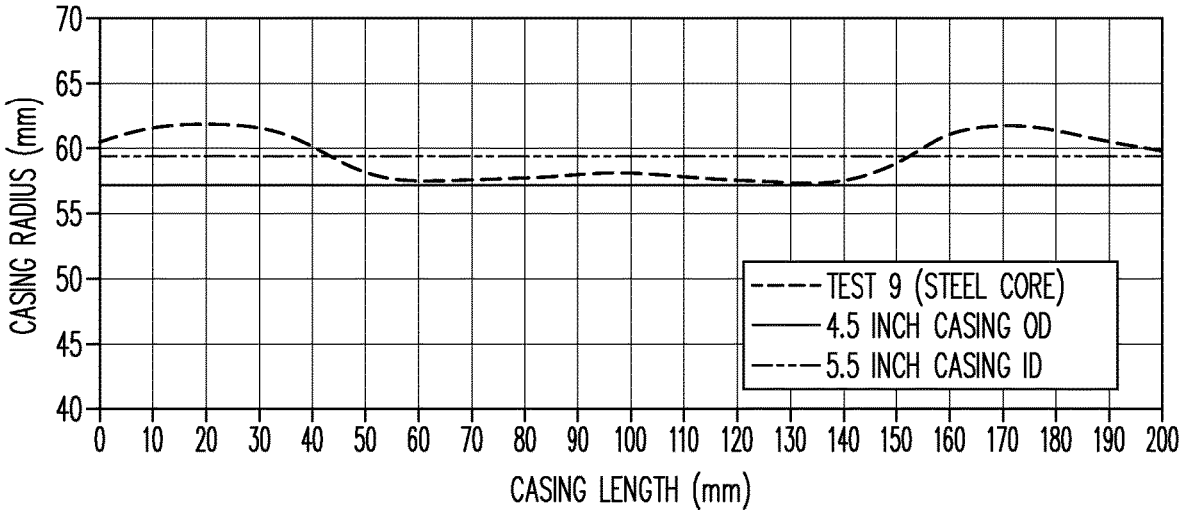
FIG. 15F shows a swell profile for the ballistically actuated wellbore tool of FIG. 15E.

With reference now to FIGS. 14-15F, tests 7-9 were performed to evaluate the impact of decreasing the free inner volume of the outer carrier 105 with an inner core 935 of varying material. For each test, a 50 g pellet 915 (53 mm OD) was positioned in the middle of the inner core 935 within the outer carrier 105.

In test 7, the inner core 935 was an aluminum pipe. FIG. 15A shows the carrier and swell profile after test 7.

FIG. 15B also shows the carrier and swell profile after test 7.

In test 8, the inner core 935 was a plastic tube. FIG. 15C shows the carrier and the swell profile after test 8.

FIG. 15D also shows the carrier and the swell profile after test 8.

In test 9, the inner core 935 was a steel tube. FIGS. 15E and 15F show the carrier and the swell profile after test 9.

As shown in FIGS. 15B, 15D, and 15F, the swell induced by each of tests 7-9 is not uniform, and the maximum swell achieved in the middle of the casing was by the plastic tube.

Figure 16A:
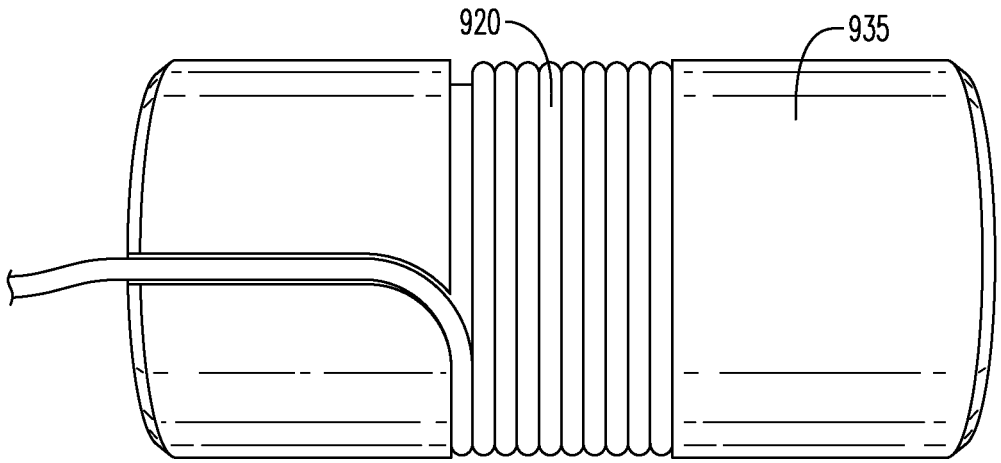
FIG. 16A shows an experimental setup for a ballistically actuated wellbore tool.

With reference now to FIG. 16A, test 10 replaced the explosive pellet with about 9 rows of detonating cord 920 wrapped around an inner core 935 of polyvinyl chloride (PVC) that was inserted into the carrier. The detonating cord in these and other tests include HMX explosive material. The resulting explosive weight was about 48.06 g.

Figure 16B:
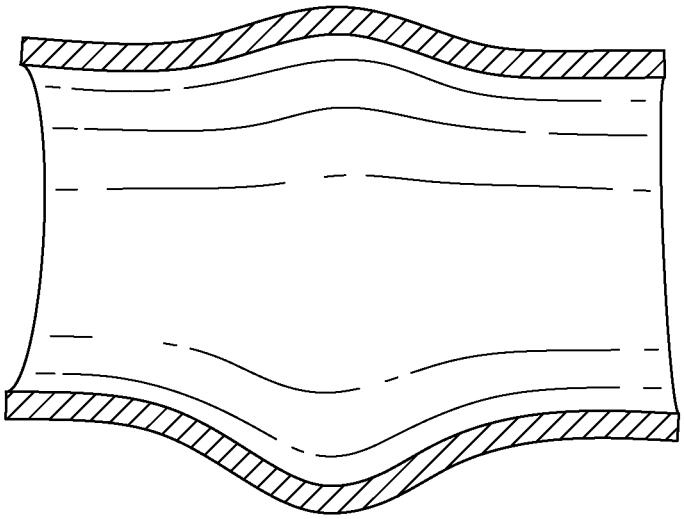
FIG. 16B shows a ballistically actuated wellbore tool after an experimental test.

As shown in FIG. 16B, this arrangement cut the carrier in half such that a swell measurement was not possible.

Figure 16C:
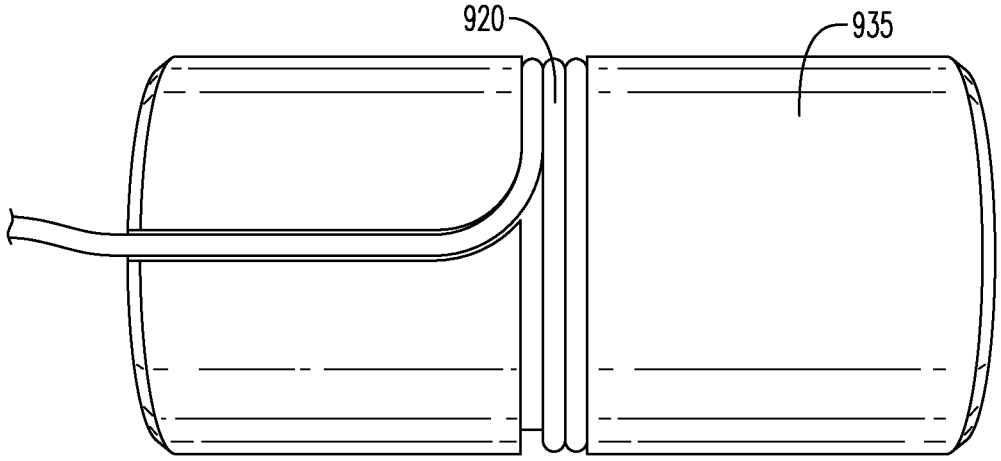
FIG. 16C shows an experimental setup for a ballistically actuated wellbore tool.
Figure 16D:
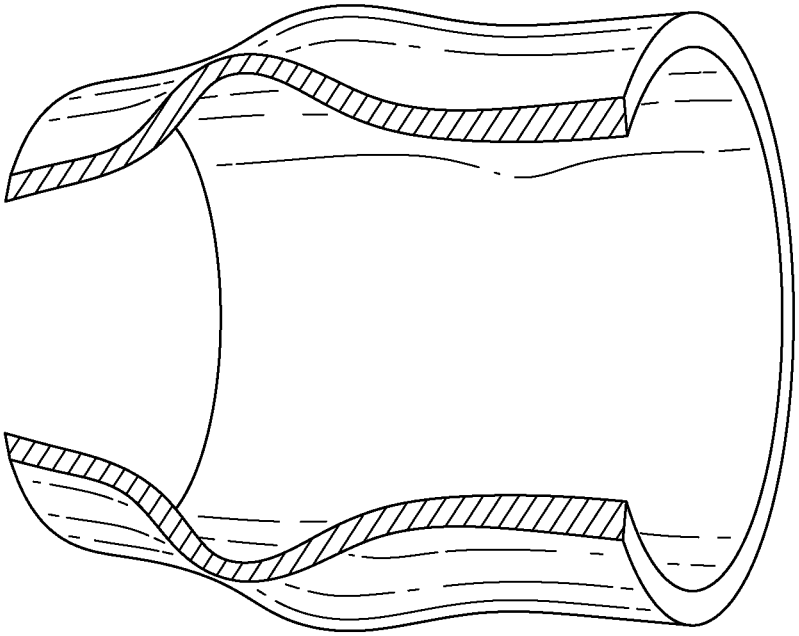
FIG. 16D shows a ballistically actuated wellbore tool after an experimental test.

With reference now to FIG. 16C, for test 11 a similar setup as in test 10 was used but the length of detonating cord 920 (number of rows) was decreased and the thickness of the cord was increased. The resulting explosive weight was about 51.66 g. As shown in FIG. 16D, this arrangement cut the carrier in half such that a swell measurement was not possible.

Based on the results from tests 10 and 11, it is believed that the free space in the carrier may play an important role in swelling the carrier such that decreasing the free space in the carrier could have a severe impact on the carrier.

Figure 17A:
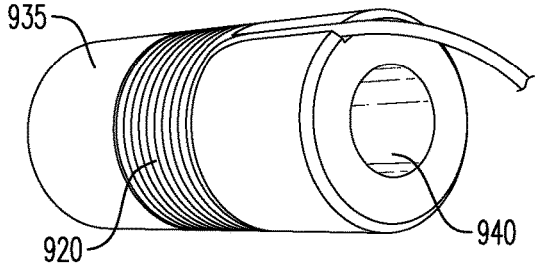
FIG. 17A shows an experimental setup for a ballistically actuated wellbore tool.
Figure 17B:
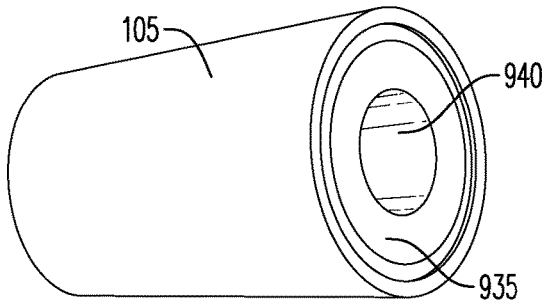
FIG. 17B shows an experimental setup for a ballistically actuated wellbore tool.

With reference now to FIG. 17A and FIG. 17B, to avoid rupturing the carrier as in tests 10 and 11, test 12 was designed with a PVC having an inner diameter (ID) of 50 mm and an inner free space 940. The total explosive weight from the detonating cord 920 was approximately 48 g and the inner free space 940 had a diameter of 50 mm.

The tests noted above re FIG. 17A and FIG. 17B were performed with air as the inner and outer media.

Figure 17C:
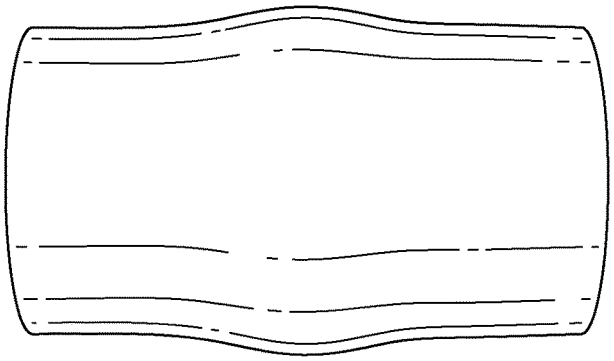
FIG. 17C shows a ballistically actuated wellbore tool after an experimental test.

FIG. 17C shows the carrier and the swell profile after test 12, and a substantially uniform swell in the carrier.

Figure 17D:
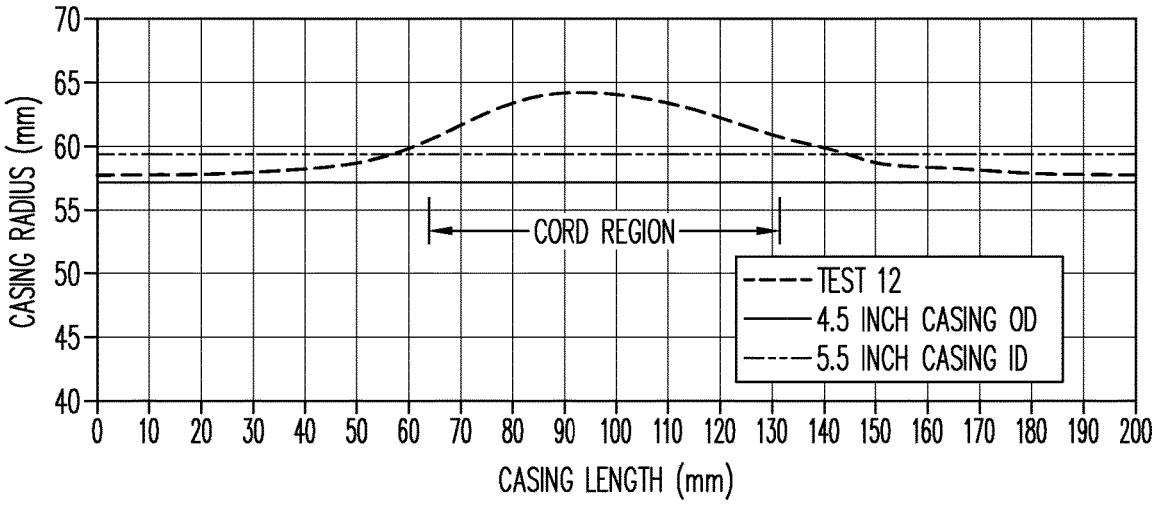
FIG. 17D shows a swell profile for the ballistically actuated wellbore tool of FIG. 17C.

FIG. 17D also shows the carrier and the swell profile after test 12, and a substantially uniform swell in the carrier.

Figure 18A:
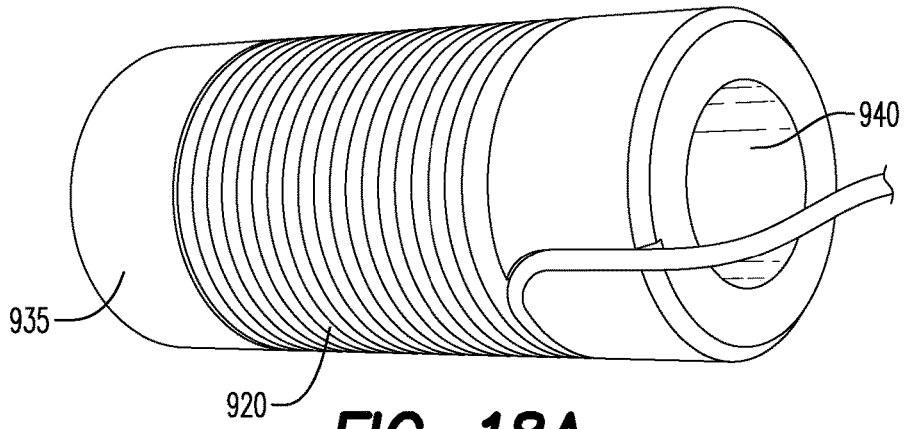
FIG. 18A shows an experimental setup for a ballistically actuated wellbore tool.

With reference now to FIG. 18A, test 13 included a test setup similar to test 12 but with an increased length of detonating cord 920 including dummy cord to space out the explosive detonating cord 920. The explosive weight was approximately 48 g.

Figure 18B:
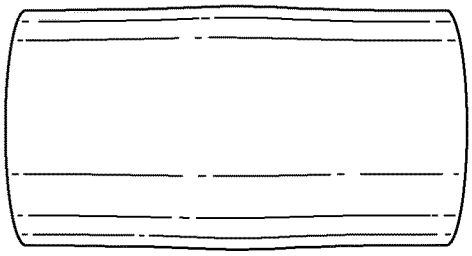
FIG. 18B shows a ballistically actuated wellbore tool after an experimental test.
Figure 18C:
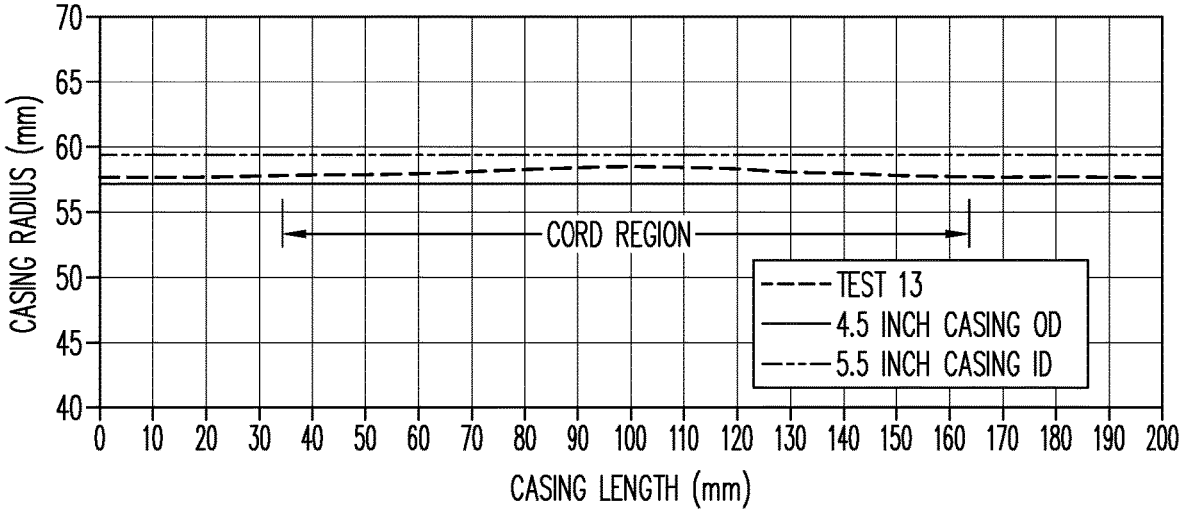
FIG. 18C shows a swell profile for the ballistically actuated wellbore tool of FIG. 18B.

FIGS. 18B and FIG. 18C each show the carrier and swell profile after test 13.

As shown in FIG. 17D and FIG. 18C, the PVC core with free space filled with air seems to induce a more uniform swell and prevents the rupturing observed in tests 11 and 12 with a solid PVC core. In addition, increasing the width of the cord axially along the inner core apparently significantly decreases the maximum swell.

Figure 19A:
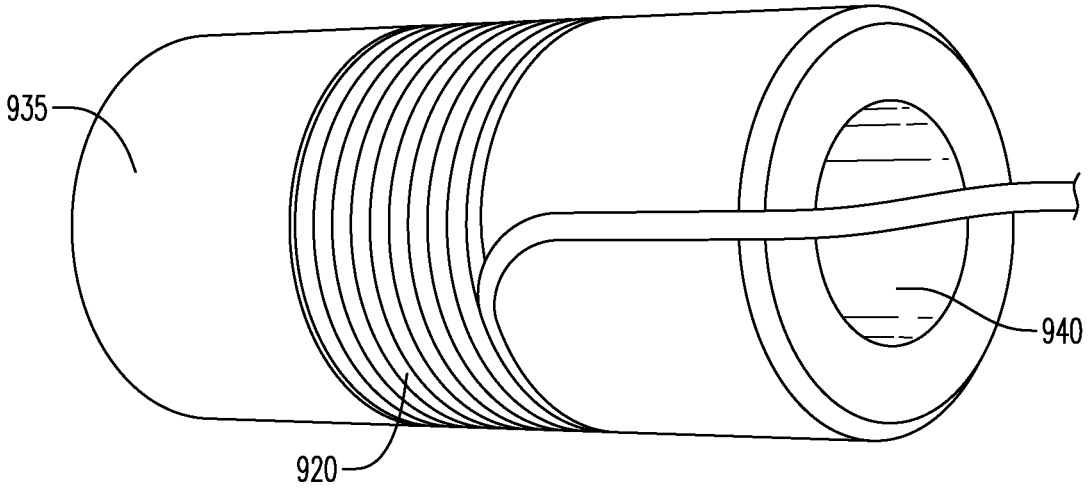
FIG. 19A shows an experimental setup for a ballistically actuated wellbore tool.

With reference now to FIG. 19A, test 14 used approximately 48.06 g explosive weight of detonating cord 920 and a PVC core with an ID of 62 mm, and therefore increased free space 940 compared to tests 12 and 13. The PVC core was filled with water. The outer carrier 105 was sealed with caps 925.

Figure 19B:
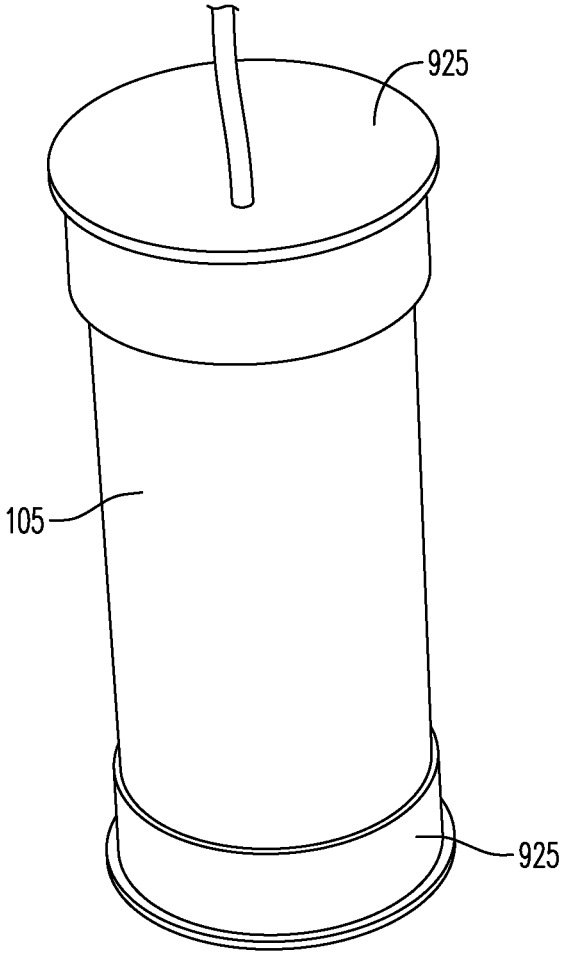
FIG. 19B shows an experimental setup for a ballistically actuated wellbore tool.

FIG. 19B similarly shows the set up for test 14.

Figure 19C:
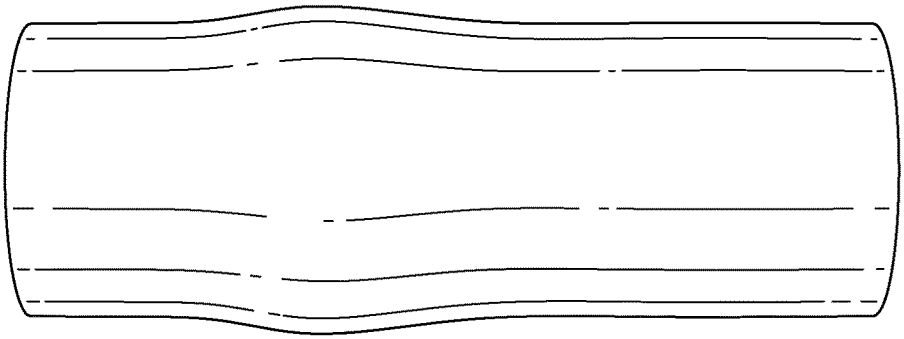
FIG. 19C shows a ballistically actuated wellbore tool after an experimental test.
Figure 19D:
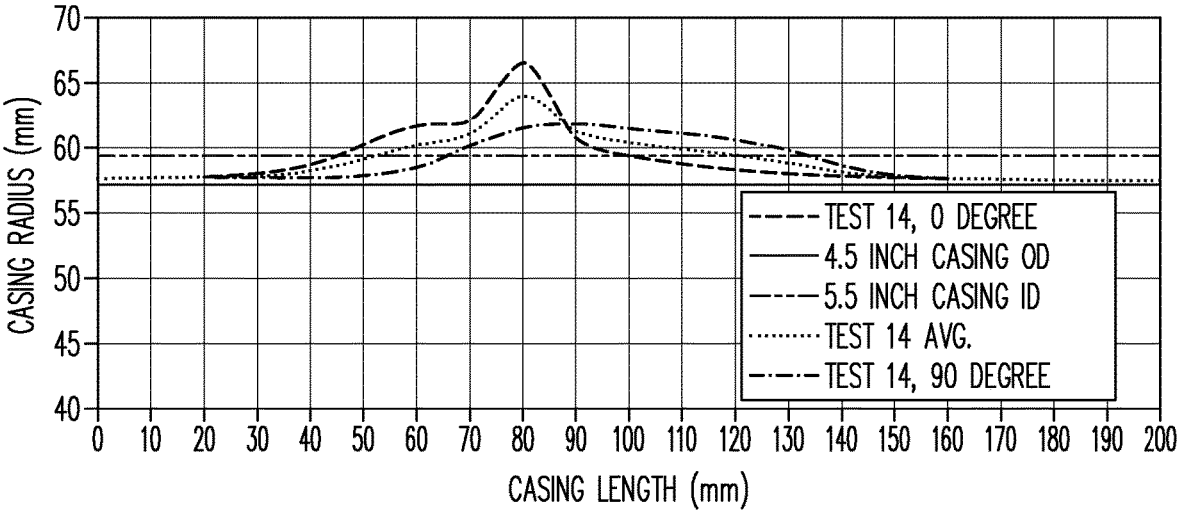
FIG. 19D shows a swell profile for the ballistically actuated wellbore tool of FIG. 19C.

FIGS. 19C and 19D show the carrier and swell profile after test 14. After test 14, the swell was not completely round and somewhat inconsistent. The swell had certain areas with an oval profile.

Accordingly, as shown in FIG. 19D, the circumference of the carrier after test 14 was measured on two different axes: 0 degrees and 90 degrees. The average circumference value (charted in FIG. 19D) is the average of the 0-degree and 90-degree measurements.

Filling the casing with water (test 14) instead of air (tests 12 and 13) seems to have increased the maximum swell, likely due to the water as an inner medium. Test 13 showed the least amount of swell of tests 12-14, likely due to the explosive sections of the detonating cord being spaced further apart.

Figure 20A:
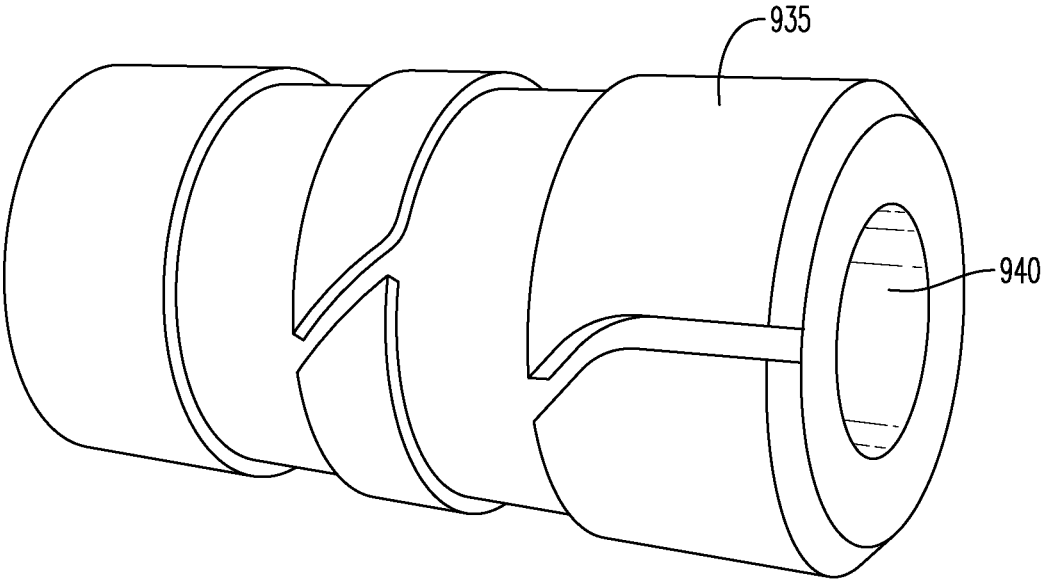
FIG. 20A shows an experimental setup for a ballistically actuated wellbore tool.

With reference now to FIG. 20A, tests 15-17 investigated the possibility of increasing the swell length (i.e., axially along the carrier) in a 4.5" carrier 105.

Figure 20B:
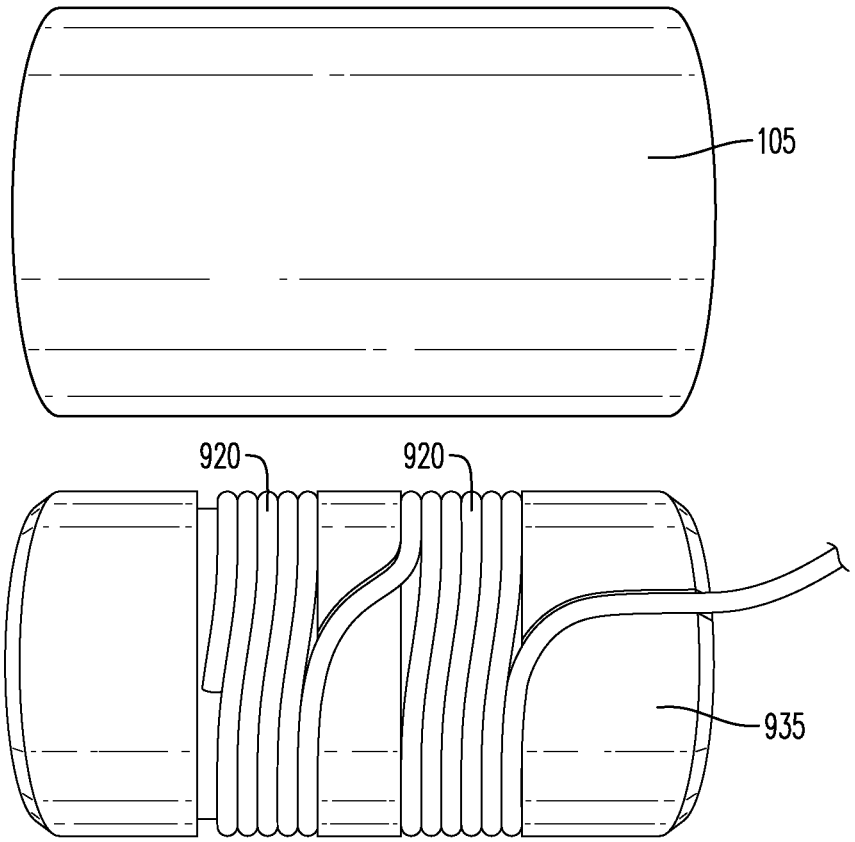
FIG. 20B shows an experimental setup for a ballistically actuated wellbore tool.

FIG. 20B illustrates that the setup included wrapping the detonating cord 920 in two different rows around the PVC inner core 935 with an inner free area 940. In test 15, approximately 58.5 g of explosive weight was used between the two rows of detonating cord 920.

Figure 20C:
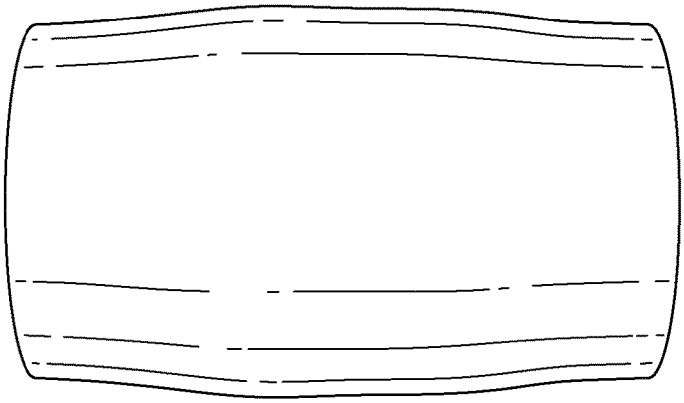
FIG. 20C shows a ballistically actuated wellbore tool after an experimental test.

FIG. 20C shows the carrier and swell profile after test 15, and the increased axial region that experienced swell versus previous tests.

Figure 20D:
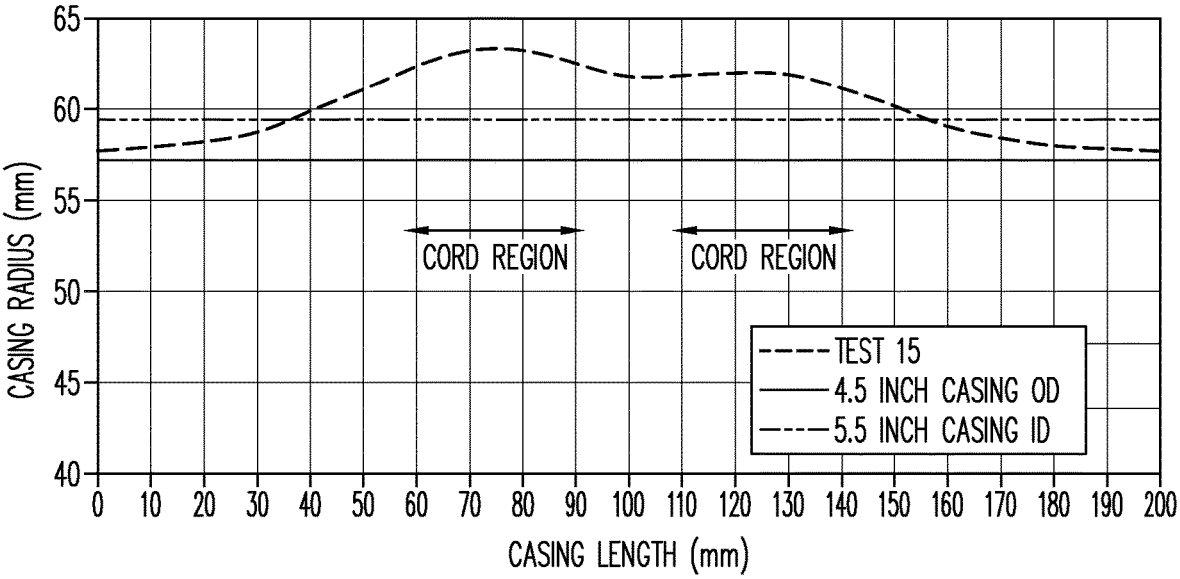
FIG. 20D shows a swell profile for the ballistically actuated wellbore tool of FIG. 20C.

FIG. 20D also shows the carrier and swell profile after test 15, and the increased axial region that experienced swell versus previous tests.

Figure 20E:
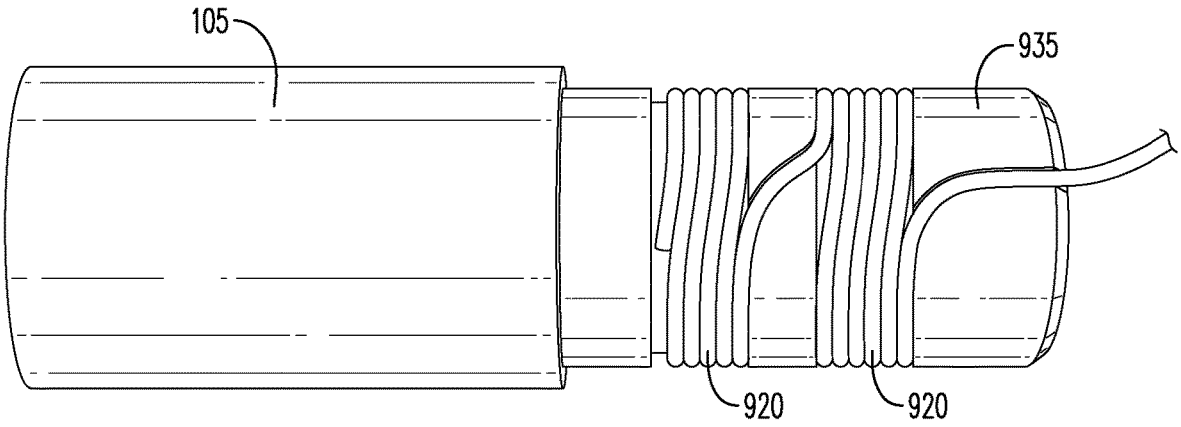
FIG. 20E shows an experimental setup for a ballistically actuated wellbore tool.

With reference now to FIG. 20E, test 16 used a similar setup with respect to the inner core 935 as in test 15, but in test 16 the total explosive weight was increased to 61.2 g and the 4.5" outer carrier 105 was inserted into and shot within a 5.5" casing 945 representing a wellbore casing within which the carrier/wellbore tool would be actuated.

Figure 20F:
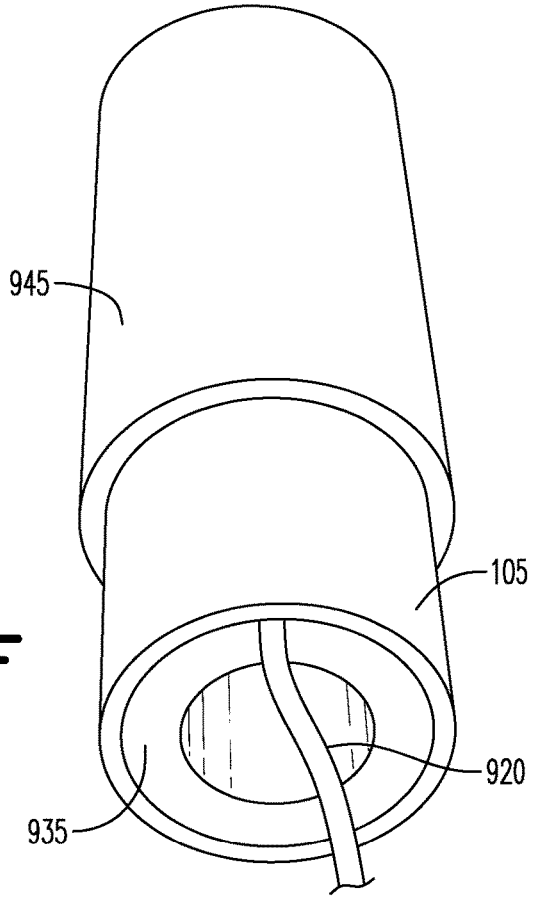
FIG. 20F shows an experimental setup for a ballistically actuated wellbore tool.

FIG. 20F also shows that test 16 used a similar setup with respect to the inner core 935 as in test 15, with a similar adjustment in total explosive weight as in FIG. 20E.

Figure 20G:
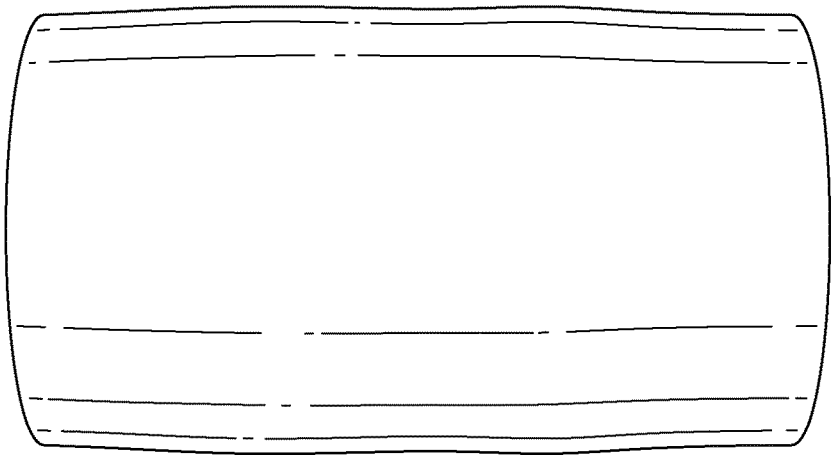
FIG. 20G shows a ballistically actuated wellbore tool after an experimental test.

FIG. 20G shows the carrier and swell profile after test 16, after which the carrier was capable of removal from the casing 945.

Figure 20H:
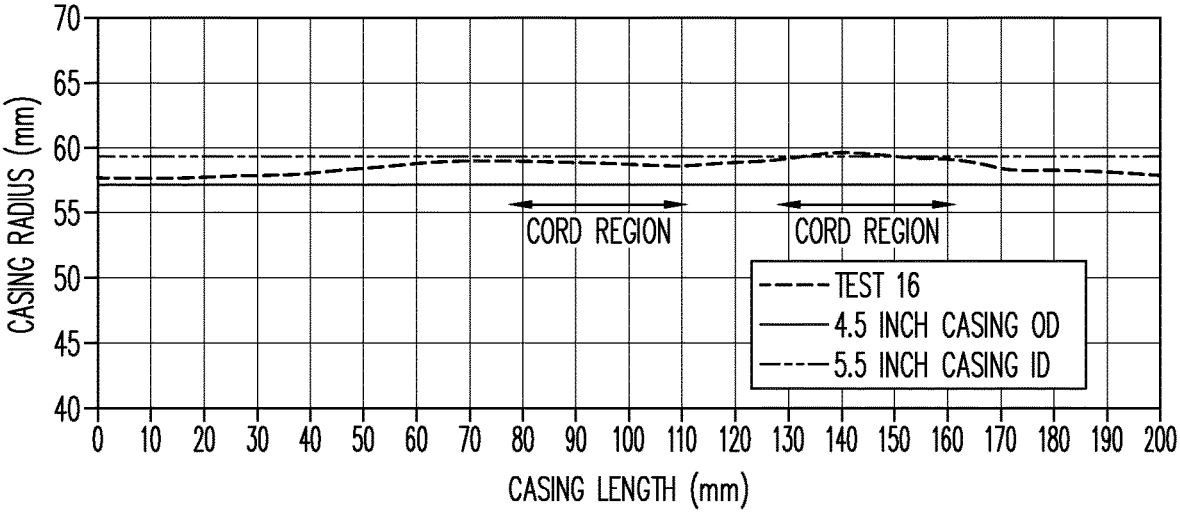
FIG. 20H shows a swell profile for the ballistically actuated wellbore tool of FIG. 20G.

FIG. 20H also shows the carrier and swell profile after test 16, after which the carrier was capable of removal from the casing 945.

Figure 20I:
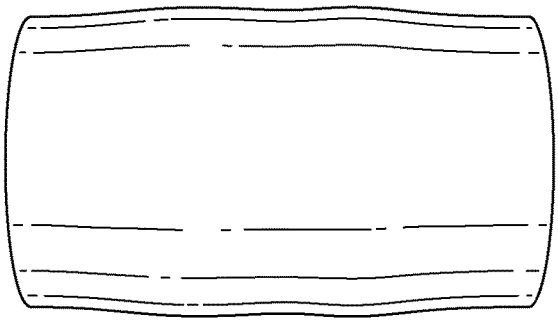
FIG. 20I shows a ballistically actuated wellbore tool after an experimental test.
Figure 20J:
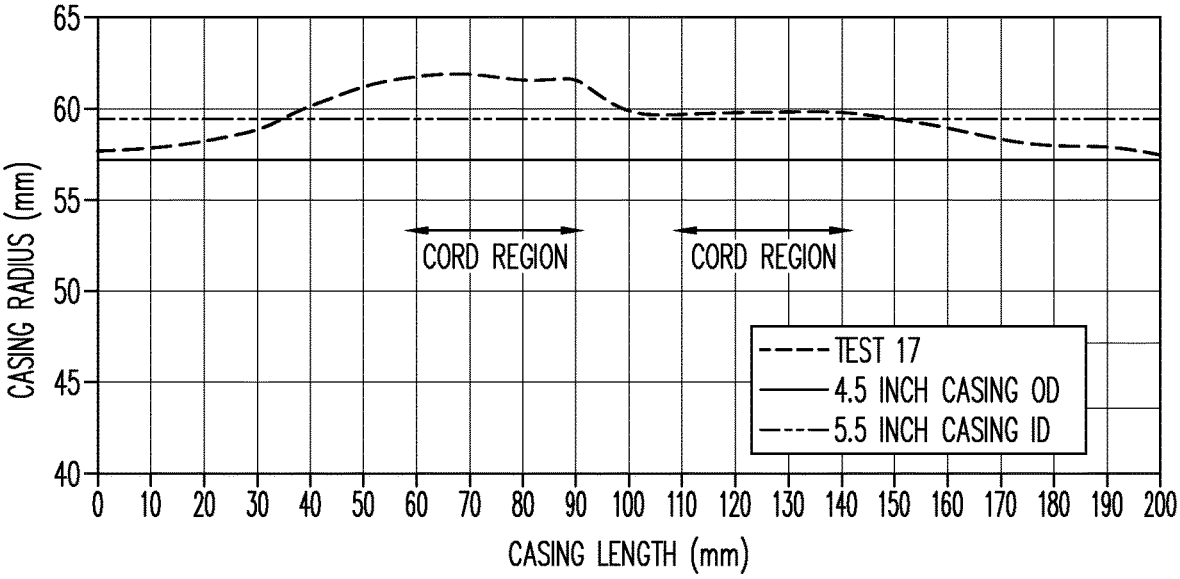
FIG. 20J shows a swell profile for the ballistically actuated wellbore tool of FIG. 20I.
Figure 20K:
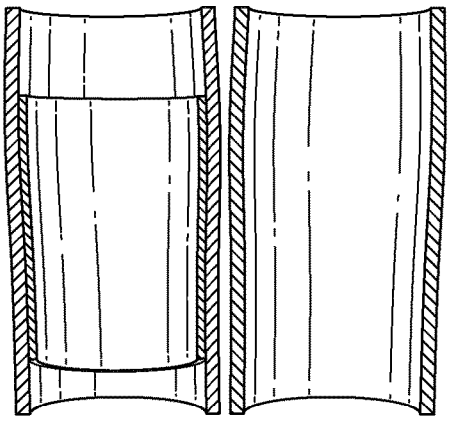
FIG. 20K shows the ballistically actuated wellbore tool of FIG. 20I in a casing after the experimental test.
Figure 20L:
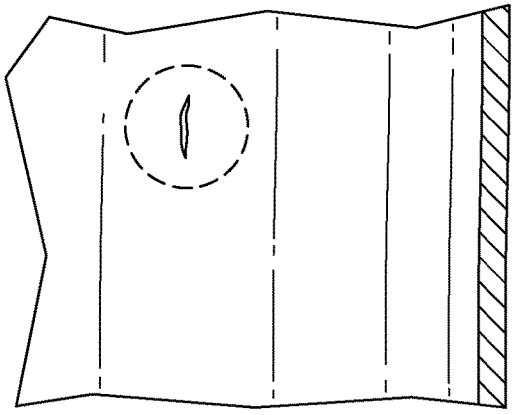
FIG. 20L shows the ballistically actuated wellbore tool of FIG. 20I in a casing after the experimental test.

With reference now to FIGS. 20I-20L, test 17 used a similar setup to test 16 but the explosive weight from the detonating cord was approximately 115 g. As shown in FIG. 20L, test 17 also caused an open crack on the outer surface of the carrier.

FIG. 20I shows the carrier and swell profile after test 17, in which the carrier got stuck in the casing as shown in FIG. 20K. The swell was measured after cutting the casing open and removing the carrier from within.

FIG. 20J also shows the carrier and swell profile after test 17, in which the carrier got stuck in the casing as shown in FIG. 20K. As in FIG. 20I, the swell was measured after cutting the casing open and removing the carrier from within.

According to tests 15-17, two rows of detonating cord on the inner core apparently induce a wider (i.e., along a greater axial length of the carrier) swell compared to one row of cord. Increasing the explosive weight apparently increases the maximum swell and the fixation of the carrier in the wellbore casing.

Test 18 evaluated a different 4.5" carrier grade and used a similar setup with detonating cord 920 wrapped around an inner core 935 as in tests 15-17, and the inner core 935 was placed in a carrier 105 made from D10053 ST 37 steel and shot in a 5.5" casing. The total explosive weight from the detonating cord was approximately 54 g. The carrier became completely trapped in the casing and swell was not measured.

Overall, according to the test results, using the detonating cord as the explosive material instead of the explosive pellet results in an increase in the swollen region. Other suggestions from the testing include: 1) the inner and outer medium fluid directly affect the amount of swell and the shape of the swell; 2) increasing explosive weight (while keeping other conditions constant) increases the amount of swell; 3) the amount of free volume in the carrier affects the swell; 4) using water instead of air between the explosive and the carrier, within the carrier, increases the swell; 5) the material of the inner core (e.g., to reduce free volume in the carrier) affects the swell; 6) the grade of steel from which the carrier is formed affects the amount of swell; and 7) where two rows of detonating cord are used on a PVC inner core, the row at which initiation starts induces a greater swell than the other row.

In other testing done with a setup including a PVC inner core with inner free volume such as in test 12, except with water as an inner medium and an outer medium, results showed or suggested, among other things, that doubling the thickness of the outer carrier wall from 7 mm to 14 mm decreased swell by approximate 58% but prevented the outer carrier wall from cracking and substituting steel for the PVC as the inner core material increased the swell by approximate 131%.

Figure 21:
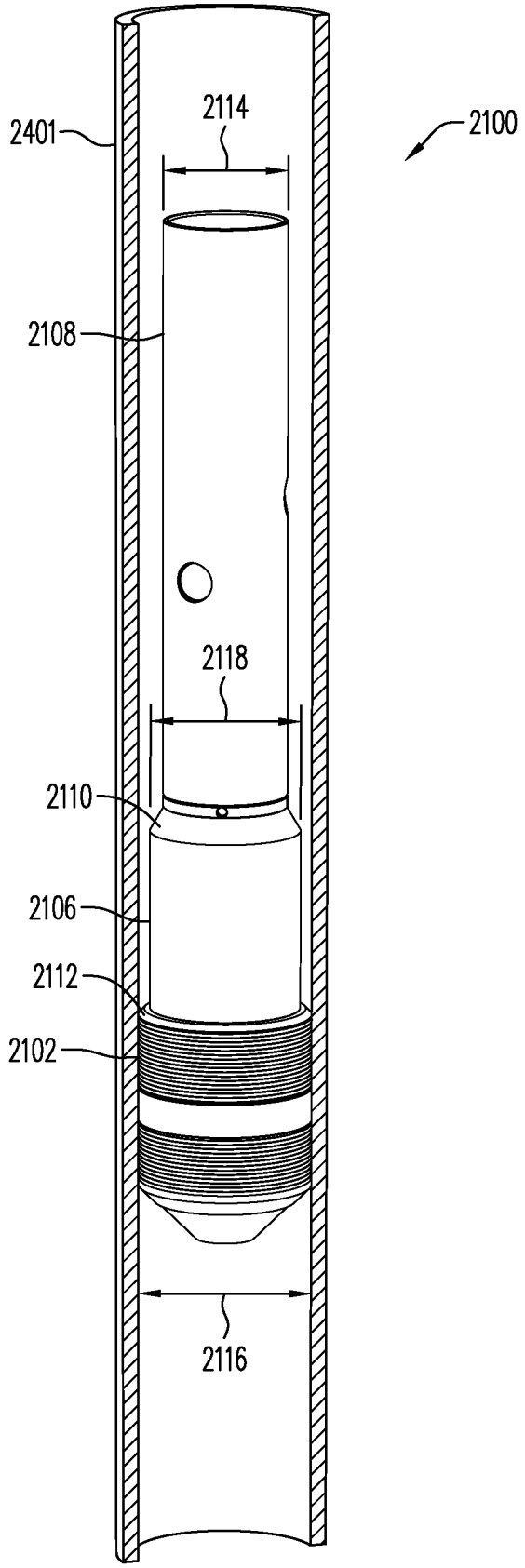
FIG. 21 is a cross-sectional view of a wellbore casing including a ballistically actuated wellbore tool.

FIG. 21 is a cross-sectional view of a wellbore casing 2104 including a ballistically actuated wellbore tool positioned in the wellbore casing 2104. According to an aspect, the ballistically actuated wellbore tool includes a ballistically actuated plug 2100. According to an aspect, the ballistically actuated plug 2100 includes a ballistic housing 2106. The ballistic housing 2106 may be connected to a perforating gun housing 2108 on a first end 2110 of the ballistic housing 2106 and an outer seal housing 2102 on a second end 2112 of the ballistic housing 2106. The ballistically actuated plug 2100 includes the outer seal housing 2102 connected to the ballistic housing 2106. The ballistic housing 2106 may be attached to a perforating gun housing 2108 or another wellbore tool.

As seen in FIG. 21, for example, an outer diameter (a third outer diameter) 2118 of the ballistic housing 2106 may be less than an outer diameter (second outer diameter) 2116 of the outer seal housing 2102, and an outer diameter (a first outer diameter) 2114 of the perforating gun housing 2108 may be less than the second outer diameter 2116 of the ballistic housing 2106. The second outer diameter 2116 of the outer seal housing 2102 may be the largest of the outer diameters because the ballistically actuated plug 2100 is contemplated to expand in an outward configuration in order to form a sealing engagement with the wellbore casing 2104.

Figure 22:
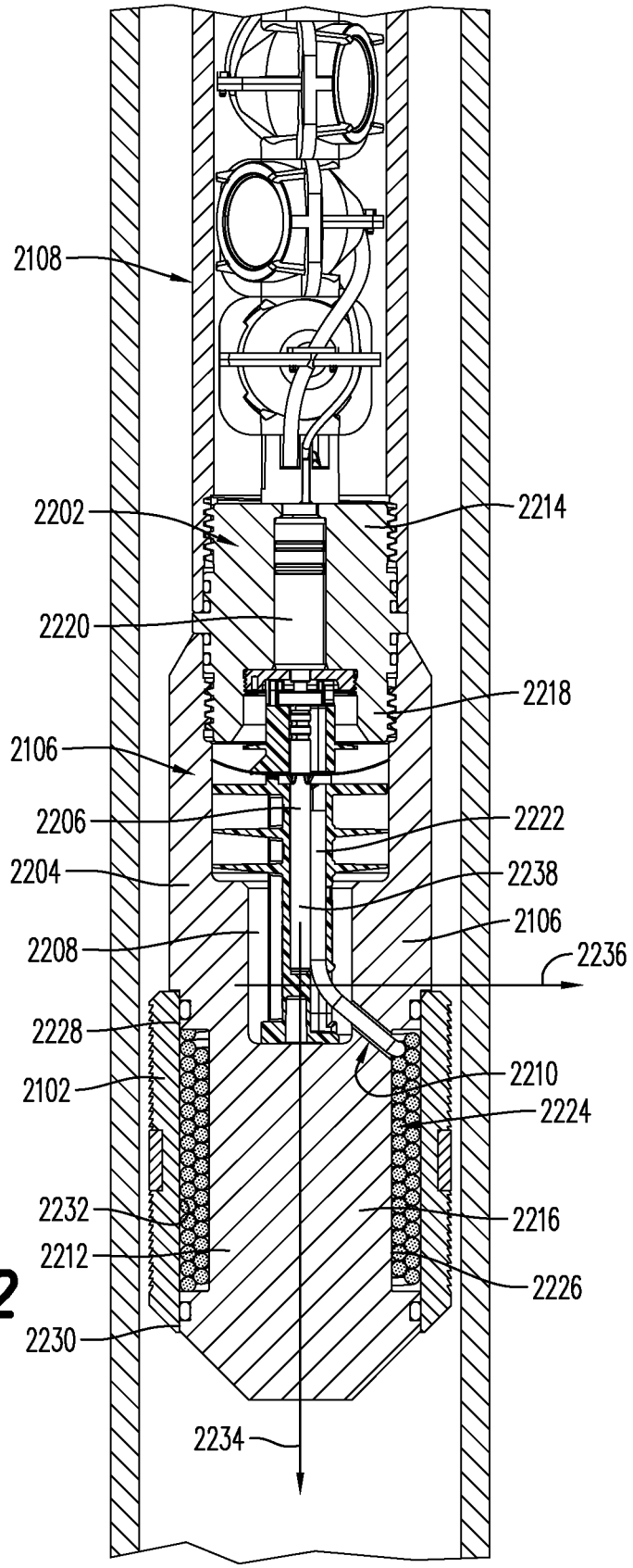
FIG. 22 is a cross-sectional view of a ballistically actuated wellbore tool, according to an aspect.

FIG. 22 depicts a cross-sectional view of the wellbore casing 2104, with the ballistically actuated plug 2100 being disposed therein. While FIG. 22 illustrates the ballistically actuated plug 2100 being in a relatively centralized position in the wellbore casing 2104, it is contemplated that the ballistically actuated plug 2100 may be decentralized, that is, the ballistically actuated plug 2100 may be positioned in the wellbore casing 2104 such that the clearance between the ballistically actuated plug 2100 and the wellbore casing 2104 varies along the length of the ballistically actuated wellbore tool.

According to an aspect, the ballistic housing 2106 includes a first housing portion 2204 including a chamber 2208. The chamber 2208 may be configured as an open space within which an item or other physical structure may be positioned. The chamber 2208 may be a drilled out portion of the first housing portion 2204 of the ballistic housing 2106. According to an aspect, the chamber 2208 is a multi-bore space (i.e., consisting of bores having multiple different inner diameters) for receiving one or more ballistic components. For example, the chamber 2208 includes an initiator 2206. The initiator 2206 may be a detonator such as a wireless detonator as described in U.S. Pat. No. 9,605,937, which is commonly assigned to DynaEnergetics Europe GmbH and incorporated herein by reference in its entirety. According to an aspect, the initiator 2206 includes a wireless detonator that is capable of being positioned or placed into a perforating gun assembly with minimal effort, by means of placement/positioning within a detonator positioning assembly, for wireless connection to adjacent electrical components in the gun assembly. In an embodiment, the detonator positioning assembly includes the detonator positioned within the detonator positioning assembly, which is then positioned within the chamber 2208 of the ballistic housing 2106. The detonator may be configured to electrically contactably form an electrical connection without the need of manually and physically connecting, cutting or crimping wires as required in a wired electrical connection. In other words, the detonator may be a wirelessly-connectable selective detonator.

Figure 24:
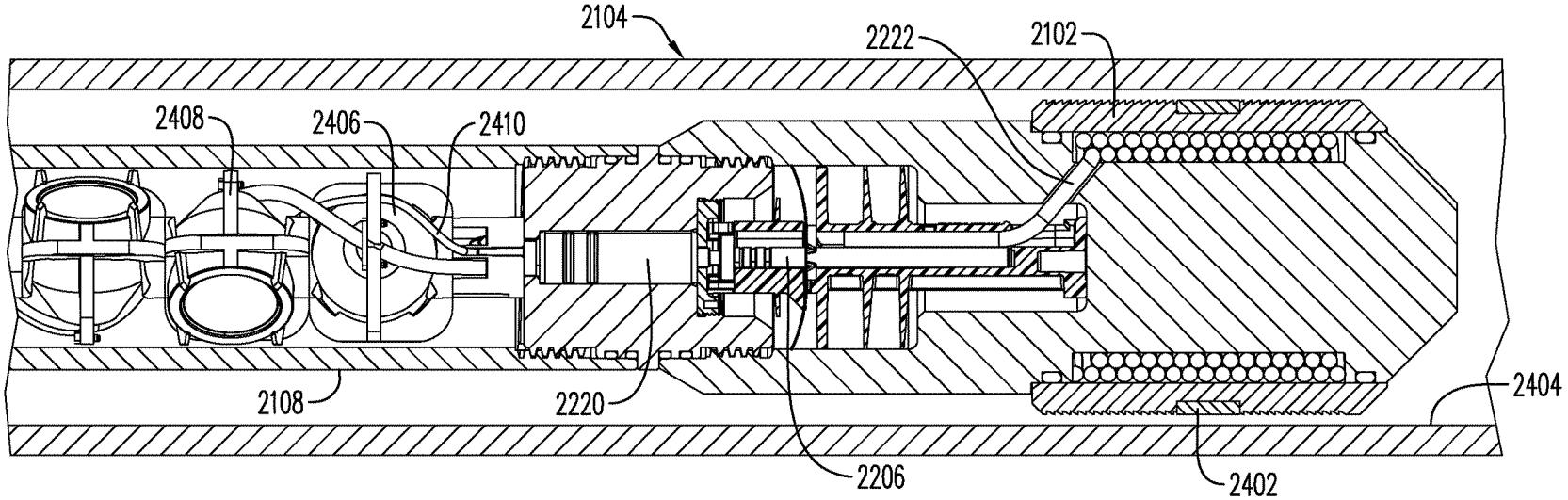
FIG. 24 is a cross-sectional view of a ballistically actuated wellbore tool including a detonator and a detonation extender, prior to ballistic activation, according to an aspect.
Figure 25:
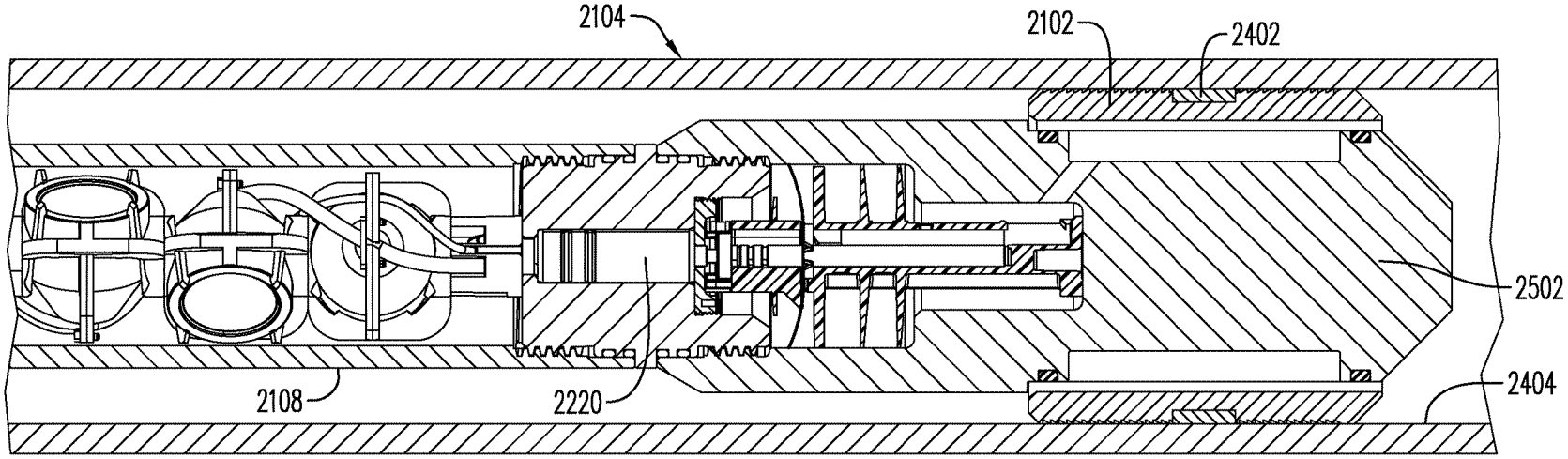
FIG. 25 is a cross-sectional view of a ballistically actuated wellbore tool including a detonator and a detonation extender, after ballistic activation, according to an aspect.
Figure 26:
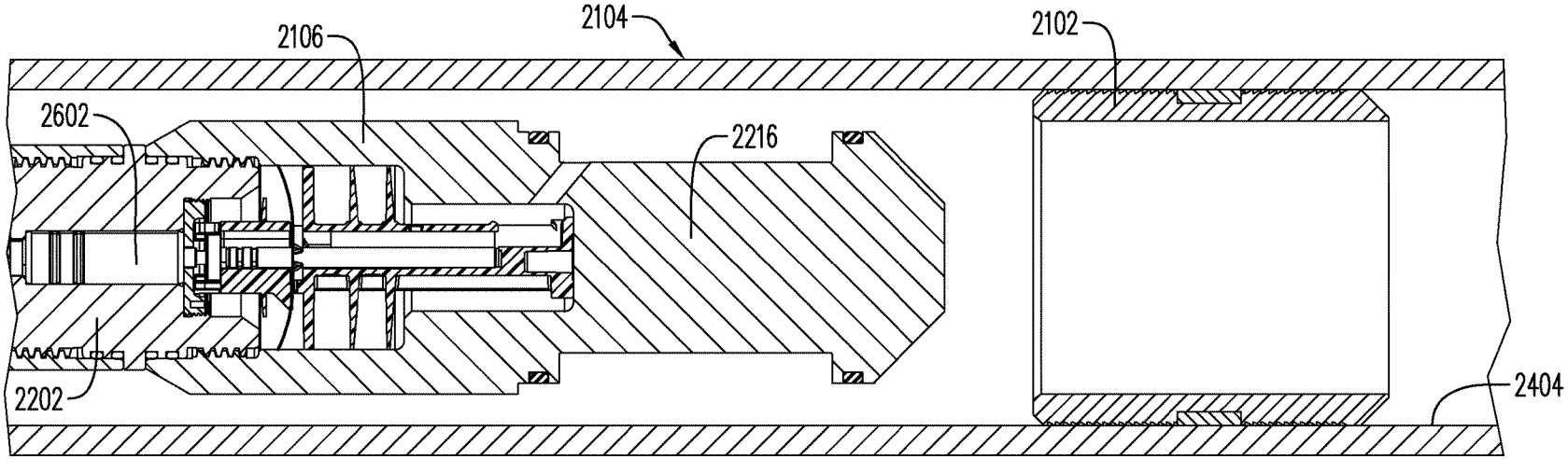
FIG. 26 is a cross-sectional view of a ballistically actuated wellbore tool, illustrating a ballistic housing being detached from a seal housing after ballistic activation, according to an aspect.

As illustrated in at least FIG. 22, and with reference to FIGS. 24-26, embodiments of the disclosure are associated with a wellbore tool assembly including a perforating gun bulkhead assembly 2220, and a sub-assembly 2202 including a first sub portion 2214 and a second sub portion 2218. The first sub portion 2214 may be coupled to the perforating gun housing 2108 According to an aspect, the second sub portion 2218 is coupled to the first housing portion 2204. As would be understood by one of ordinary skill in the art, an electrical feed-through assembly may be positioned in the sub (i.e., in a bore formed through the sub). The electrical feed through assembly is illustrated as being a bulkhead assembly 2220, however, other electrical feed through mechanisms are contemplated. The bulkhead assembly 2220 is illustrated as being connected to the initiator 2206, which is positioned in the ballistic housing 2106 of the ballistically actuated wellbore tool, and to a detonating cord, electrical feedthrough, and shaped charge positioning device provided in the adjacent perforating gun housing 2108.

According to an aspect, the ballistic housing 2106 further includes a second housing portion 2212. The second housing portion 2212 extends from the first housing portion 2204 and is configured to extend through an opening 2312 (or a central channel) of the outer seal housing 2102 and has a noncompressible core 2216. The noncompressible core 2216 may include a core of solid material as opposed to a hollow core (or a portion of a structure that includes an empty chamber or an empty space). In at least one other configuration, the noncompressible core 2216 may include a space or chamber that is filled with a liquid. According to an aspect, the noncompressible core 2216 has an outer diameter that varies based on the amount of detonating cord or explosive layers that is utilized. According to an aspect, the noncompressible core 2216 may include protrusions that act as spacers. The detonating cord or explosive layers may be disposed in between these protrusions or may be disposed circumferentially around the protrusions. The noncompressible core 2216 helps to ensure that the ballistic housing 2106 remains intact after detonation of an initiator 2206 and the detonation extender 2222 expands and deforms the outer seal housing 2102.

Figure 23:
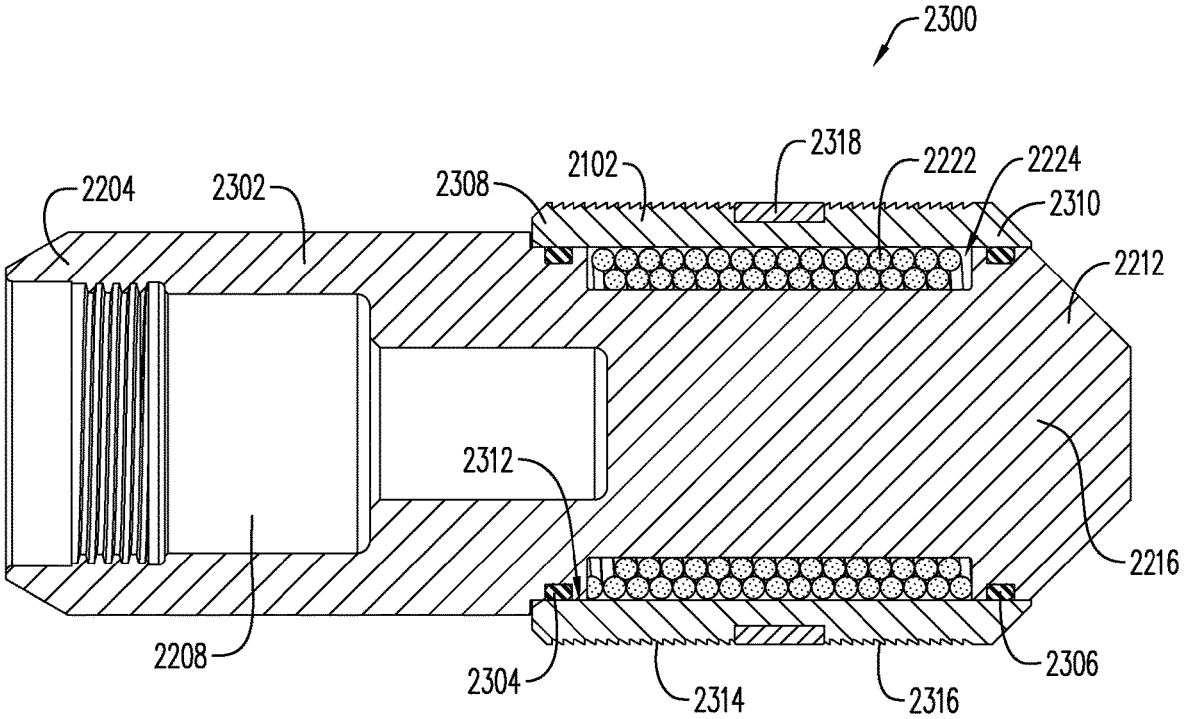
FIG. 23 is a cross-sectional view of a ballistically actuated wellbore tool including a ballistic housing secured to an outer seal housing, according to an aspect.

In an aspect, the ballistic housing is formed from a single monolithic piece of metal. The ballistic housing includes a recess 2224 formed in an outer surface 2226 of the second housing portion 2212. The recess 2224 may be a reduced diameter portion of the second housing portion 2212 and in an aspect, may extend circumferentially around at least the noncompressible core 2216 of the second housing portion 2212. The recess 2224 extends between a first retention portion 2228 (first retention shoulder) and a second retention portion 2230 (second retention shoulder) of the second housing portion 2212. Each of the first retention portion 2228 and the second retention portion 2230 may form a surface on which the outer seal housing 2102 can be retained. The recess 2224 may be configured as a gap that extends between the first retention portion 2228 and the second retention portion 2230. According to an aspect and as illustrated in FIG. 22, FIG. 23, and FIG. 24, the first retention portion 2228 is in engagement with an inner surface 2232 of the outer seal housing 2102 at the first end 2308 of the outer seal housing 2102, and the second retention portion 2230 is in engagement with the inner surface of the outer seal housing 2102 at the second end 2310 of the outer seal housing 2102.

According to an aspect, a channel 2210 extends from the chamber 2208 of the first housing portion 2204 to the recess 2224. The channel 2210 may extend in a direction that is away from the chamber 2208 and towards the noncompressible core 2216. According to an aspect, the channel extends in a direction between a longitudinal axis 2234 and an axial direction 2236 (radial axis) of the first housing portion 2204. According to an aspect, the channel 2210 may extend at an angle of less than 90-degrees away from the noncompressible core 2216 and may be open to an external area defined by the recess 2224 outside of the second housing portion 2212.

According to an aspect, a detonation extender 2222 is in ballistic communication with the initiator 2206. The detonation extender 2222 may be in side-by-side contact with the initiator 2206 in such a configuration that the side-by-side contact ensures that the ballistic component or explosive material of the initiator 2206 can initiate the detonation extender 2222. The detonation extender 2222 may further extend into the channel 2210 and at least around a portion of the noncompressible core 2216. As illustrated in FIG. 22 and FIGS. 23-24, for example, the detonation extender 2222 extends into the recess 2224 formed at the second housing portion 2212. According to an aspect, the detonation extender 2222 is a detonating cord or a plurality of compressed explosive pellets. The detonation extender 2222 may be circumferentially disposed around the noncompressible core 2216. According to an aspect, the detonation extender 2222 is positioned in the recess 2224. When the detonation extender 2222 includes a detonating cord, the detonating cord is wrapped around the noncompressible core 2216 to form at least two layers of detonating cord. The two layers of detonating cord may be wrapped around the noncompressible core 2216 in a staggered configuration.

As described hereinabove, the detonation extender 2222 is positioned so that it is in relatively close contact with or physically touching a shell 2238 of the initiator 2206. The detonation extender 2222 may include any sort of explosive mechanism (compressed explosive powder, a gel explosive, a detonating cord, or the like). While the detonation extender 2222 is illustrated as being in a side-by-side contact with the detonator, it is contemplated by the detonation extender 2222 may be in an end-to-end arrangement. To be sure, the initiator 2206 and detonation extender 2222 may be arranged in any configuration that allows the detonation extender 2222 to be initiated by the initiator 2206.

At least a portion of the detonation extender 2222 may be positioned in the ballistic channel 2210 that extends from the chamber 2208 of the ballistic housing 2106 to an exterior surface or portion of the ballistic housing 2106. The detonation extender 2222 may also be disposed between a gap formed between the ballistic housing 2106 and the outer seal housing 2102. The gap is formed by the ballistic housing 2106 being positioned within a space extending from a first end of the outer seal housing 2102 to a second end of the outer seal housing 2102. According to an aspect, the inner diameter of the outer seal housing 2102 may be larger than at least a portion of the outer diameter of the ballistic housing 2106. At least another portion of the second housing portion 2212, positioned in the space of the outer seal housing 2102 may have an outer diameter that (with or without o-rings) facilitates frictional engagement with the ballistic housing 2106 and the outer seal housing 2102.

According to an aspect, the outer seal housing 2102 is circumferentially disposed around the noncompressible core 2216. The detonation extender 2222 may be configured, upon detonation, to expand the outer seal housing 2102 from an unexpanded form to an expanded form to secure the outer seal housing 2102 within the wellbore casing.

FIG. 23 illustrates the outer seal housing 2102 being circumferentially disposed around the second housing portion 2212. The outer seal housing 2102 includes a first end 2308, and a second end 2310 opposite the first end 2308. According to an aspect, an opening 2312 extends between the first end 2308 and the second end 2310 of the outer seal housing 2102. The recess 2224 formed in the outer surface 2226 of the second housing portion 2212 is positioned in the opening 2312. In other words, the recess 2224 is circumferentially covered by the outer seal housing 2102.

The outer seal housing 2102 includes an external surface 2314 having an outwardly facing surface feature 2316. The outwardly facing surface feature 2316 may be configured as a plurality of external gripping teeth formed on the external surface 2314. The outer seal housing 2102 may be dimensioned such that the external gripping teeth will contact the wellbore casing's 2104 inner surface 2404 when the outer seal housing 2102 is in its outwardly expanded form. According to an aspect, the gripping teeth may be shaped to frictionally grip the inner surface 2404 of the wellbore casing 2104 and thereby position the ballistically actuated plug 2100 within the wellbore casing 2104 and form a partial or total seal between the gripping teeth and the inner surface of the wellbore casing 2104 when the outer seal housing 2102 is in the expanded form. According to an aspect, the external surface 2314 includes a plurality of the outwardly facing surface features 2316 that are each configured to engage an inner surface 2404 of the wellbore casing 2104.

According to an aspect, the outer seal housing 2102 may be a generally tubular structure that is made of a metal. According to an aspect, the outer seal housing 2102 is made from steel. The outer seal housing 2102 may be made from copper, steel or any other metal capable of being deformed or transition from an unexpanded to an expanded configuration.

One or more sealing mechanisms may be provided on the ballistic housing 2106. For example, as illustrated in FIG. 23, a first sealing mechanism 2304 is positioned around the outer surface 2226 of the second housing portion 2212 and a second sealing mechanism 2306 is positioned around the outer surface 2226 of the second housing portion 2212. The first and second sealing mechanisms are spaced apart from each other, with the recess 2224 extending between them. As further illustrated, the first sealing mechanism 2304 and the second sealing mechanism 2306 are both spaced apart from the recess 2224. According to an aspect, at least one of the first sealing mechanism 2304 and the second sealing mechanism 2306 includes an o-ring.

A seal receptacle 2318 may extend around the external surface 2314 of the outer seal housing. According to an aspect, the seal receptacle 2318 is configured to receive a sealing band 2402 (FIG. 24). When the outer seal housing 2102 is in its expanded configuration, the sealing band 2402 engages the inner surface 2404 of the wellbore casing 2104. According to an aspect, the sealing band 2402 may be compressed between the outer seal housing 2102 and the inner surface 2404 of the wellbore casing 2104 when the outer seal housing 2102 is in its expanded configuration.

As shown in FIG. 24, FIG. 25, FIG. 26, and FIG. 27, embodiments may include a method of sealing a wellbore casing 2104. FIG. 24 is a cross-sectional view of a ballistically actuated wellbore tool including an initiator 2206 and a detonation extender 2222, prior to ballistic activation. As illustrated, the initiator 2206 and the detonation extender 2222 are present, and the outer seal housing 2102 is in an unexpanded configuration and engaged with the ballistic housing 2106. According to an aspect, and as illustrated in FIG. 25, when the outer seal housing 2102 is in the expanded form, the ballistic housing 2106 is disengaged from the outer seal housing 2102.

FIG. 25 is a cross-sectional view of the ballistically actuated wellbore tool, after ballistic activation of the initiator 2206 and the detonation extender 2222, according to an aspect. The outer seal housing 2102 is illustrated in an expanded configuration. In the expanded configuration, the plurality of outwardly facing surface features 2316 and the sealing band 2402 of the outer seal housing 2102 is in contact with the inner surface 2404 of the wellbore casing 2104. While the plurality of outwardly facing surface features 2316 are depicted as teeth or a jagged surface, it is contemplated that the textured outer surface may include anything that roughens or enhances frictional engagement between the outer surface of the outer seal housing 2102 and the inner surface of the wellbore casing 2104. A sealing element or the sealing band 2402, if provided around the body of the outer seal housing 2102, is also compressed between the body of the outer seal housing 2102 and the inner surface 2404 of the wellbore casing 2104.

FIG. 26 is a cross-sectional view of the ballistically actuated wellbore tool, illustrating the ballistic housing 2106 being detached from the outer seal housing 2102 after ballistic activation. In the detached configuration, the ballistic housing 2106 and any other perforating tools attached thereto is pulled in an upward direction towards a surface of the wellbore. The perforation tools may then be activated at the upward position in the wellbore, and may subsequently be withdrawn from the wellbore using a wireline or any other retrieval mechanism.

Figure 27:
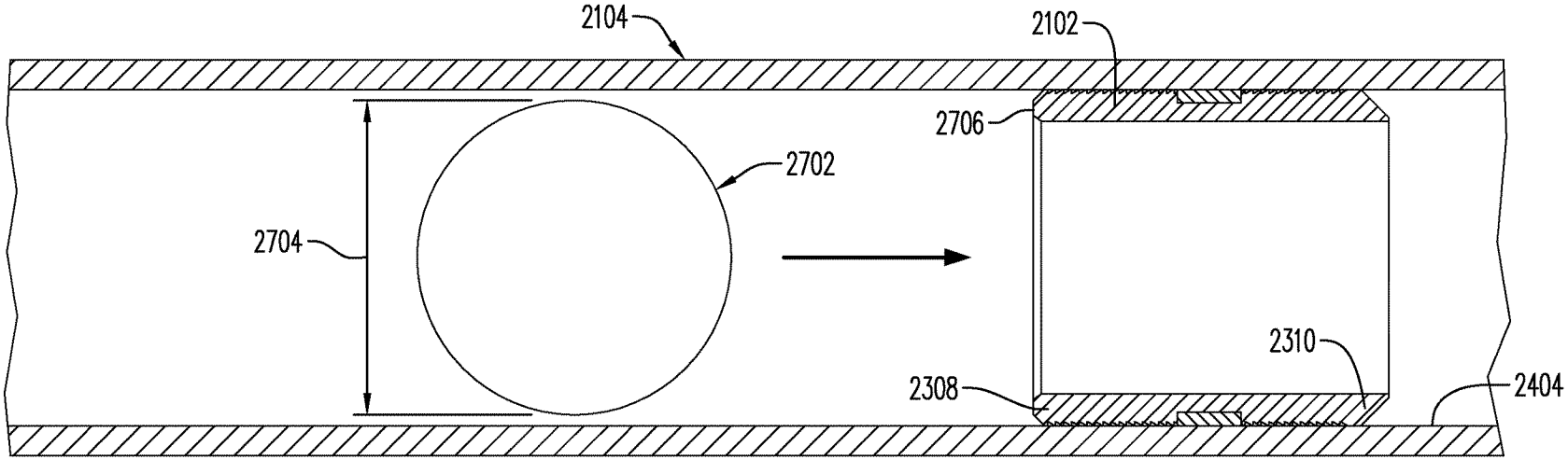
FIG. 27 is a cross-sectional view of the seal housing and a ball traveling towards the seal housing, according to an aspect.

FIG. 27 is a cross-sectional view of the outer seal housing 2102 and a ball 2702 traveling towards the outer seal housing 2102. The ball 2702 may have an outer diameter 2704 that enables it to be seated or disposed against a rim 2706 of the outer seal housing 2102. According to an aspect, the ball 2702 may be dropped into the wellbore casing 2104 after ballistic activation and detachment of the ballistic housing 2106 from the outer seal housing 2102, thereby sealing a flow path through the outer seal housing 2102 in its expanded form. Once the ball 2702 has sealed the flow path and isolated the upstream zone, fracking fluid may then be pumped into the wellbore casing 2104 to fracture the hydrocarbon formations via the perforations that the perforating gun/(s) created.

According to an aspect, the outer seal housing 2102 may be dimensioned to receive frac balls of different sizes or different maximum outer diameters.

Example Specifications for Outer Seal Housing

| Casing OD (inches) | Casing ID | Casing Wall Thickness | Running OD Range (before activation) | Open Flow ID Range (after Activation) | % of open flow as compared to unrestricted casing |
|---|---|---|---|---|---|
| 3.5 | 2.992 | 0.254 | 2.7 to 2.8 | 2.0 to 2.5 | 45% to 70% |
| 4.5 | 4.090 | 0.205 | 3.5 to 3.9 | 2.7 to 3.5 | 44% to 73% |
| | 4.052 | 0.224 | | | 44% to 75% |
| | 4.000 | 0.250 | | | 46% to 77% |
| | 3.920 | 0.290 | 3.3 to 3.7 | 2.8 to 3.6 | 44% to 84% |
| | 3.826 | 0.337 | | | 46% to 89% |
| 5.0 | 4.408 | 0.296 | 3.7 to 4.0 | 2.9 to 3.7 | 40% to 70% |
| | 4.276 | 0.362 | | | 43% to 75% |
| | 4.126 | 0.437 | | | 46% to 80% |

-continued

Example Specifications for Outer Seal Housing

| Casing OD (inches) | Casing ID | Casing Wall Thickness | Running OD Range (before activation) | Open Flow ID Range (after Activation) | % of open flow as compared to unrestricted casing |
|---|---|---|---|---|---|
| 5.5 | 4.950 | 0.275 | 4.4 to 4.7 | 3.7 to 4.5 | 56% to 83% |
| | 4.892 | 0.304 | | | 57% to 85% |
| | 4.778 | 0.361 | 4.0 to 4.3 | 3.5 to 4.2 | 54% to 77% |
| | 4.670 | 0.415 | | | 56% to 81% |
| | 4.548 | 0.476 | | | 59% to 85% |

Figure 28:
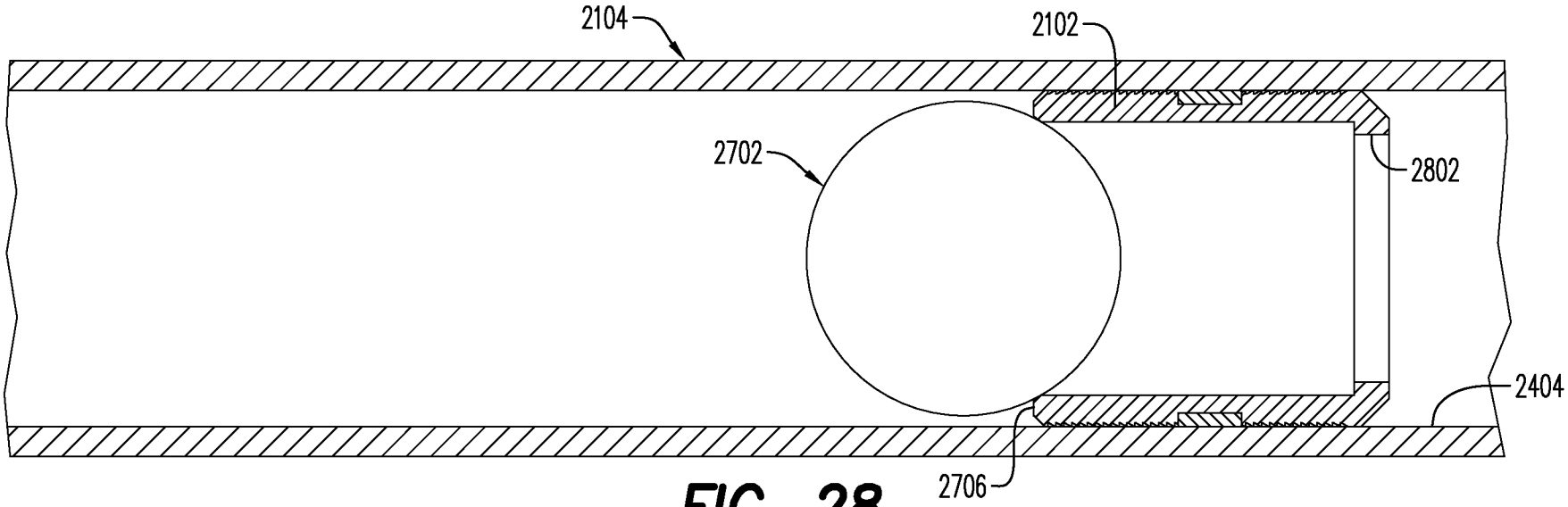
FIG. 28 is a cross-sectional view of the seal housing of FIG. 27, illustrating the ball seated in the seal housing.

FIG. 28 is a cross-sectional view of the seal housing of FIG. 27, illustrating the ball 2702 seated in the opening 2312 at the first end 2308 of the outer seal housing 2102, at the rim 2706. While the ball 2702 is shown as seated at the first end 2308 of the outer seal housing 2102, it is contemplated that the ball may be seated within any area along the length of the opening 2312. For example, a ball 2702 having a smaller outer diameter than the inner diameter of the outer seal housing 2102 at the first end 2308 may be seated in a second seat 2802 of the outer seal housing 2102 that has a lesser inner diameter than the inner diameter at the first end 2308. In other words, the outer seal housing 2102 may have as stepped inner surface that is able to provide a seat for receiving the outer seal housing 2102. It is further contemplated that the outer seal housing 2102 may have a general conical configuration/inner surface profile along the opening 2312, with the larger inner diameter being at the first end 2308 and the smaller inner diameter being at the second end 2310 of the outer seal housing 2102.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Approximating language, as used herein throughout the specification and claims, may be applied to modify any quantitative representation that could permissibly vary without resulting in a change in the basic function to which it is related. Accordingly, a value modified by a term such as "about" or "approximately" is not to be limited to the precise value specified. Such approximating language may refer to the specific value and/or may include a range of values that may have the same impact or effect as understood by persons of ordinary skill in the art field. For example, approximating language may include a range of +/−10%, +/−5%, or +/−3%. The term "substantially" as used herein is used in the common way understood by persons of skill in the art field with regard to patents, and may in some instances function as approximating language. In some instances, the approximating language may correspond to the precision of an instrument for measuring the value.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A ballistically actuated plug for being deployed in a wellbore casing, comprising:

a ballistic housing comprising a first housing portion including a chamber, and a second housing portion having a noncompressible core;

an initiator positioned within the chamber;

a detonation extender in ballistic communication with the initiator and circumferentially disposed around the noncompressible core;

an outer seal housing circumferentially disposed around the noncompressible core, and a recess formed in an outer surface of the second housing portion;

a first sealing mechanism positioned around the outer surface of the second housing portion; and a second sealing mechanism positioned around the outer surface of the second housing portion;

wherein the detonation extender is configured, upon detonation, to expand the outer seal housing from an unexpanded form to an expanded form to secure the outer seal housing within the wellbore casing;

the recess is configured to receive the detonation extender;

the recess extends between the first sealing mechanism and the second sealing mechanism; and the first sealing mechanism and the second sealing mechanism are both spaced apart from the recess.

2. The ballistically actuated plug of claim 1, wherein a channel extends from the chamber of the first housing portion to the recess, such that at least a portion of the detonation extender is positioned in the channel.

3. The ballistically actuated plug of claim 2, wherein the detonation extender is at least one of detonating cord and a plurality of compressed explosive pellets.

4. The ballistically actuated plug of claim 2, wherein the detonation extender is a detonating cord wrapped around the noncompressible core to form at least two layers of detonating cord.

5. The ballistically actuated plug of claim 4, wherein the two layers of detonating cord are wrapped around the noncompressible core in a staggered configuration.

6. The ballistically actuated plug of claim 1, wherein the ballistic housing is formed from a single monolithic piece of metal.

7. The ballistically actuated plug of claim 1, wherein the outer seal housing further comprises:

a first end;

a second end opposite the first end; and an opening extending between the first end and the second end, wherein the recess formed in the outer surface of the second housing portion is positioned in the opening.

8. The ballistically actuated plug of claim 1, wherein the outer seal housing has an external surface, and the external surface comprises a plurality of outwardly facing surface features configured to engage an inner surface of a wellbore casing.

9. A ballistically actuated plug for being deployed in a wellbore casing, comprising:

a ballistic housing comprising a first housing portion including a chamber, and a second housing portion extending from the first housing portion;

an initiator positioned within the chamber;

a detonation extender in side-by-side contact with the initiator and extending from the chamber to an outer surface of the second housing portion;

an outer seal housing circumferentially disposed around the second housing portion;

a recess formed in the outer surface of the second housing portion;

a first sealing mechanism positioned around the outer surface of the second housing portion; and a second sealing mechanism positioned around the outer surface of the second housing portion, wherein the detonation extender is configured, upon detonation, to expand the outer seal housing from an unexpanded form to an expanded form to secure the outer seal housing within the wellbore casing;

the recess is configured to receive the detonation extender;

the recess extends between the first sealing mechanism and the second sealing mechanism, and the first sealing mechanism and the second sealing mechanism are both spaced apart from the recess.

10. The ballistically actuated plug of claim 9, wherein the second housing portion comprises a noncompressible core.

11. The ballistically actuated plug of claim 9, wherein the detonation extender extends from the chamber and is circumferentially disposed around the second housing portion.

12. The ballistically actuated plug of claim 11, wherein a channel extends from the chamber of the first housing portion to the recess, such that at least a portion of the detonation extender is positioned in the channel.

13. The ballistically actuated plug of claim 12, wherein the detonation extender is a detonating cord wrapped around the second housing portion to form at least two layers of detonating cord, and wherein the two layers of detonating cord are wrapped around the second housing portion in a staggered configuration.

14. The ballistically actuated plug of claim 9, wherein the outer seal housing has an external surface, and the external surface comprises:

a plurality of outwardly facing surface features; and a sealing band extending around the external surface of the outer seal housing, wherein the plurality of outwardly facing surface features and the sealing band are configured to engage an inner surface of a wellbore casing.

* * * * *